US012588765B2

(12) United States Patent
Lapointe

(10) Patent No.: US 12,588,765 B2
(45) Date of Patent: Mar. 31, 2026

(54) ROCKING FURNITURE MEMBER WITH POWER SYNCHRONOUS MECHANISM

(71) Applicant: La-Z-Boy Incorporated, Monroe, MI (US)

(72) Inventor: Larry P. Lapointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 438 days.

(21) Appl. No.: 18/143,240

(22) Filed: May 4, 2023

(65) Prior Publication Data

US 2024/0365982 A1 Nov. 7, 2024

(51) Int. Cl.

| | |
|---|---|
| ***A47C 3/025*** | (2006.01) |
| ***A47C 1/02*** | (2006.01) |
| ***A47C 1/024*** | (2006.01) |
| ***A47C 1/032*** | (2006.01) |
| ***A47C 1/034*** | (2006.01) |
| ***A47C 1/035*** | (2006.01) |

(Continued)

(52) U.S. Cl.

CPC ..... *A47C 3/0251* (2018.08); *A47C 1/02* (2013.01); *A47C 1/024* (2013.01); *A47C 1/03211* (2013.01); *A47C 1/0342* (2013.01); *A47C 1/0345* (2013.01); *A47C 1/035* (2013.01); *A47C 3/027* (2013.01); *A47C 7/50* (2013.01)

(58) Field of Classification Search

None

See application file for complete search history.

(56) References Cited

U.S. PATENT DOCUMENTS

| | | | |
|---|---|---|---|
| 203,602 | A | 5/1878 | Dietsch |
| 1,182,854 | A | 5/1916 | Poler |

(Continued)

FOREIGN PATENT DOCUMENTS

| | | | |
|---|---|---|---|
| CA | 1316807 | C | 4/1993 |
| CN | 87203587 | U | 1/1988 |

(Continued)

OTHER PUBLICATIONS

International Search Report and Written Opinion of the International Searching Authority for Application No. PCT/US2014/019455, dated May 26, 2014.

(Continued)

*Primary Examiner* — Robert Canfield

(74) *Attorney, Agent, or Firm* — Harness, Dickey & Pierce, P.L.C.

(57) ABSTRACT

A furniture member may include a seat base, a seat assembly, a legrest platform, a drive rod, and a sequencing mechanism. The seat assembly is movable relative to the seat base. The legrest platform is coupled to the seat assembly. The drive rod is rotatable relative to the seat assembly, and rotation of the drive rod causes the seat assembly and the legrest platform to move. The sequencing mechanism includes a cam that is attached to the drive rod and a follower wheel that is attached to the seat assembly. The cam is configured to prevent the seat assembly from moving between a first recline position and a second recline position while the seat assembly moves between first and second tilt positions and while the legrest platform moves between first and second legrest positions.

27 Claims, 45 Drawing Sheets

(51) Int. Cl.

| | |
|---|---|
| ***A47C 1/0355*** | (2013.01) |
| ***A47C 3/027*** | (2006.01) |
| ***A47C 7/50*** | (2006.01) |

(56) References Cited

U.S. PATENT DOCUMENTS 1,414,637 A 5/1922 Gell
2,473,895 A 6/1949 Mednick
2,677,412 A 5/1954 Thomas
2,719,572 A 10/1955 Goldberg
2,772,723 A 12/1956 Tunnell
3,096,121 A 7/1963 Knabusch et al.
3,179,466 A 4/1965 Garrett
3,191,990 A 6/1965 Rugg et al.
3,302,969 A 2/1967 Mizelle et al.
3,339,971 A 9/1967 Fletcher
3,352,601 A 11/1967 Cycowicz
3,567,280 A 3/1971 Bradshaw
3,637,255 A 1/1972 Re
3,638,995 A 2/1972 Flanagan et al.
3,758,151 A 9/1973 Re
3,815,954 A 6/1974 Rogers, Jr. et al.
3,865,432 A 2/1975 Rogers, Jr. et al.
3,880,462 A 4/1975 Mednick
3,926,472 A 12/1975 Evans
3,941,417 A 3/1976 Re
3,945,449 A 3/1976 Ostrow
4,077,663 A 3/1978 Cycowicz et al.
4,099,776 A 7/1978 Crum et al.
4,140,342 A 2/1979 Jones
4,179,157 A 12/1979 Shoemaker et al.
4,191,420 A 3/1980 Fassett et al.
4,212,494 A 7/1980 Dabney
4,212,495 A 7/1980 Gall
4,216,991 A 8/1980 Holobaugh
4,216,992 A 8/1980 Crum
4,226,468 A 10/1980 Johnson
4,226,473 A 10/1980 Johnson
4,244,620 A 1/1981 Harrison et al.
4,352,523 A 10/1982 Holobaugh, Jr.
4,364,603 A 12/1982 Johnson
4,367,895 A 1/1983 Pacitti et al.
4,373,602 A 2/1983 Tomita et al.
4,451,084 A 5/1984 Seeley
4,492,407 A 1/1985 Broadhead
4,519,647 A 5/1985 Rogers, Jr.
4,570,995 A 2/1986 Rogers, Jr.
4,570,996 A 2/1986 Rogers, Jr.
4,582,435 A 4/1986 Davis
4,586,749 A 5/1986 Nakatani
4,601,513 A 7/1986 Pine
4,650,211 A 3/1987 Tanahashi
4,662,597 A 5/1987 Uecker et al.
4,719,764 A 1/1988 Cook
4,740,031 A 4/1988 Rogers, Jr.
4,805,960 A 2/1989 Tacker
4,818,018 A 4/1989 Yamasaki
4,861,101 A 8/1989 Hartline
4,895,411 A 1/1990 Pine
4,915,444 A 4/1990 Rogers, Jr.
4,932,927 A 6/1990 Fillar
4,989,914 A 2/1991 Pine
5,011,220 A 4/1991 LaPointe
5,044,692 A 9/1991 Tidwell, Jr. et al.
5,054,850 A 10/1991 Pine
5,064,244 A 11/1991 Sproule
5,072,988 A 12/1991 Plunk
5,088,789 A 2/1992 LaPointe et al.
5,123,705 A 6/1992 Johnson
5,129,701 A 7/1992 Pine
5,141,284 A 8/1992 LaPointe
5,147,108 A 9/1992 LaPointe
5,156,441 A 10/1992 Byersmith et al.
5,171,000 A 12/1992 LaPointe et al.
5,215,351 A * 6/1993 Lapointe ..... A61G 5/14 297/DIG. 10
5,217,276 A 6/1993 LaPointe et al.
5,217,277 A 6/1993 Rasnick et al.
5,234,253 A 8/1993 LaPointe et al.
5,238,295 A 8/1993 Harrell
5,271,660 A 12/1993 LaPointe et al.
5,312,153 A 5/1994 Lin
5,314,238 A * 5/1994 Komorowski ..... A61G 5/14 297/DIG. 10
5,323,526 A 6/1994 Saul et al.
5,328,235 A 7/1994 Saul et al.
5,348,367 A 9/1994 Mizelle
5,360,255 A 11/1994 Cook et al.
5,423,591 A 6/1995 LaPointe et al.
5,435,621 A 7/1995 Komorowski et al.
5,435,622 A 7/1995 Fay et al.
5,466,046 A 11/1995 Komorowski et al.
5,480,209 A 1/1996 May
5,480,213 A 1/1996 Sproule
5,503,453 A 4/1996 Saul et al.
5,527,095 A 6/1996 Marshall et al.
5,567,009 A 10/1996 Fay et al.
5,570,927 A 11/1996 LaPointe et al.
5,570,930 A 11/1996 LaPointe et al.
5,582,457 A 12/1996 Komorowski et al.
5,597,209 A 1/1997 Bart et al.
5,651,580 A * 7/1997 LaPointe ..... A61G 5/14 297/DIG. 10
5,664,832 A 9/1997 Stevens et al.
5,730,494 A 3/1998 LaPointe et al.
5,765,913 A 6/1998 LaPointe et al.
5,772,278 A 6/1998 Kowalski
5,775,775 A 7/1998 Hoffman
5,806,920 A 9/1998 Blount
5,806,921 A 9/1998 LaPointe et al.
5,823,614 A 10/1998 Johnson et al.
5,838,808 A 11/1998 Prosser
5,857,739 A 1/1999 Smith
5,865,457 A 2/1999 Knabusch et al.
5,890,765 A * 4/1999 LaPointe ..... A47C 1/0355 297/173
5,954,392 A 9/1999 Liss et al.
5,971,475 A 10/1999 Lawson et al.
5,975,627 A 11/1999 LaPointe et al.
5,992,930 A 11/1999 LaPointe et al.
5,992,931 A * 11/1999 LaPointe ..... A47C 1/0355 297/85 M
6,000,754 A 12/1999 Lawson
6,030,033 A 2/2000 Schultz
6,106,058 A 8/2000 Sur et al.
6,145,924 A 11/2000 Mero, Jr. et al.
6,179,328 B1 1/2001 Kawagoe et al.
6,227,489 B1 5/2001 Kitamoto et al.
6,231,120 B1 5/2001 Wiecek
6,276,753 B1 8/2001 Sur et al.
6,309,015 B1 10/2001 Pine
6,330,995 B1 12/2001 Mangeiga et al.
6,409,262 B1 6/2002 LaPointe
6,467,845 B1 10/2002 Chen
6,488,332 B1 12/2002 Markwald
6,491,342 B1 12/2002 Smith
6,655,732 B1 12/2003 LaPointe
6,827,401 B2 12/2004 Marshall et al.
6,939,076 B2 9/2005 LaPointe
6,945,599 B2 * 9/2005 May ..... A47C 3/03 297/85 L
6,988,769 B2 1/2006 LaPointe
7,021,711 B1 * 4/2006 Hoffman ..... A47C 3/027 297/270.3
7,261,367 B2 8/2007 Duncan et al.
7,275,789 B2 10/2007 LaPointe
7,311,359 B2 12/2007 Smith
7,338,132 B2 3/2008 LaPointe
7,357,450 B2 4/2008 Rogers
7,431,387 B2 10/2008 LaPointe et al.
7,431,392 B2 10/2008 Tamara
7,475,944 B2 1/2009 Griepentrog et al.
7,552,970 B2 6/2009 LaPointe
7,585,018 B2 9/2009 LaPointe et al.
7,637,571 B2 12/2009 Okano et al.

(56) References Cited

U.S. PATENT DOCUMENTS

| | | | |
|---|---|---|---|
| 7,673,933 | B2 | 3/2010 | Lawson |
| 7,731,276 | B2 | 6/2010 | Hoffman et al. |
| 7,823,966 | B2 | 11/2010 | Buchholz |
| 7,828,380 | B2 | 11/2010 | Olarte |
| 7,850,232 | B2 | 12/2010 | Casteel |
| 8,113,574 | B2 | 2/2012 | Hoffman et al. |
| 8,132,855 | B2 | 3/2012 | Richard |
| 8,308,228 | B2 | 11/2012 | Lawson et al. |
| 8,573,687 | B2 | 11/2013 | Lawson et al. |
| 8,590,964 | B2 | 11/2013 | Murphy et al. |
| 8,616,627 | B2 | 12/2013 | Murphy et al. |
| 8,622,467 | B2 | 1/2014 | Murphy et al. |
| 8,696,054 | B2 | 4/2014 | Crum |
| 9,314,101 | B2 | 4/2016 | Harwood et al. |
| 9,357,847 | B2 | 6/2016 | Murphy |
| 9,433,295 | B2 | 9/2016 | Crum |
| 9,635,943 | B2 | 5/2017 | Lawson |
| 9,655,450 | B2 | 5/2017 | Marshall et al. |
| 9,655,451 | B2 | 5/2017 | Harwood et al. |
| 9,808,090 | B2 | 11/2017 | Carrera |
| 9,895,000 | B2 | 2/2018 | Hassman |
| 9,986,832 | B2 | 6/2018 | LaPointe et al. |
| 9,986,835 | B2 | 6/2018 | LaPointe et al. |
| 10,092,106 | B2 | 10/2018 | LaPointe et al. |
| 10,485,347 | B2 | 11/2019 | Lawson et al. |
| 10,492,613 | B2 | 12/2019 | LaPointe et al. |
| 10,512,332 | B2 | 12/2019 | LaPointe et al. |
| 10,512,333 | B2 | 12/2019 | Lawson et al. |
| 10,524,574 | B2 | 1/2020 | LaPointe et al. |
| 10,524,575 | B2 | 1/2020 | LaPointe |
| 10,537,178 | B2 | 1/2020 | Marshall et al. |
| 10,568,428 | B2 | 2/2020 | Marshall et al. |
| 10,653,243 | B2 | 5/2020 | Lawson et al. |
| 10,681,987 | B2 | 6/2020 | Liu et al. |
| 10,709,246 | B2 | 7/2020 | Murphy |
| 10,750,870 | B2 | 8/2020 | Marshall et al. |
| 10,779,653 | B2 | 9/2020 | LaPointe et al. |
| 10,820,708 | B2 | 11/2020 | LaPointe et al. |
| 10,890,235 | B2 | 1/2021 | Bucove |
| 11,197,549 | B1 | 12/2021 | LaPointe et al. |
| 11,490,736 | B1 | 11/2022 | Liu et al. |
| 11,622,629 | B2 * | 4/2023 | LaPointe ..... A47C 1/0345 297/362.11 |
| 2001/0026088 | A1 | 10/2001 | Robinson |
| 2003/0057743 | A1 | 3/2003 | May |
| 2004/0000803 | A1 | 1/2004 | Guillot et al. |
| 2005/0035632 | A1 | 2/2005 | Tseng |
| 2005/0067867 | A1 | 3/2005 | May |
| 2006/0061147 | A1 | 3/2006 | Johnson et al. |
| 2006/0103202 | A1 | 5/2006 | Maki et al. |
| 2006/0249992 | A1 | 11/2006 | LaPointe et al. |
| 2006/0249993 | A1 | 11/2006 | Rogers |
| 2007/0040419 | A1 | 2/2007 | LaPointe et al. |
| 2007/0085395 | A1 | 4/2007 | LaPointe |
| 2007/0158980 | A1 | 7/2007 | LaPointe et al. |
| 2007/0241589 | A1 | 10/2007 | LaPointe |
| 2008/0129006 | A1 | 6/2008 | Johnson et al. |
| 2008/0150329 | A1 | 6/2008 | Lawson |
| 2009/0152915 | A1 | 6/2009 | Krasna et al. |
| 2009/0218862 | A1 | 9/2009 | Du et al. |
| 2009/0243368 | A1 | 10/2009 | LaPointe |
| 2009/0284054 | A1 | 11/2009 | Humer et al. |
| 2011/0016627 | A1 | 1/2011 | Blevins et al. |
| 2011/0175426 | A1 | 7/2011 | Lawson |
| 2011/0233972 | A1 | 9/2011 | Weicek |
| 2011/0248544 | A1 | 10/2011 | Adams et al. |
| 2011/0248545 | A1 | 10/2011 | LaPointe et al. |
| 2011/0248547 | A1 | 10/2011 | LaPointe et al. |
| 2011/0304193 | A1 | 12/2011 | Murphy et al. |
| 2012/0112517 | A1 | 5/2012 | Hoffman et al. |
| 2012/0193946 | A1 | 8/2012 | Robertson |
| 2013/0062914 | A1 | 3/2013 | Marshall et al. |
| 2013/0140855 | A1 | 6/2013 | Murphy et al. |
| 2013/0140856 | A1 | 6/2013 | Murphy et al. |
| 2013/0175847 | A1 | 7/2013 | Lawson |
| 2013/0249256 | A1 | 9/2013 | Payne, Jr. et al. |
| 2014/0049079 | A1 | 2/2014 | Lawson et al. |
| 2014/0049084 | A1 | 2/2014 | Lawson et al. |
| 2014/0070585 | A1 | 3/2014 | LaPointe |
| 2014/0103688 | A1 | 4/2014 | Wilson |
| 2014/0246819 | A1 | 9/2014 | Harwood et al. |
| 2014/0312660 | A1 | 10/2014 | Natuzzi et al. |
| 2014/0327282 | A1 | 11/2014 | Crum |
| 2014/0333099 | A1 | 11/2014 | Lu et al. |
| 2014/0368011 | A1 | 12/2014 | LaPointe |
| 2015/0196123 | A1 | 7/2015 | Buehrer |
| 2015/0250320 | A1 | 9/2015 | Arceci et al. |
| 2015/0272329 | A1 | 10/2015 | Lawson |
| 2015/0282619 | A1 | 10/2015 | Lawson |
| 2016/0058195 | A1 | 3/2016 | Huang et al. |
| 2016/0100686 | A1 | 4/2016 | Regev |
| 2016/0100687 | A1 | 4/2016 | Murphy et al. |
| 2016/0120315 | A1 | 5/2016 | Robertson |
| 2016/0192779 | A1 | 7/2016 | Harwood et al. |
| 2016/0206097 | A1 | 7/2016 | Rivera |
| 2016/0206099 | A1 | 7/2016 | Robertson |
| 2016/0270537 | A1 | 9/2016 | Marshall et al. |
| 2016/0302573 | A1 | 10/2016 | Garland et al. |
| 2016/0325838 | A1 | 11/2016 | Erhel |
| 2016/0376007 | A1 | 12/2016 | Meindlhumer |
| 2017/0013961 | A1 | 1/2017 | LaPointe et al. |
| 2017/0042330 | A1 | 2/2017 | Bruce et al. |
| 2017/0101188 | A1 | 4/2017 | Auge et al. |
| 2017/0150818 | A1 | 6/2017 | Contreras |
| 2017/0347796 | A1 | 12/2017 | LaPointe et al. |
| 2017/0367483 | A1 | 12/2017 | Fecker et al. |
| 2018/0070725 | A1 | 3/2018 | LaPointe et al. |
| 2018/0078039 | A1 | 3/2018 | LaPointe et al. |
| 2018/0206644 | A1 | 7/2018 | Murphy |
| 2018/0228290 | A1 | 8/2018 | Kiwak et al. |
| 2018/0289156 | A1 | 10/2018 | Marshall et al. |
| 2018/0289157 | A1 | 10/2018 | Marshall et al. |
| 2018/0289158 | A1 | 10/2018 | Marshall et al. |
| 2019/0029436 | A1 | 1/2019 | Lin |
| 2019/0082841 | A1 | 3/2019 | LaPointe et al. |
| 2019/0082849 | A1 | 3/2019 | LaPointe et al. |
| 2019/0116981 | A1 | 4/2019 | LaPointe et al. |
| 2019/0290004 | A1 | 9/2019 | Lawson et al. |
| 2019/0313796 | A1 | 10/2019 | LaPointe |
| 2019/0350362 | A1 | 11/2019 | LaPointe et al. |
| 2019/0350368 | A1 | 11/2019 | Lapointe et al. |
| 2019/0380499 | A1 | 12/2019 | Kang |
| 2020/0163458 | A1 | 5/2020 | Murphy |
| 2020/0352333 | A1 | 11/2020 | LaPointe et al. |
| 2021/0022506 | A1 | 1/2021 | Murphy |
| 2021/0100364 | A1 | 4/2021 | Murphy |
| 2021/0169234 | A1 | 6/2021 | Jacobs et al. |
| 2022/0048627 | A1 | 2/2022 | Erhel et al. |
| 2022/0125201 | A1 | 4/2022 | Lapointe et al. |

FOREIGN PATENT DOCUMENTS

| | | | |
|---|---|---|---|
| CN | 2168480 | Y | 6/1994 |
| CN | 200976974 | Y | 11/2007 |
| CN | 104936483 | A | 9/2015 |
| CN | 105208896 | A | 12/2015 |
| CN | 113208347 | A | 8/2021 |
| CN | 113349581 | A | 9/2021 |
| DE | 623960 | C | 1/1936 |
| DE | 4122375 | A1 | 5/1992 |
| DE | 29707946 | U1 | 7/1997 |
| EP | 1504697 | A1 | 2/2005 |
| JP | S53147329 | A | 12/1978 |
| JP | H04259403 | A | 9/1992 |
| JP | H08266370 | A | 10/1996 |
| JP | H1146920 | A | 2/1999 |
| JP | 2001-046167 | A | 2/2001 |
| JP | 2001054443 | A | 2/2001 |
| JP | 2003070583 | A | 3/2003 |
| JP | 2003260097 | A | 9/2003 |
| JP | 2004065507 | A | 3/2004 |
| JP | 3125308 | U | 9/2006 |
| JP | 2008132141 | A | 6/2008 |
| JP | 2012070787 | A | 4/2012 |

(56) References Cited

FOREIGN PATENT DOCUMENTS

| | | | |
|---|---|---|---|
| JP | 2013172804 | A | 9/2013 |
| JP | 2014147849 | A | 8/2014 |
| JP | 2015-066194 | A | 4/2015 |
| JP | 3198305 | U | 6/2015 |
| JP | 2021133182 | A | 9/2021 |
| KR | 20060036132 | A | 4/2006 |
| KR | 100807370 | B1 | 2/2008 |
| KR | 101245357 | B1 | 3/2013 |
| TW | 374704 | B | 11/1999 |
| TW | 201919523 | A | 6/2019 |
| WO | 9611612 | A1 | 4/1996 |
| WO | 2008008235 | A2 | 1/2008 |
| WO | 2011094478 | A1 | 8/2011 |
| WO | 2012162499 | A1 | 11/2012 |
| WO | 2015066030 | A1 | 5/2015 |
| WO | 2015153446 | A1 | 10/2015 |
| WO | 2016092248 | A1 | 6/2016 |
| WO | 2017155069 | A1 | 9/2017 |
| WO | 2020118009 | A1 | 6/2020 |

OTHER PUBLICATIONS

International Search Report and Written Opinion of the International Searching Authority for Application No. PCT/US2016/021361, dated May 30, 2016.
International Search Report and Written Opinion of the International Searching Authority for Application No. PCT/US2018/025467, dated Jul. 17, 2018.
European Search Report for Application No. 18159817.8, dated Sep. 26, 2018.
International Search Report and Written Opinion of the International Searching Authority for Application No. PCT/US2017/043899, dated Nov. 8, 2017.
International Search Report and Written Opinion of the International Searching Authority for Application No. PCT/US2006/031852, dated Jun. 17, 2008.
International Search Report and Written Opinion of the International Searching Authority for Application No. PCT/US2017/035976, dated Aug. 25, 2017.
European Search Report for Application No. 16824840.9, dated Dec. 7, 2018.
International Search Report and Written Opinion of the International Searching Authority for Application No. PCT/US2016/032967, dated Aug. 19, 2016.
First Examination Report for New Zealand Application No. 738919, dated Mar. 14, 2019.
European Search Report for Application No. 19158581.9, dated May 3, 2019.
International Search Report and Written Opinion of the International Searching Authority for Application No. PCT/US2019/021568, dated Jun. 20, 2019.
International Search Report and Written Opinion of the International Searching Authority for Application No. PCT/US2019/064607, dated Mar. 26, 2020.
International Search Report and Written Opinion of the International Searching Authority for Application No. PCT/US2020/032159, dated Aug. 14, 2020.
Office Action for Taiwanese Application No. 106116858, dated Apr. 10, 2020. Translation provided by Lee and Li, Attorneys-at-Law.
Office Action for Taiwanese Application No. 107109634, dated Apr. 19, 2021. Translation provided by Lee and Li, Attorneys-at-Law.
Office Action for Canadian Application No. 2,896,885, dated Mar. 8, 2018.
Office Action for Canadian Application No. 2,896,885, dated Oct. 18, 2018.
First Examination Report for New Zealand Application No. 565885, dated Oct. 7, 2009.
First Examination Report for Australian Application No. 2016294155, dated Nov. 21, 2019.
First Examination Report for Indian Application No. 201817001204, dated Jan. 3, 2020.
European Search Report for Application No. 16765435.9, dated Sep. 5, 2018.
First Examination Report for Indian Application No. 201717033062, dated Apr. 24, 2020.
First Examination Report for New Zealand Application No. 735460, dated Mar. 2, 2018.
International Search Report and Written Opinion regarding International Application No. PCT/US2021/052135, dated Jan. 3, 2022.
International Search Report and Written Opinion regarding International Patent Application No. PCT/US2023/015263, dated Jun. 29, 2023.
International Search Report and Written Opinion of the ISA issued in PCT/US2024/024928, mailed Aug. 8, 2024; ISA/US.
International Search Report and Written Opinion regarding International Application No. PCT/US2024/013045, dated Jul. 25, 2024.
Chinese Office Action regarding Application No. 202180065617X dated Jul. 31, 2025 [machine translation].
International Search Report and Written Opinion of the ISA, issued in PCT/US2023/081628, maiiled Mar. 18, 2024; ISA/US (16 pages).
Office Action regarding Taiwanese Patent Application No. 114107320, Jul. 24, 2025 [Translation provided by Lee & Li].
Non-Final Office Action regarding U.S. Appl. No. 18/521,132 dated Oct. 22, 2025.
Pivoting Member with Adjustable Friction System—Oct. 30, 2024.
Viva Lift Power Recliners Catalog—Mar. 2019.
Viva Lift Power Recliner Collection Catalog [date unknown].
Viva Lift Power Recliner Collection—Atlas Plus Catalog [date unknown].

* cited by examiner

ROCKING FURNITURE MEMBER WITH POWER SYNCHRONOUS MECHANISM

FIELD

The present disclosure relates to a furniture member and more specifically, to a rocking furniture member with a power synchronous mechanism.

BACKGROUND

This section provides background information related to the present disclosure and is not necessarily prior art.

Furniture members such as chairs, sofas, loveseats, sectionals, and the like may include a seatback that is movable relative to a seat bottom between an upright position and a reclined position, using a recliner mechanism. Additionally, some furniture members may include a legrest mechanism that allows an occupant of the furniture member to move a legrest platform between a retracted position and an extended position to support the legs and/or feet of the occupant. Furthermore, some furniture members may include a rocker mechanism that allows the occupant of the furniture member to rock the furniture member between a rearward-tilt position and a forward-tilt position.

However, individually operating the recliner, legrest, and rocker mechanisms and the number of adjustable positions can become overwhelming for the occupant of the furniture member. The present disclosure provides a synchronous mechanism that synchronizes the recline, tilt, and legrest motions of the furniture member in order for the occupant to easily locate their desired and comfortable position without individually operating the recliner, legrest, and rocker mechanisms.

SUMMARY

This section provides a general summary of the disclosure and is not a comprehensive disclosure of its full scope or all of its features.

The present disclosure provides a furniture member that may include a seat base, a seat assembly, a legrest platform, a drive rod, and a sequencing mechanism. The seat assembly may be movable relative to the seat base. The seat assembly may be movable between a first recline position and a second recline position, and the seat assembly may be movable between a first tilt position and a second tilt position. The legrest platform may be coupled to the seat assembly and movable between a first legrest position and a second legrest position. The drive rod may be rotatable relative to the seat assembly. Rotation of the drive rod may cause the seat assembly to move from the first tilt position to the second tilt position and may cause the legrest platform to move from the first legrest position to the second legrest position. The sequencing mechanism may include a cam attached to the drive rod and a follower wheel attached to the seat assembly. The cam may be configured to prevent the seat assembly from moving between the first recline position and the second recline position while the seat assembly moves between the first tilt position and the second tilt position and while the legrest platform moves between the first legrest position and the second legrest position.

In some configurations of the furniture member of the above paragraph, rotation of the drive rod causes a first surface of the cam to contact the follower wheel and subsequent rotation of the drive rod causes a second surface of the cam to contact the follower wheel.

In some configurations of the furniture member of either of the above paragraphs, when the first surface of the cam contacts the follower wheel, the sequencing mechanism is configured to prevent the seat assembly from reclining from the first recline position to the second recline position. When the second surface of the cam contacts the follower wheel, the sequencing mechanism is configured to allow the seat assembly to recline from the first recline position to the second recline position.

In some configurations of the furniture member of any of the above paragraphs, the furniture member includes a motor powering rotation of the drive rod.

In some configurations of the furniture member of any of the above paragraphs, actuation of the motor controls movement of the seat assembly to achieve intermediate positions between the first recline position and the second recline position and intermediate positions between the first tilt position and the second tilt position. Actuation of the motor controls movement of the legrest platform to achieve intermediate positions between the first legrest position and the second legrest position.

In some configurations of the furniture member of any of the above paragraphs, the furniture member includes a rail, a sliding carriage and a support rod. The rail is attached to the motor. The sliding carriage is attached to the drive rod and coupled to the rail. The support rod is rotatable relative to the seat assembly and coupled to the motor.

In some configurations of the furniture member of any of the above paragraphs, the motor drives the sliding carriage to slide along the rail and simultaneously causes the drive rod to rotate. Rotation of the drive rod causes the seat assembly to simultaneously move between the first tilt position and the second tilt position and the legrest platform to simultaneously move between the first legrest position and the second legrest position.

In some configurations of the furniture member of any of the above paragraphs, the motor drives the rail to slide relative to the sliding carriage and simultaneously causes the support rod to rotate. Rotation of the support rod causes the seat assembly to move between the first recline position and the second recline position.

In some configurations of the furniture member of any of the above paragraphs, the furniture member includes a tilt linkage mechanism. The tilt linkage mechanism includes a clevis drivingly engaged to the drive rod and a wheel support panel pivotally attached to the seat base.

In some configurations of the furniture member of any of the above paragraphs, rotation of the drive rod causes the clevis to drive rotation of the wheel support panel, and rotation of the wheel support panel causes the seat assembly to move relative to the seat base between the first tilt position and the second tilt position.

In some configurations of the furniture member of any of the above paragraphs, the tilt linkage mechanism includes a first link rotatably attached to the clevis and the wheel support panel. The first link is movable independent of the clevis. The tilt linkage mechanism includes a second link rotatably attached to the wheel support panel and has a follower wheel extending from the second link.

In some configurations of the furniture member of any of the above paragraphs, the seat assembly is rockable between the first rock position and a second rock position. The first and second links and the wheel support panel simultaneously rotate as the seat assembly moves between the first and second rock positions. The seat assembly is rockable between the first rock position and the second rock position when the legrest platform is in the first legrest position.

In some configurations of the furniture member of any of the above paragraphs, when the follower wheel contacts the wheel support panel, the seat assembly is in the first rock position and is restricted from rocking further in a rearward direction.

In some configurations of the furniture member of any of the above paragraphs, when the first link contacts the clevis, the seat assembly is in the second rock position and is restricted from rocking further in a forward direction.

The present disclosure provides a furniture member that may include a seat base, a seat assembly, a legrest platform, a drive rod, a support rod, and a tilt linkage mechanism. The seat assembly may be movable relative to the seat base. The seat assembly may be movable between an upright position and a reclined position, and the seat assembly may be movable between a nominal tilt position and a rearward-tilt position. The legrest platform may be coupled to the seat assembly. The legrest platform may be movable between a stowed position and a deployed position. The drive rod may be rotatable relative to the seat assembly. Rotation of the drive rod causes the legrest platform to move from the stowed position to the deployed position. The support rod may be rotatable relative to the seat assembly. Rotation of the support rod may cause the seat assembly to move between the upright position and the reclined position. The tilt linkage mechanism may include a set of linkages attached the drive rod and the support rod, a first cam attached to the drive rod, a first follower wheel movable into rolling contact with the first cam, and a wheel support panel rotatably attached to the seat base. The tilt linkage mechanism may be configured to allow the seat assembly to move between the nominal tilt position and the rearward-tilt position simultaneously while the legrest platform moves between the stowed position and the deployed position and the seat assembly moves between the upright position and the reclined position.

In some configurations of the furniture member of the above paragraph, the furniture member may include a sequencing mechanism. The sequencing mechanism includes a second cam attached to the drive rod and a second follower wheel attached to the seat assembly. The second cam includes a first surface, a second surface, and third surface.

In some configurations of the furniture member of either of the above paragraphs, when the first surface of the second cam contacts the second follower wheel, the second cam is configured to prevent the seat assembly from moving between the upright position and the reclined position.

In some configurations of the furniture member of any of the above paragraphs, when the second surface of the second cam contacts the second follower wheel, the second cam is configured to allow the seat assembly to move between the upright position and the reclined position.

In some configurations of the furniture member of any of the above paragraphs, the furniture member may include a motor powering rotation of the drive rod.

In some configurations of the furniture member of any of the above paragraphs, actuation of the motor controls movement of the seat assembly to achieve intermediate positions between the upright position and the reclined position and intermediate positions between the nominal tilt position and the rearward-tilt position. Actuation of the motor controls movement of the legrest platform to achieve intermediate positions between the stowed position and the deployed position.

In some configurations of the furniture member of any of the above paragraphs, the furniture member may include a rail attached to the motor and a sliding carriage attached to the drive rod.

In some configurations of the furniture member of any of the above paragraphs, the motor first drives the sliding carriage to slide along the rail and simultaneously causes the drive rod to rotate. The motor subsequently drives the rail to slide relative to the sliding carriage and simultaneously causes the support rod to rotate.

In some configurations of the furniture member of any of the above paragraphs, the set of linkages of the tilt linkage mechanism include a first link coupled to the support rod and a second link coupled to the drive rod.

In some configurations of the furniture member of any of the above paragraphs, rotation of the first cam causes the first cam to contact the first follower wheel and simultaneously drives the set of linkages such that the seat assembly moves from the nominal tilt position to the rearward-tilt position.

In some configurations of the furniture member of any of the above paragraphs, the seat assembly is sequenced to move from a first synchronous position to a second synchronous position and from a third synchronous position to a fourth synchronous position. When the seat assembly moves between the first synchronous position and the fourth synchronous position, the seat assembly moves between the nominal tilt position and the rearward-tilt position and the legrest platform moves between the stowed position and the deployed position. When the seat assembly moves between the second synchronous position and the fourth synchronous position, the seat assembly moves between the upright position and the reclined position.

In some configurations of the furniture member of any of the above paragraphs, the seat assembly is rockable between a rearward-rock position and a forward-rock position. The set of linkages and the wheel support panel simultaneously rotate as the seat assembly moves between the rearward-rock and forward-rock positions. The seat assembly is free to rock between the forward-rock position and the rearward-rock position when the legrest platform is in the stowed position. The seat assembly is restricted from rocking between the forward-rock position and the rearward-rock position when the legrest platform is in the deployed position. In some configurations of the furniture member of any of the above paragraphs, when the first follower wheel contacts the wheel support panel, the seat assembly is in the rearward-rock position and is restricted from rocking further in a rearward direction.

In some configurations of the furniture member of any of the above paragraphs, when the first follower wheel contacts the first cam, the seat assembly is in the forward-rock position and is restricted from rocking further in a forward direction.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
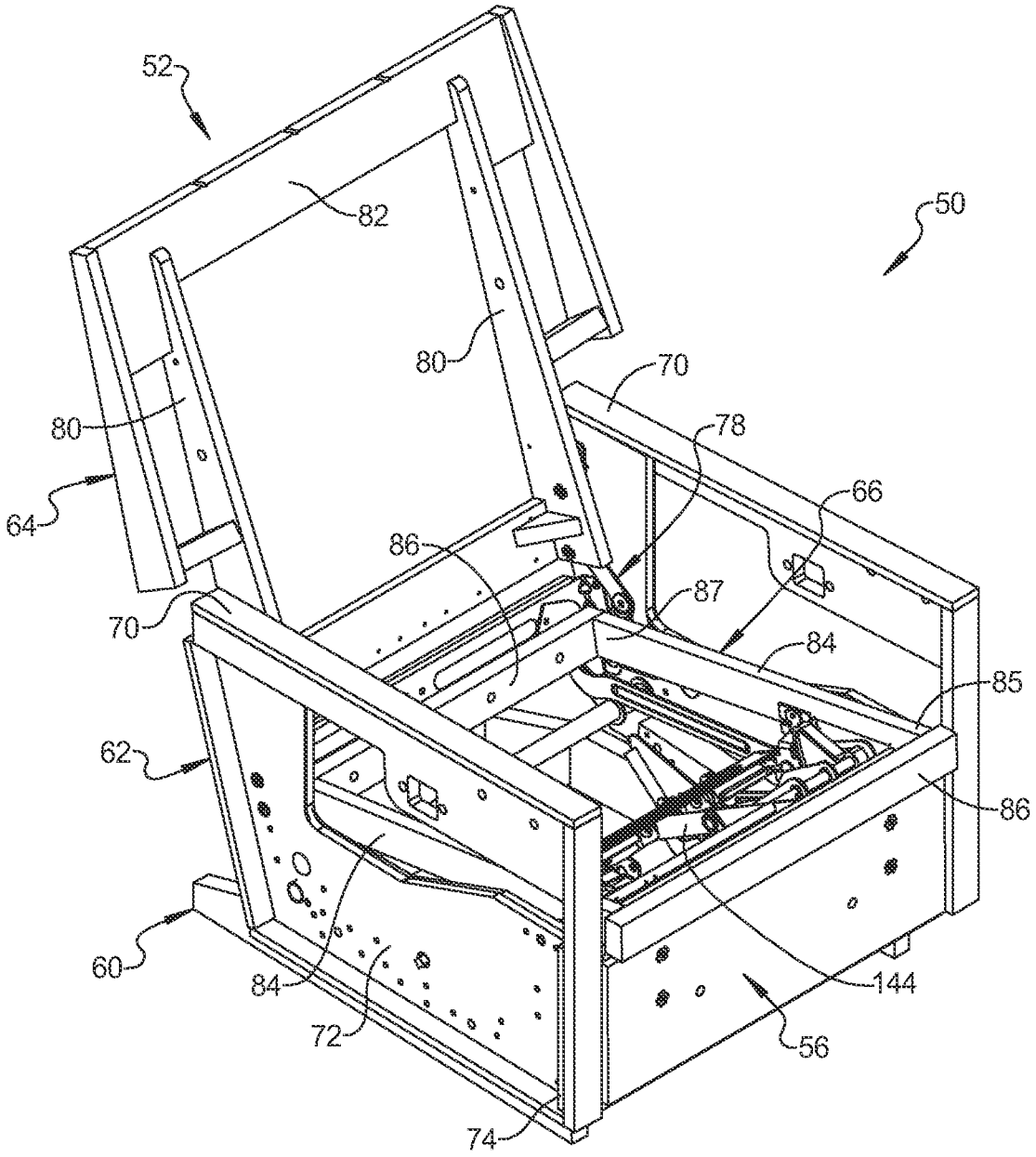
FIG. 1 is a perspective view of a furniture member showing a seat assembly in a first synchronous position according to the principles of the present disclosure.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
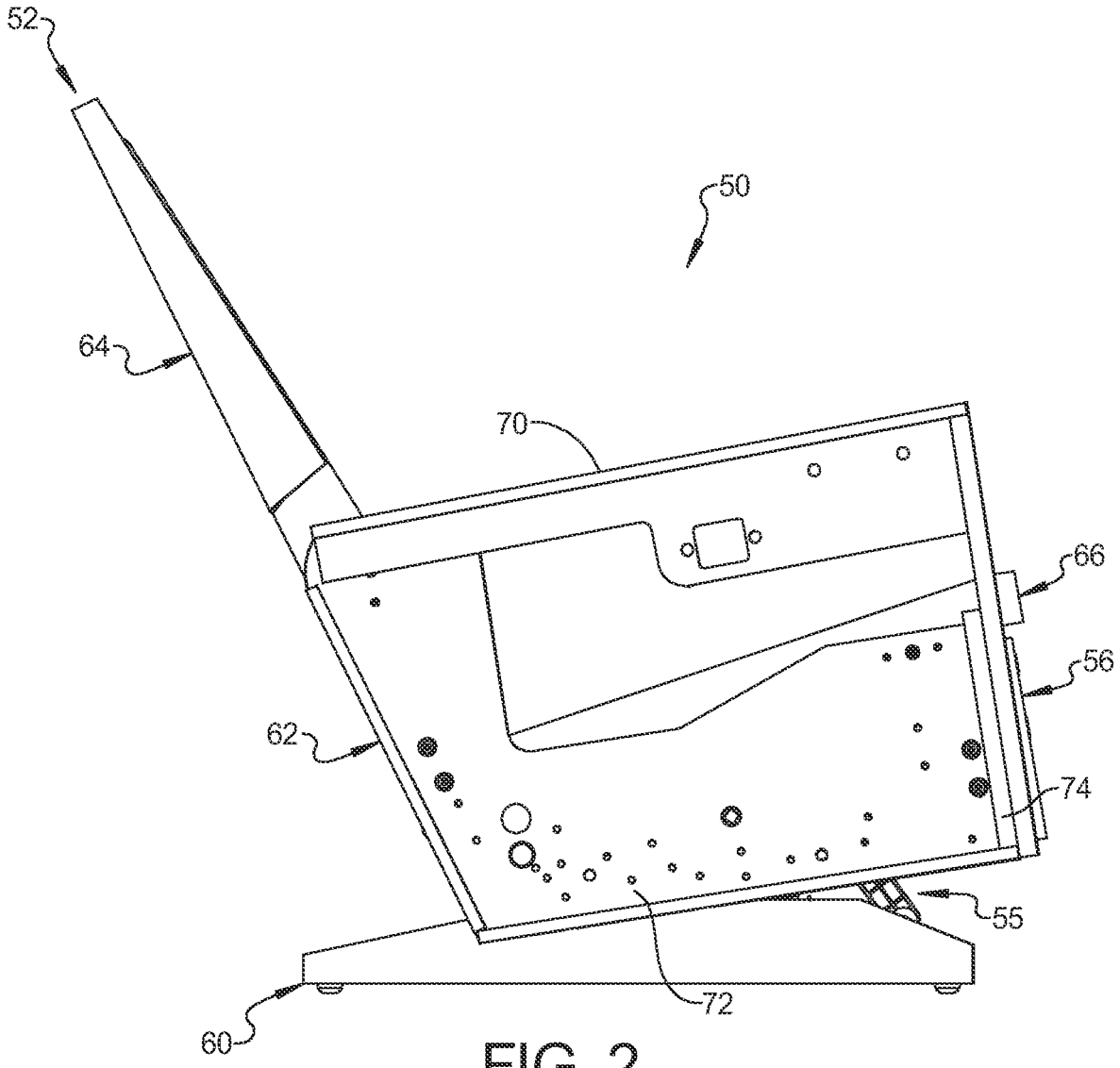
FIG. 2 is a side view of the furniture member showing the seat assembly in a rearward-tilt and rearward-rock position.
Figure 3:
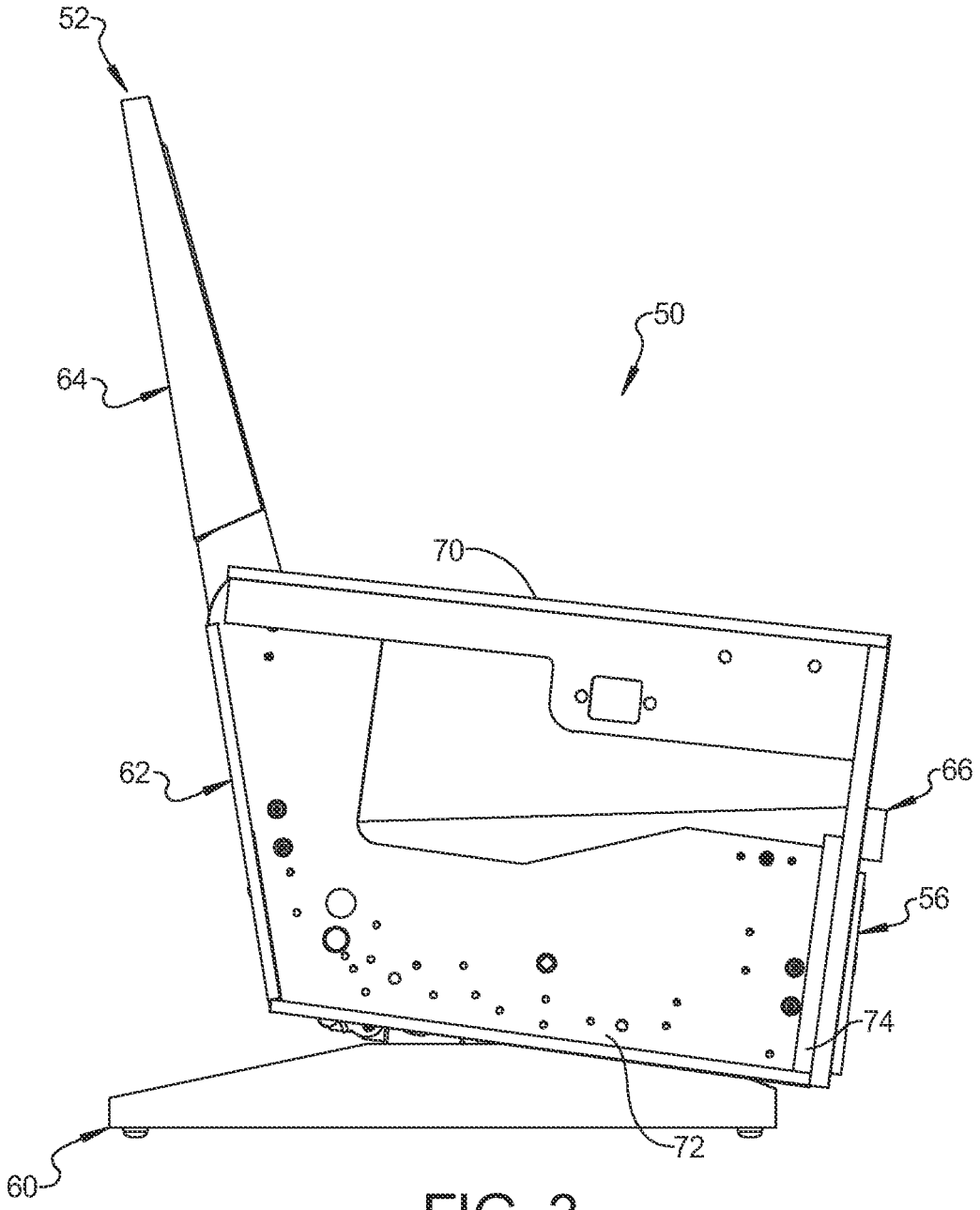
FIG. 3 is a side view of the furniture member showing the seat assembly in a forward-tilt and forward-rock position.

With reference to FIGS. 1-25, a furniture member 50 is provided that may include a seat base 60 and a seat assembly 52. The furniture member 50 may also include a drive actuator mechanism 54, a pair of tilt linkage mechanisms 55, a legrest mechanism 56, and a pair of sequencing mechanisms 58 (collectively referred to as a synchronous mechanism). As will be described in further detail below, the seat assembly 52 is movable relative to the seat base 60. The seat assembly 52 may rock forward and backward among a first rock position or a nominal rock position (FIG. 1), a second rock position or a rearward-rock position (FIG. 2), and a third rock position or a forward-rock position (FIG. 3). Additionally, the seat assembly 52 may move among a first synchronous position (FIG. 1), a second synchronous position or a first intermediate position (FIG. 4), a third synchronous position or a second intermediate position (FIG. 5), and a fourth synchronous position (FIG. 6).

The seat assembly 52 may rock between the first, second, and third rock positions independent of the seat assembly 52 moving between the first, second, third, and fourth synchronous positions. More specifically, rocking of the seat assembly 52 between the first, second, and third rock positions is manually powered by an occupant sitting in the seat assembly 52. Movement of seat assembly 52 between the first, second, third, and fourth synchronous positions is electrically powered by a motor (e.g., motor 126). When the seat assembly 52 moves from the first synchronous position (FIG. 1) to the fourth synchronous position (FIG. 6), the seat assembly 52 tilts from a nominal tilt position to a rearward-tilt position, the seat assembly 52 reclines from an upright position or a first recline position to a reclined position or a second recline position, and the legrest mechanism 56 move from a stowed position to a deployed position. When the seat assembly 52 moves from the fourth synchronous position (FIG. 6) back to the first synchronous position (FIG. 1), the seat assembly 52 tilts from the rearward-tilt position to the nominal tilt position, the seat assembly 52 returns from the reclined position to the upright position, and the legrest mechanism 56 returns from the deployed position to the stowed position.

Figure 4:
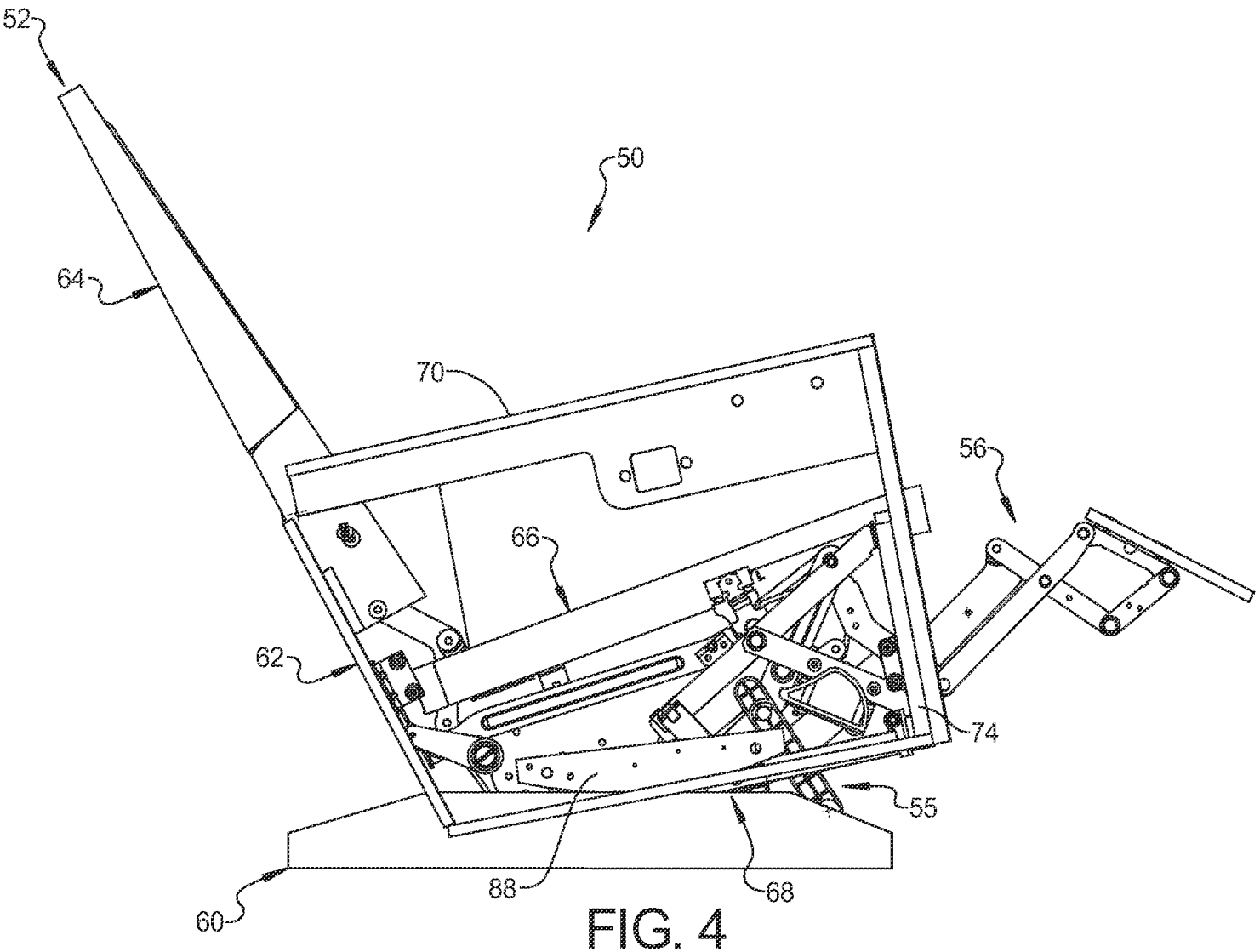
FIG. 4 is a side view of the furniture member showing the seat assembly in a second synchronous position.
Figure 5:
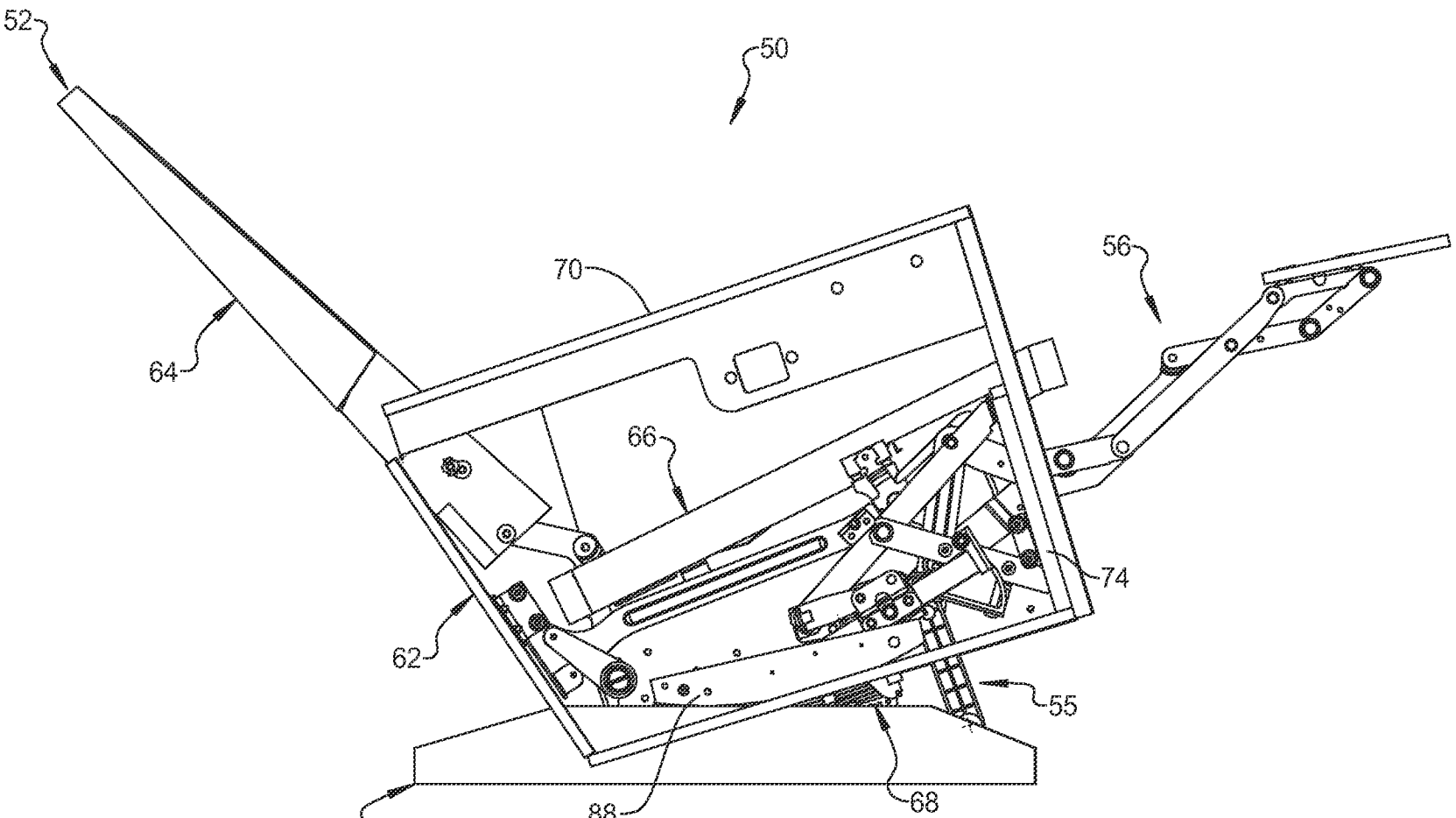
FIG. 5 is a side view of the furniture member showing the seat assembly in a third synchronous position.
Figure 6:
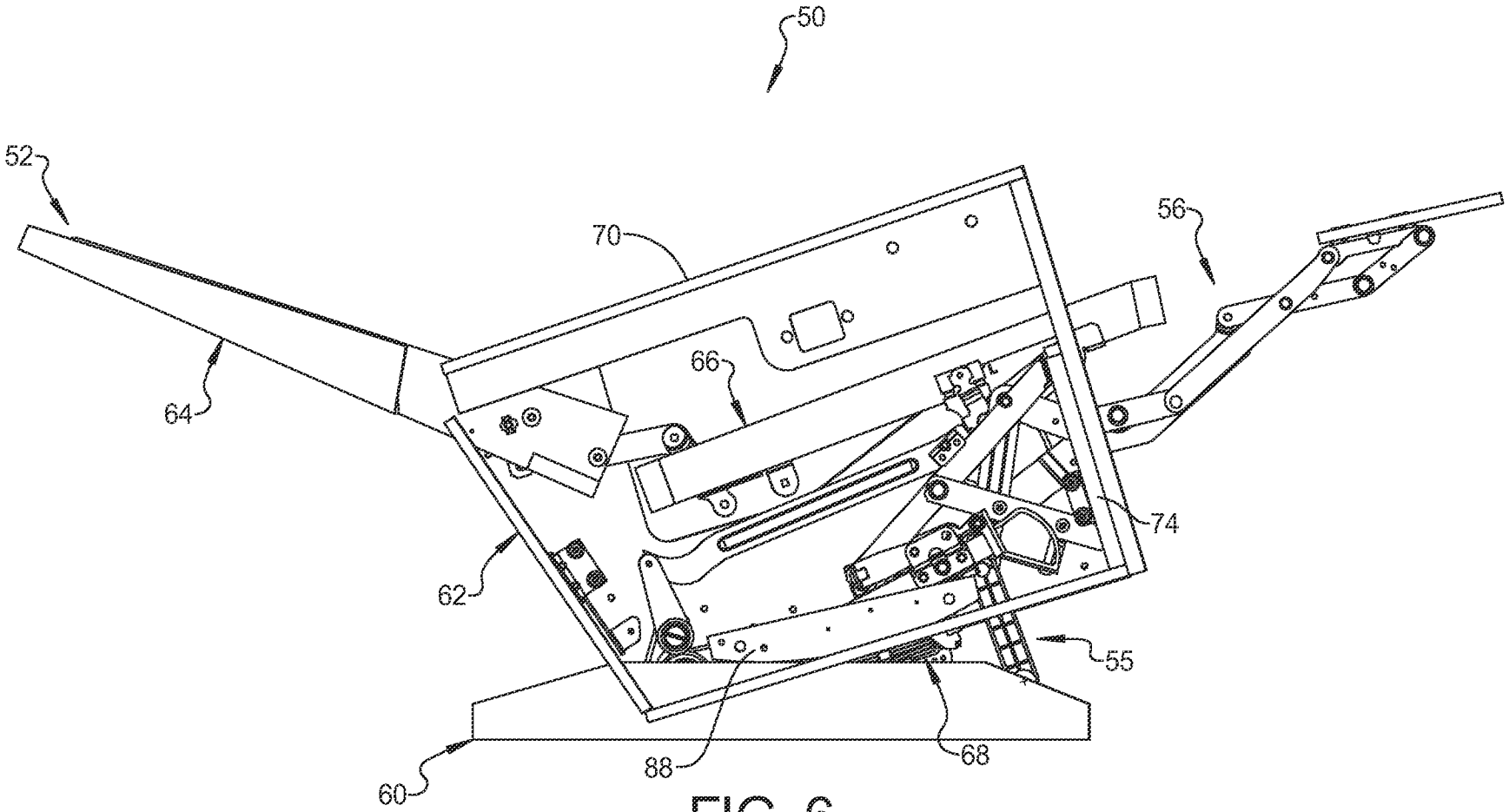
FIG. 6 is a side view of the furniture member showing the seat assembly in a fourth synchronous position.

With reference to FIGS. 1-6, the seat assembly 52 may include a seat frame assembly 62, a seatback assembly 64, a seat bottom assembly 66, and a rocker assembly 68 (FIGS. 4-6). The seat frame assembly 62 may include a pair of armrests frames 70, a pair of side support panels 72, and a front support panel 74. The armrest frames 70 may be positioned on opposing sides of the seat bottom assembly 66. The side support panel 72 may be attached to the armrest frames 70. The front support panel 74 may extend between the pair of side support panels 72.

As shown in FIG. 1, the seatback assembly 64 may be rotatably coupled to the seat bottom assembly 66 by a pair of linkages 78 to allow the seatback assembly 64 to rotate relative to the seat bottom assembly 66. The seatback assembly 64 may include a pair of spaced apart first panels 80 and a second panel 82 extending transversely between the pair of first panels 80.

The seat bottom assembly 66 may include a pair of first support beams 84 and a pair of second support beams 86. Each of the first support beam 84 may extend between a front end 85 and a rear end 87 that opposes the front end 85. The front end 85 may be positioned near the front support panel 74 and the rear end 87 may be positioned near the seatback assembly 64. A first one of the second support beams 86 may be attached to the pair of first support beams 84 at the front ends 85. A second one of the second support beam 86 may be attached to the pair of first support beams 84 at the rear ends 87. Accordingly, the pairs of first and second support beams 84, 86 may cooperate to substantially form a frame for the seat bottom assembly 66 that may support a seat cushion (not shown), seat bottom springs (not shown), and/or seat bottom slats (not shown), for example.

The pair of linkages 78 may attach the pair of first panels 80 of the seatback assembly 64 to the pair of first support beams 84 of the seat bottom assembly 66, respectively. More specifically, the pair of linkages 78 may attach the pair of first panels 80 to the rear ends 87 of the pair of first support beams 84. The pair of linkages 78 may support movement of the seatback assembly 64 and the seat bottom assembly 66 between the upright position and the reclined position.

Figure 7:
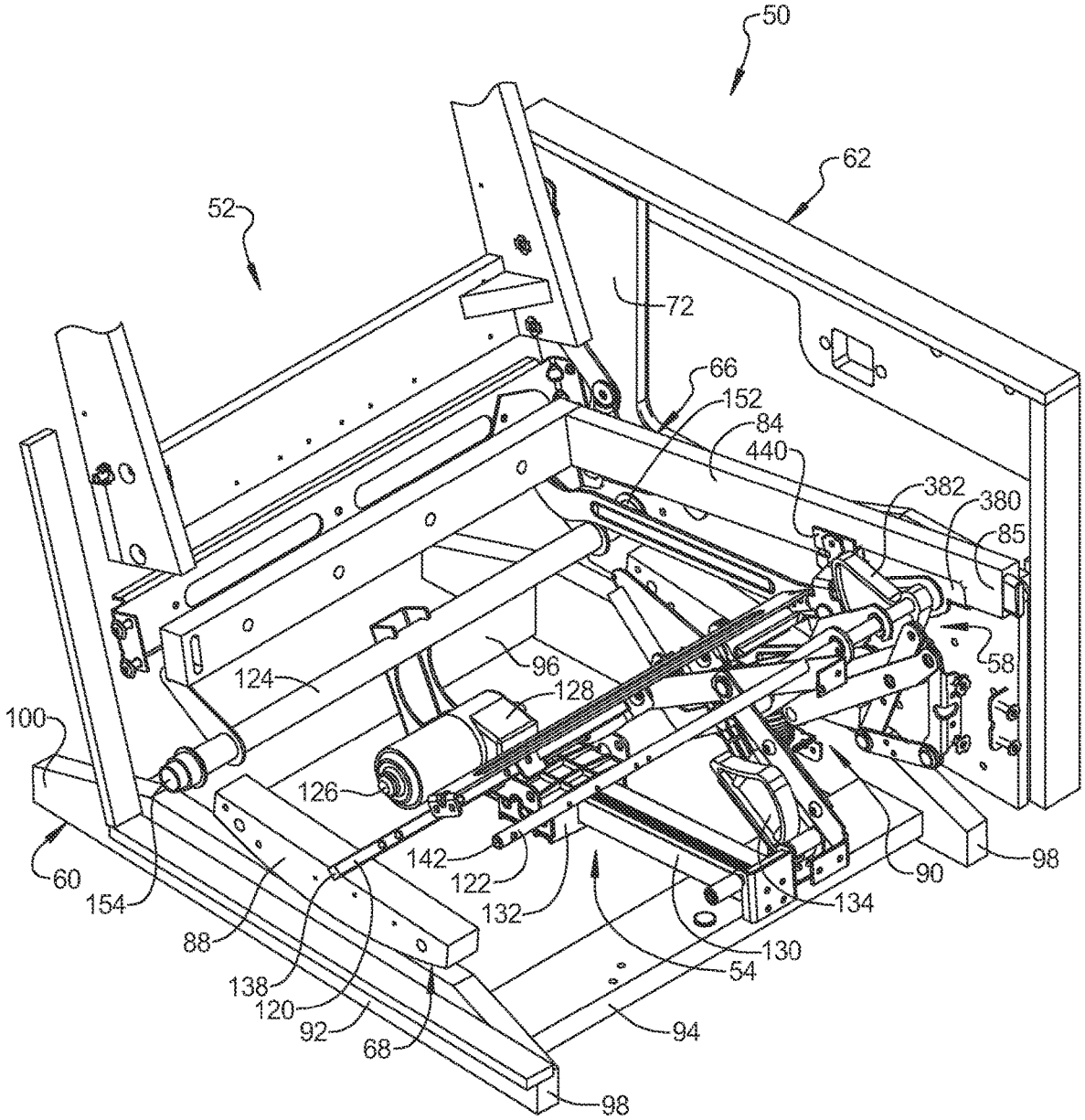
FIG. 7 is a partial perspective view of a synchronous mechanism of the furniture member.
Figure 8:
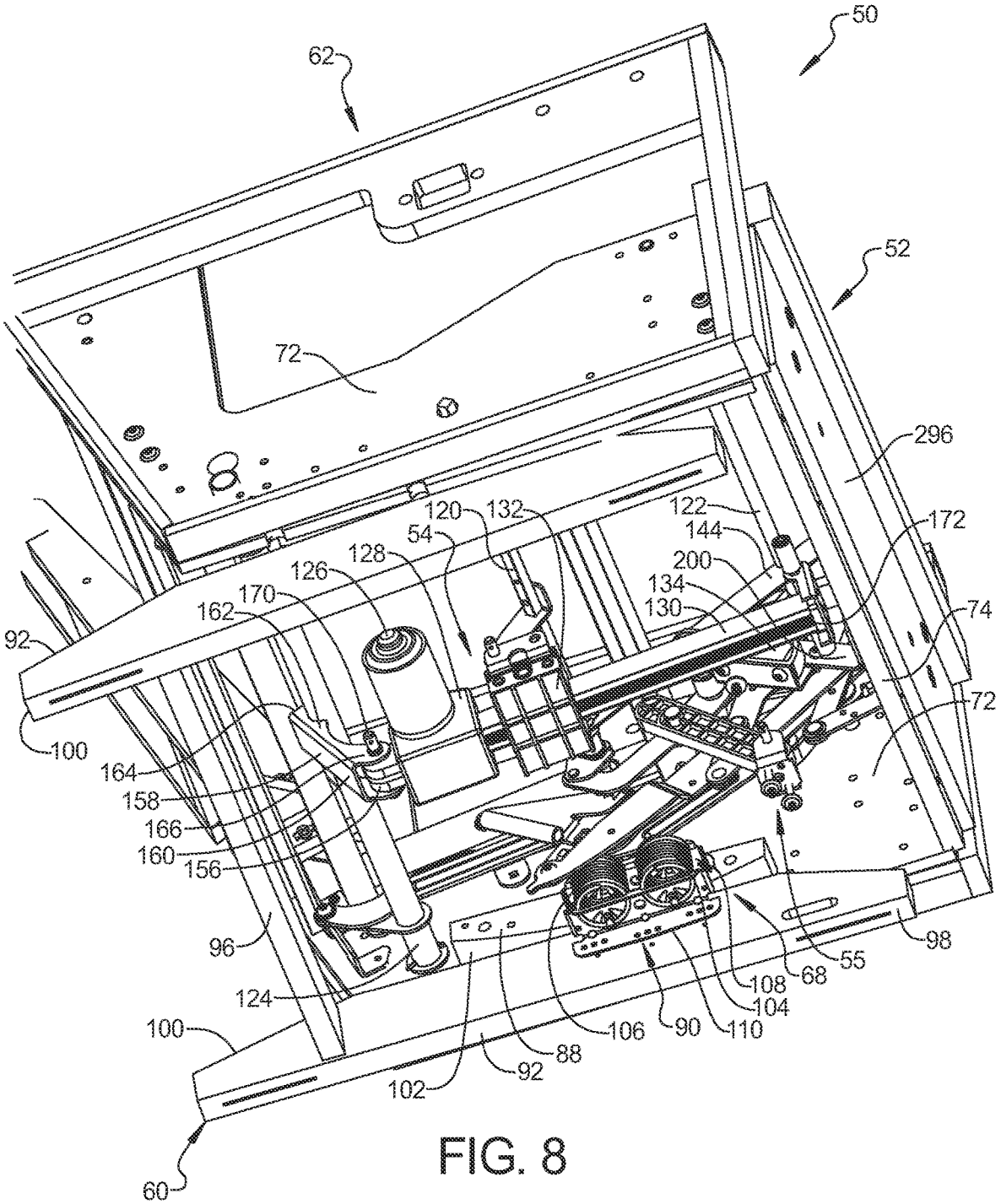
FIG. 8 is a partial perspective view of the synchronous mechanism.

As shown in FIGS. 7-8, the seat base 60 may include a pair of side support members 92, a first cross member 94 and a second cross member 96. Each of the side support members 92 may be positioned adjacent to the respective side support panels 72. The side support member 92 may extend between a first end 98 and a second end 100 that opposes the first end 98. The first cross member 94 may extend between the pair of side support members 92 and may be positioned adjacent to the first end 98. The second cross member 96 may extend between the pair of side support members 92 and may be spaced apart from the first cross member 94. The second cross member 96 may be positioned adjacent to the second end 100. The side support members 92 and the first and second cross members 94, 96 may be fixed relative to each other. In other words, the seat base 60 may be a stationary base frame for the furniture member 50.

As shown in FIGS. 7-8, the rocker assembly 68 may include a pair of rocker members 88, and a pair of rocker spring assemblies 90. The rocker members 88 may be mounted to the seat frame assembly 62 and may support the seat assembly 52 for rocking movement relative to the seat base 60 among the nominal rock position or nominal tilt position (FIG. 1), rearward-rock position (FIG. 2) or rearward-tilt position (FIG. 6), and the forward-rock position (FIG. 3). In the configuration shown in the figures, one of the rocker members 88 may be secured to a first one of the side support panels 72 and a first one of the rocker spring assemblies 90. A second one of the rocker members 88 may be secured to a second one of the side support panels 72 and a second one of the rocker spring assemblies 90. A bottom surface 102 of the rocker members 88 may be formed in a curved shape and may rollingly contact the respective side support member 92 of the seat base 60.

Each of the rocker spring assemblies 90 may be in mirror-image configuration with each other. With continued reference to FIG. 8, each rocker spring assembly 90 may include a first spring 104, a second spring 106, a first mount bracket 108, and a second mount bracket 110. The first mount bracket 108 may be fixedly attached to the rocker member 88 or to the seat frame assembly 62 (e.g., the side support panel 72). The second mount bracket 110 may be fixedly attached to the seat base 60 (e.g., to the side support member 92 of the seat base 60). The first and second springs 104, 106 may be disposed between and attached to the first and second mount brackets 108, 110.

Figure 9:
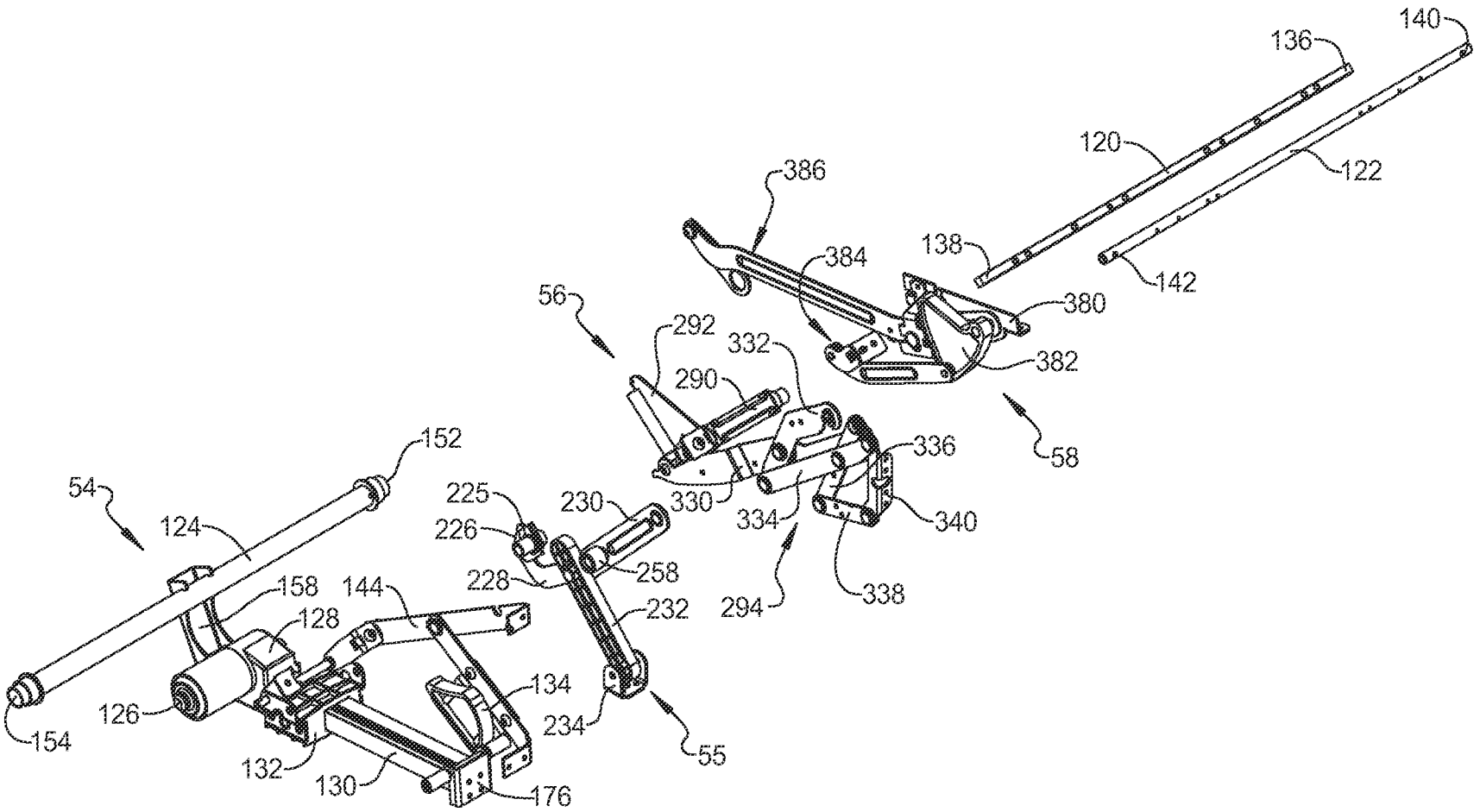
FIG. 9 is an exploded view of the synchronous mechanism.
Figure 10:
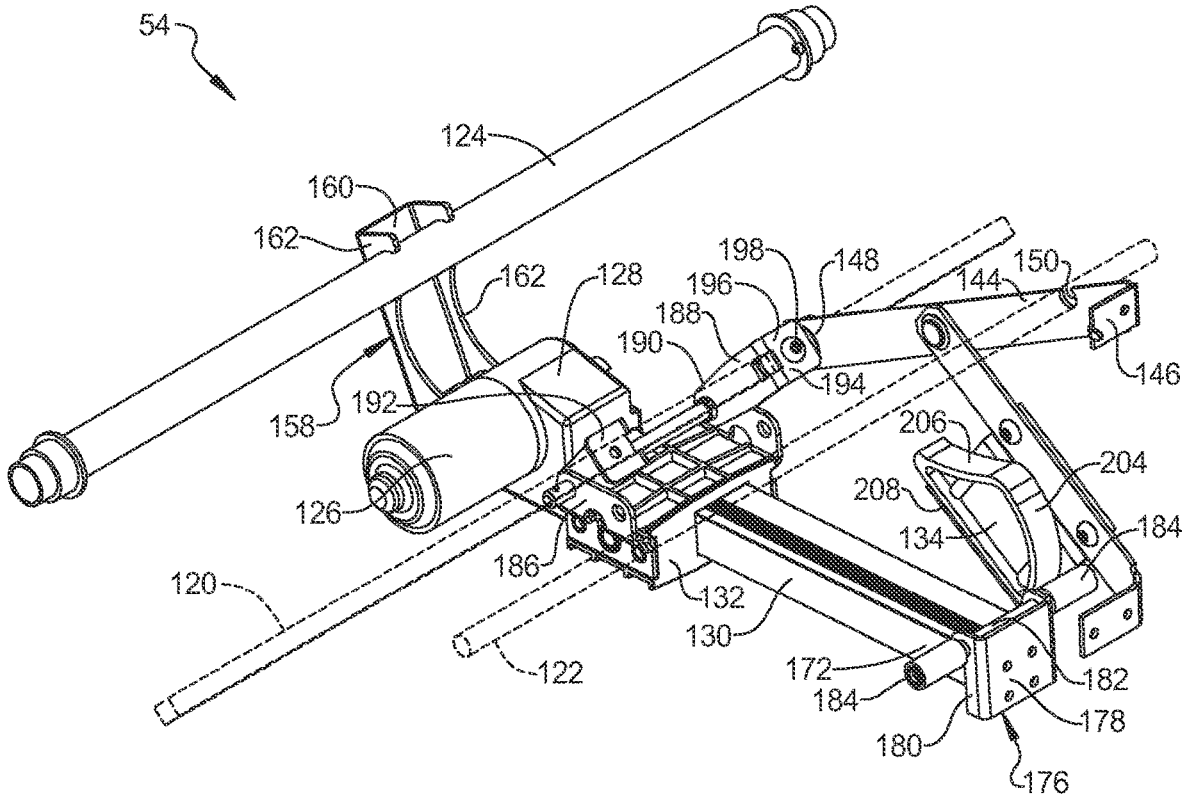
FIG. 10 is a perspective view of a drive actuator assembly of the synchronous mechanism, with the synchronous mechanism in a position of FIG. 1.
Figure 11:
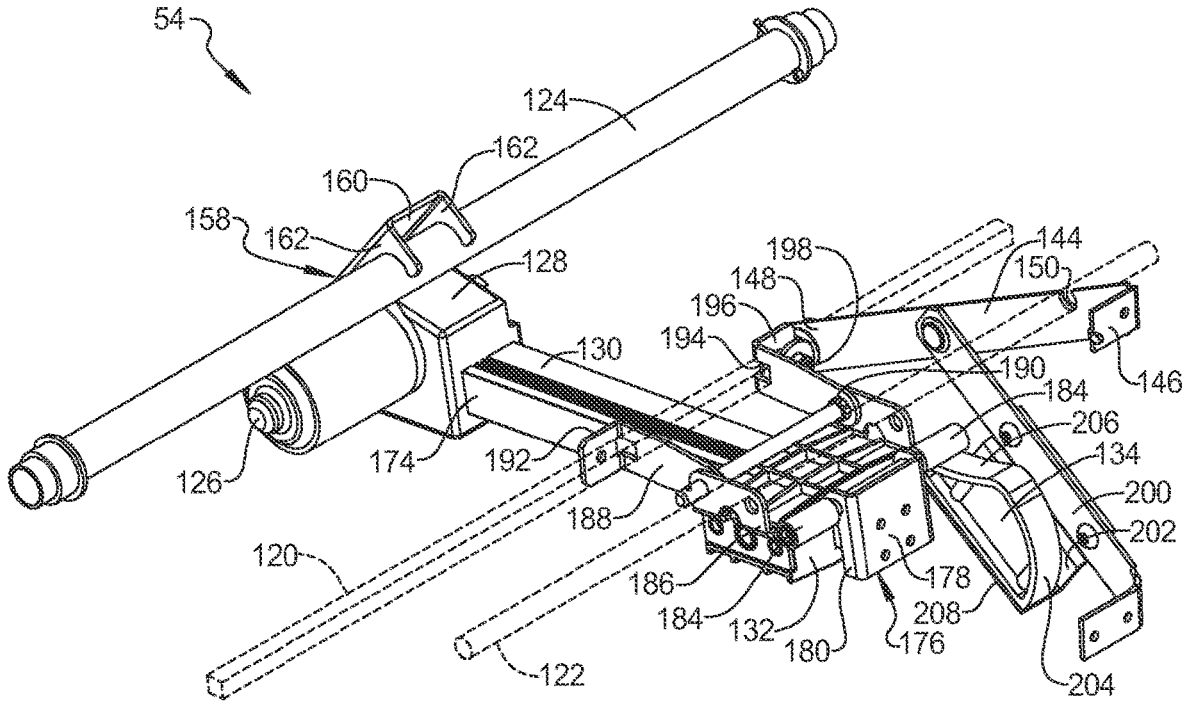
FIG. 11 is a perspective view of the drive actuator assembly of the synchronous mechanism, with the synchronous mechanism in a position of FIG. 6.

As shown in FIGS. 7-11, the drive actuator mechanism 54 may include a drive rod 120, a first support rod 122, a second support rod 124, a motor 126, a drive assembly 128, a rail 130, a sliding carriage 132, and a cam 134. The drive actuator mechanism 54 may be positioned equidistantly between the side support members 92 of the seat base 60. The drive actuator mechanism 54 is movable between a first position (FIG. 10) and a second position (FIG. 11). The first position of the drive actuator mechanism 54 corresponds to when the seat assembly 52 is in the first synchronous position (FIG. 1). The second position of the drive actuator mechanism 54 corresponds to when the seat assembly 52 is in the fourth synchronous position (FIG. 6).

As shown in FIGS. 7 and 9, the drive rod 120 may include a first rod end 136 and a second rod end 138 that opposes the first rod end 136. The drive rod 120 may be rotatably supported by the seat frame assembly 62. The first and second rod ends 136, 138 of the drive rod 120 may be received in the respective side support panel 72 of the seat frame assembly 62. The drive rod 120 may have a square cross-sectional shape. Alternatively, the drive rod 120 may have any other suitable cross-sectional shape.

As shown in FIGS. 7 and 9, the first support rod 122 may include a first rod end 140 and a second rod end 142 that opposes the first rod end 140. The first and second rod ends 140, 142 of the first support rod 122 may be received in the respective side support panel 72 of the seat frame assembly 62. The first support rod 122 may have a circular cross-sectional shape. Alternatively, the drive rod 120 may have any other suitable cross-sectional shape.

As shown in FIGS. 10-11, a brace member 144 may support the drive rod 120 and the first support rod 122. The brace member 144 includes a first member end 146 and a second member end 148 that opposes the first member end 146. The first member end 146 of the brace member 144 may be fixedly attach to the front support panel 74 (FIG. 1) of the seat frame assembly 62. The second member end 148 of the brace member 144 may receive the drive rod 120 such that the drive rod 120 is rotatable relative to the brace member 144. A recess 150 may be disposed between the first and second member ends 144, 146 that receive the first support rod 122.

As shown in FIGS. 7 and 9, the second support rod 124 may include a first rod end 152 and a second rod end 154 that opposes the first rod end 152. The first and second rod ends 152, 154 of the second support rod 124 may be received in the respective side support panel 72 of the seat frame assembly 62. The second support rod 124 may have a circular cross-sectional shape. Alternatively, the second support rod 124 may have any other suitable cross-sectional shape.

As shown in FIGS. 8, the motor 126 may be an AC or DC electric motor and may be operatively connected to the drive assembly 128. The drive assembly 128 may be rotatably attached to the second support rod 124 using a connecting bracket 156 and a support link 158. The connecting bracket 156 may be fixedly attached to the drive assembly 128 and may extend toward the second cross member 96 of the seat base 60. The support link 158 may include a back wall 160 and opposing sidewalls 162 that cooperate to substantially form a U-shape. Additionally, the support link 158 may extend between a first end 164 and a second end 166 that opposes the first end 164. The first end 164 of the support link 158 may be attached to the second support rod 124. More specifically, the sidewalls 162 of the support link 158 may transversely receive a portion of the second support rod 124. The second end 166 of the support link 159 may receive the connecting bracket 156 between the sidewalls 162. A mechanical fastener 170 may extends through the sidewalls 162 of the support link 158 and the connecting bracket 156 to rotatably attach the support link 158 to the connecting bracket 156.

As shown in FIGS. 10-11, the rail 130 may extend between a first end 172 and a second end 174 that opposes the first end 172. The first end 172 of the rail 130 may be positioned near the front support panel 74 (FIG. 8). The second end 174 of the rail 130 may be at least partially housed in the drive assembly 128. A bracket 176 may be disposed at the first end 172 of the rail 130. The bracket 176 may include a back wall 178 and opposing sidewalls 180 that extend from the back wall 178 to substantially form a U-shape. The back wall 178 of the bracket 176 may abut the first end 172 of the rail 130. The sidewalls 180 may be positioned beside the rail 130. A rod 182 may extend through the opposing sidewalls 180 of the bracket 176. A pair of follower wheels 184 may be disposed on opposing ends of the rod 182 and positioned outboard of the sidewalls 180 of the bracket 176.

The sliding carriage 132 is slidably disposed and supported on the rail 130. The sliding carriage 132 is configured to slide in either a forward direction (i.e., toward the first end 172 of the rail 130) or a rearward or backward direction (i.e., toward the second end 174 of the rail 130). As illustrated in FIG. 10, the sliding carriage 132 may be positioned at the second end 174 of the rail 130 when seat assembly 52 is in the first synchronous position (FIG. 1). As illustrated in FIG. 11, the sliding carriage 132 is positioned at the first end 172 of the rail 130 when the seat assembly 52 is in the fourth synchronous position (FIG. 6). Accordingly, the sliding carriage 132 slides between the first and second ends 172, 174 of the rail 130.

As shown in FIGS. 10-11, the sliding carriage 132 is connected to the drive rod 120 using a first pair of links 186 and a second pair of links 188 disposed on opposing sides of the sliding carriage 132. The first pair of links 186 may be fixedly attached to the sliding carriage 132. The second pair of links 188 may include a first end 190 that is rotatably coupled to the first pair of links 186 and a second end 192 that is drivingly engaged with the drive rod 120. More specifically, the second end 192 of the links 188 may include an aperture 194 that receives the drive rod 120 and is shaped to the cross-sectional shape of the drive rod 120. Additionally, the second end 192 of the links 188 may include a flange 196. The flange 196 may be positioned beside the drive rod 120 and may be fixedly attached to the drive rod 120 using a mechanical fastener 198.

The cam 134 may be fixedly attached to the brace member 144 using a connecting link 200 and a connecting bracket 202. The connecting link 200 may be fixedly attached to the brace member 144 and the front support panel 74 (FIG. 8) at opposing ends. The connecting bracket 202 may be fixedly attached the cam 134 to the connecting link 200. The cam 134 may include a first side 204, a second side 206, and a third side 208 that cooperate to substantially form a triangular shape. The first side 204 of the cam 134 is curved and is formed substantially in a convex configuration. The second side 206 of the cam 134 is also curved and is formed substantially in a concave configuration. The third side 208 of the cam 134 connects the first and second sides 204, 206 of the cam 134 at opposing ends and is formed substantially in a flat configuration.

The follower wheel 184 may be supported on the cam 134. As illustrated in FIG. 10, the follower wheel 184 may contact the first side 204 of the cam 134 in a position adjacent to the third side 208 of the cam 134 when the seat assembly 52 is in the first synchronous position (FIG. 1). As illustrated in FIG. 11, the follower wheel 184 may contact the second side 206 of the cam 134 in a position adjacent to the third side 208 of the cam 134 in a position adjacent to the third side 208 of the cam 134 when the seat assembly 52 is in the fourth synchronous position (FIG. 6). Accordingly, the follower wheel 184 is configured to roll against the first and second sides 204, 206 of the cam 134. The cam 134 may be made of a polymeric material such as polyoxymethylene, from a composite or a metal material, or any other suitable material.

Figure 12:
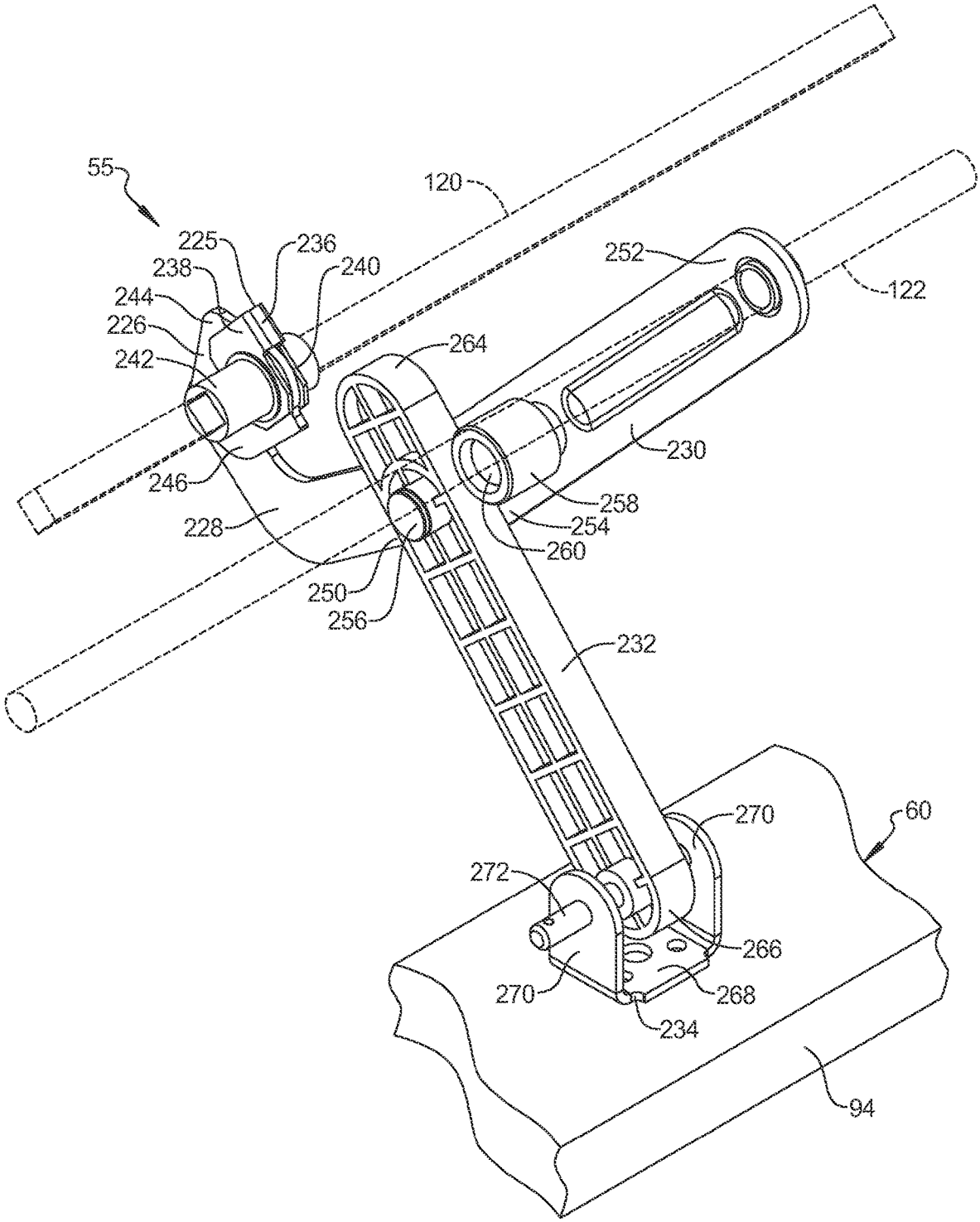
FIG. 12 is a perspective view of a tilt linkage assembly of the synchronous mechanism, with the synchronous mechanism in the position of FIG. 1.
Figure 13:
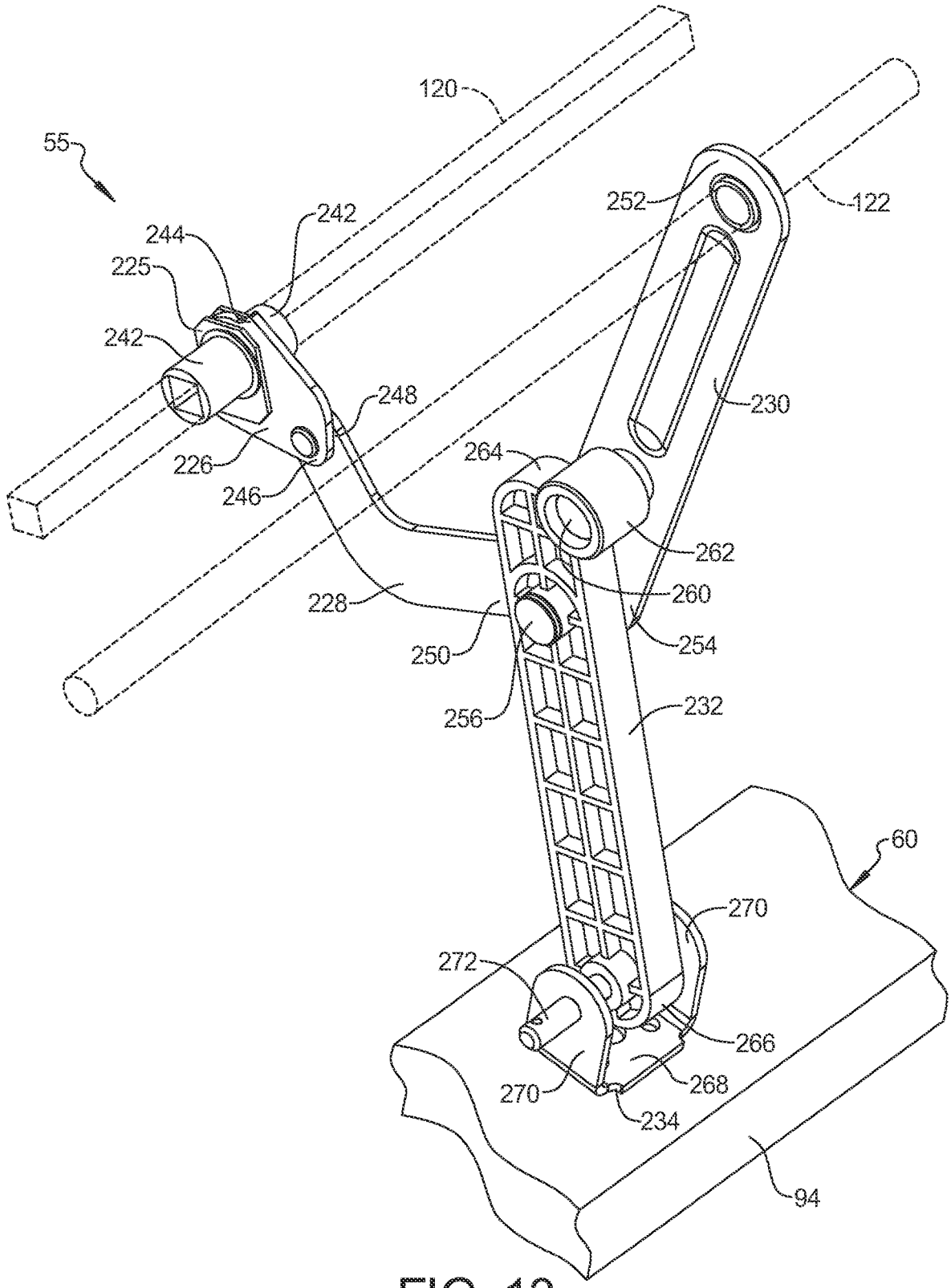
FIG. 13 is a perspective view of the tilt linkage assembly of the synchronous mechanism, with the synchronous mechanism in the position of FIGS. 2 and 6.
Figure 14:
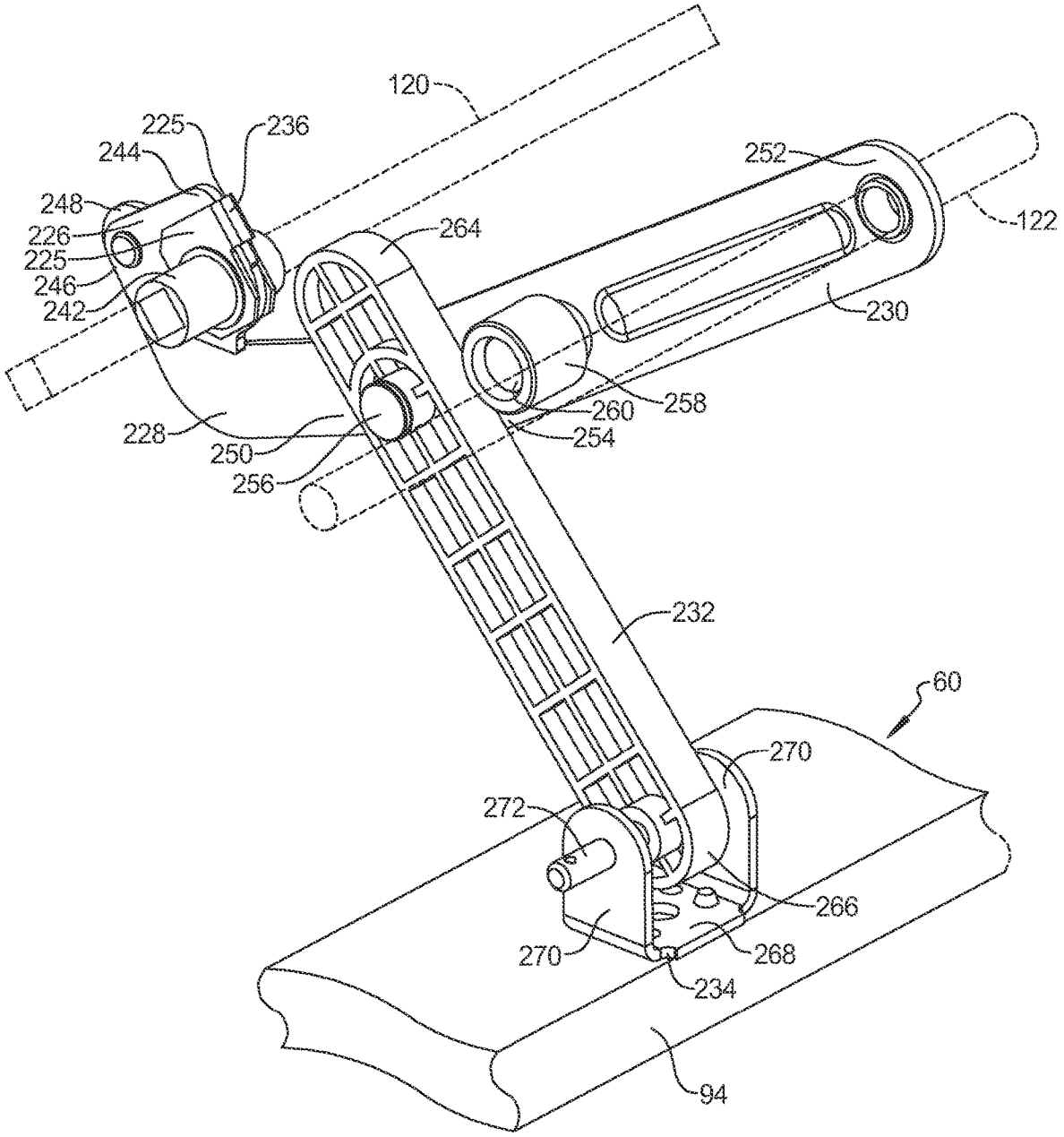
FIG. 14 is a perspective view of the tilt linkage assembly of the synchronous mechanism, with the synchronous mechanism in the position of FIG. 3.

As shown in FIGS. 9, and 12-14, each of the tilt linkage mechanisms 55 may include a clevis 225, a first link 226, a second link 228, a third link 230, a wheel support panel 232, and a mount bracket 234. The pair of tilt linkage mechanisms 55 are disposed on opposing sides of the drive actuator mechanism 54 and each of the tilt linkage mechanism 55 are in mirror-image configuration with each other. Only one tilt linkage mechanism 55 is shown in the Figures. The tilt linkage mechanism 55 is movable between a first position (FIG. 12), a second position (FIG. 13), and a third position (FIG. 14). The first position of the tilt linkage mechanism 55 corresponds to when the seat assembly 52 is in the nominal rock position or nominal tilt position (FIG. 1). The second position of the tilt linkage mechanism 55 corresponds to when the seat assembly 52 is in the rearward-rock position (FIG. 2) or rearward-tilt position (FIG. 6). The third position of the tilt linkage mechanism 55 corresponds to when the seat assembly is in the forward-rock position (FIG. 3).

As shown in FIGS. 12-14, the clevis 225 of the tilt linkage mechanism 55 may be drivingly engaged with the drive rod 120. The clevis 225 may include a backwall 236 and opposing sidewalls 238 that cooperate to substantially form a U-shape. The drive rod 120 may extend transversely through the sidewalls 238. The backwall 236 of the clevis 225 may include a recess 240. Additionally, a pair of spacers 242 may be disposed outboard of the sidewalls 238 of the clevis 225.

The first link 226 may include a first end 244 that is attached to the drive rod 120 and a second end 246 that is rotatably attached to the second link 228. The first end 244 of the first link 226 may be disposed between the sidewalls 238 of the clevis 225. Additionally, the second link 228 may include a first end 248 that is rotatably attached to the first link 226 and a second end 250 that is rotatably attached to the third link 230. In the example shown in the figures, the second link 228 is formed substantially in an L-shape. However, the second link 228 could have any other suitable shape.

The third link 230 includes a first end 252 that is attached to the first support rod 122 and a second end 254 that is rotatably attached to the second end 250 of the second link 228. The second end 250 of the second link 228 and the second end 254 of the third link 230 are rotatably attached to the wheel support panel 232 using a common mechanical fastener 256. A follower wheel 258 may extend from the third link 230. The follower wheel 258 may include a base 260 that is fixed to the third link 230 and a contact surface 262 of the follower wheel 258 that may be in rolling contact with the wheel support panel 232.

The wheel support panel 232 extends between a first end 264 that is rotatably attached to the second and third links 228, 230 and a second end 266 that is rotatably attached to the mount bracket 234 (or to the first cross member 94 of the seat base 60). The common mechanical fastener 256 extends through the wheel support panel 232 and is positioned adjacent to the first end 264 of the wheel support panel 232. The wheel support panel 232 may be made of a polymeric material (such as polyoxymethylene, for example), a composite material, a metallic material, or any other suitable material.

The mount bracket 234 is fixedly attached to the first cross member 94 of the seat base 60. The mount bracket 234 includes a back wall 268 that abuts the seat base 60 and opposing sidewalls 270 that extend from the back wall 268 to substantially form a U-shape. The second end 266 of the wheel support panel 232 is positioned between the sidewalls 270 of the mount bracket 234. A mechanical fastener 272 extends transversely through the sidewalls 270 of the mount bracket 234 and the wheel support panel 232.

Figure 15:
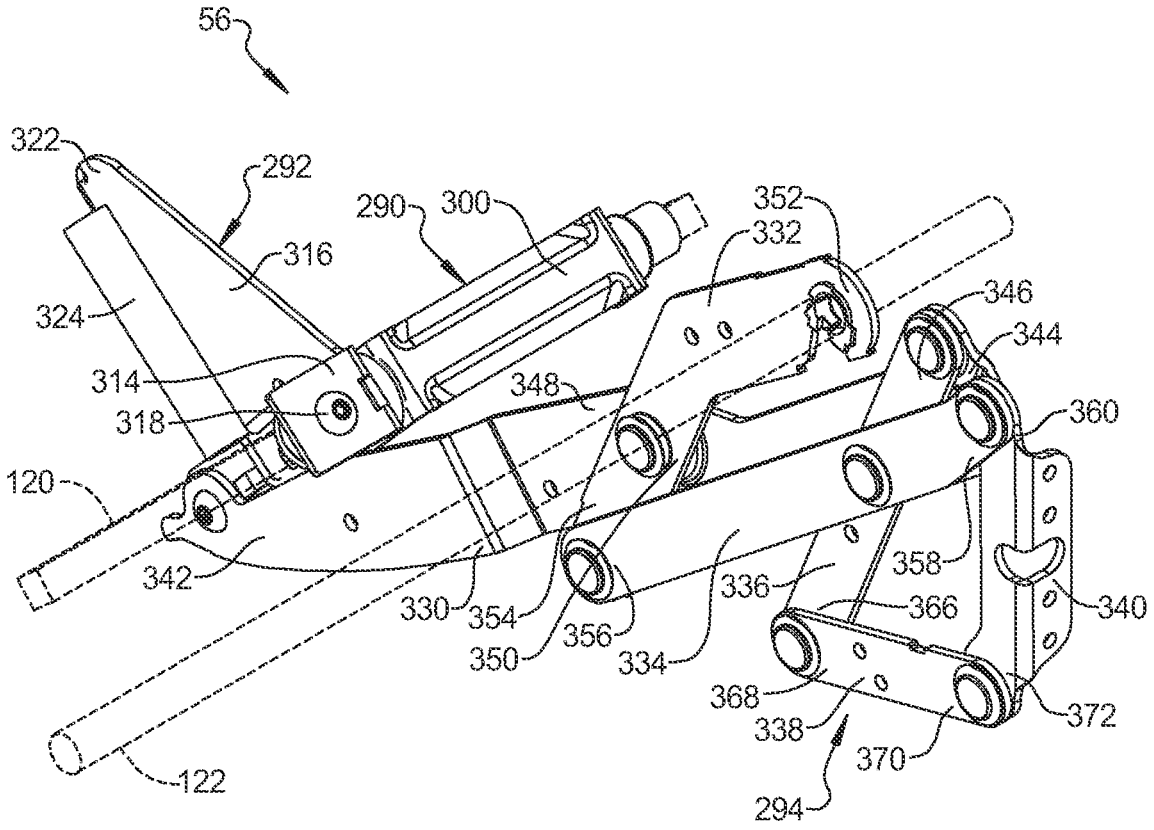
FIG. 15 is a perspective view of a legrest mechanism of the synchronous mechanism, with the synchronous mechanism in the position of FIG. 1.
Figure 16:
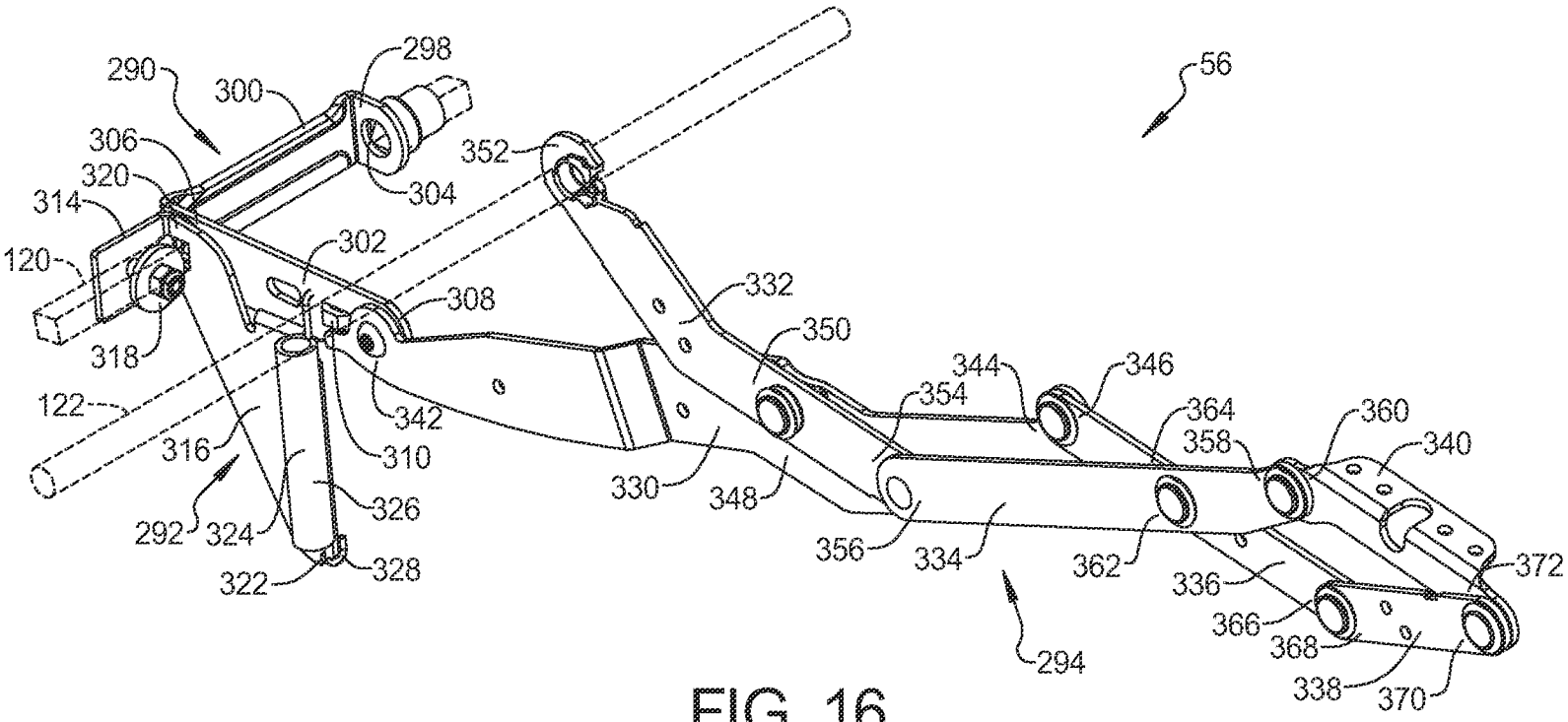
FIG. 16 is a perspective view of the legrest mechanism of the synchronous mechanism, with the synchronous mechanism in the position of FIG. 6.

As shown in FIGS. 9 and 15-16, the legrest mechanism 56 may include a pair of drive links 290, a pair of support links 292, a pair of pantograph linkages 294, and a legrest platform 296 (FIG. 8). The pair of drive links 290, the pair of support links 292, and the pair of pantograph linkages 294 are disposed at opposing ends of the legrest platform 296. Each of the drive links 290, support links 292, and pantograph linkages 294 are in mirror image configuration with each other. Only one drive link 290, one support link 292, and one pantograph linkage 294 are shown in the Figures.

The legrest mechanism 56 is movable between a first position or stowed position (FIG. 15) and a second position or deployed position (FIG. 16). The stowed position of the legrest mechanism 56 corresponds to when the seat assembly 52 is in the first synchronous position (FIG. 1). The deployed position of the legrest mechanism 56 corresponds to when the seat assembly 52 is in the fourth synchronous position (FIG. 6). As will be described in greater detail below, rotation of the drive rod 120 causes the pantograph linkages 294 to move between the retracted position (FIG. 15) and the extended position (FIG. 16). The occupant may rest his or her legs and/or feet on the legrest platform 296 (FIG. 8) while the legrest mechanism 56 is in the deployed position.

The pair of drive link 290 may be positioned at the first rod end 136 and the second rod end 138 of the drive rod 120. As shown in FIGS. 15-16, each drive link 290 may include a first wall 298, a second wall 300, and a third wall 302 that cooperate to form a U-shape. The first wall 298 may be positioned adjacent to the side support panel 72 (FIG. 7) that receives the drive rod 120. The first wall 298 may include an aperture 304 that receives the drive rod 120. The second wall 300 may extend inboard from the first wall 298 and may be positioned beside the drive rod 120 in parallel. The third wall 302 may extend from the second wall 300. In other words, the first and third walls 298, 302 extend from opposing ends of the second wall 300 and cooperate to substantially form a U-shape. The third wall 302 may include a proximal end 306 that is attached to the second wall 300 and a distal end 308 that opposes the proximal end 306. The drive rod 120 may extend through the proximal end 306 of the third wall 302 such that the drive link 290 is drivingly engaged with the drive rod 120. The pantograph linkages 294 may be rotatably attached to the distal end 308 of the third wall 302. Additionally, a protrusion 310 may be positioned adjacent to the distal end 308 and extend toward the pantograph linkages 294. The protrusion 310 is configured to support the attachment of the pantograph linkages 294 and the drive link 290.

The pair of support links 292 may be positioned inboard of the pair of drive links 290. Each of the support links 292 may include a first wall 314 and a second wall 316 that cooperate to substantially form an L-shape. The first wall 314 may be positioned beside the drive rod 120 in parallel and spaced from the second wall 300 of the drive link 290. A mechanical fastener 318 may extend through the first wall 314 and the drive rod 120 to fixedly attach the first wall 314 to the drive rod 120. The second wall 316 may include a proximal end 320 and a distal end 322 that is opposite the proximal end 320. The drive rod 120 may extend through the proximal end 320 of the second wall 316 such that the second wall 316 is drivingly engaged with the drive rod 120.

A support tube 324 may be disposed at the distal end 322 of the second wall 316. The support tube 324 may include a body 326 and a pair of hooks 328 extending from opposing longitudinal ends of the body 326. The body 326 may be formed in a tube-like formation and may be positioned substantially perpendicular to the third wall 302 of the drive link 290. One hook 328 may be coupled to the distal end 322 of the second wall 316 of the support link 292 and a second one of the hooks 328 may be coupled to the third wall 302 of the drive link 290.

As shown in FIGS. 15-16, each of the pantograph linkages 294 may include a first support link 330, a swing link 332, a second support link 334, a cross link 336, a third support link 338, and a bracket link 340. A first end 342 of the first support link 330 may be rotatably coupled to the distal end 308 of the drive link 290. A second end 344 of the first support link 330 is rotatably coupled to a first end 346 of the cross link 336. An intermediate portion 348 of the first support link 330 (disposed between the first and second ends of the first support link 330) is rotatably coupled to an intermediate portion 350 of the swing link 332. A first end 352 of the swing link 332 may be rotatably coupled to the first support rod 122. The first end 352 may be formed as a hook. A second end 354 of the swing link 332 may be rotatably coupled to a first end 356 of the second support link 334. A second end 358 of the second support link 334 is rotatably coupled to a first end 360 of the bracket link 340. An intermediate portion 362 of the second support link 334 is rotatably coupled to an intermediate portion 364 of the cross link 336. A second end 366 of the cross link 336 is rotatably coupled to a first end 368 of the third support link 338. A second end 370 of the third support link 338 is rotatably coupled to a second end 372 of the bracket link 340. The legrest platform 296 (FIG. 8) may be fixedly attached to the bracket link 340.

Figure 17:
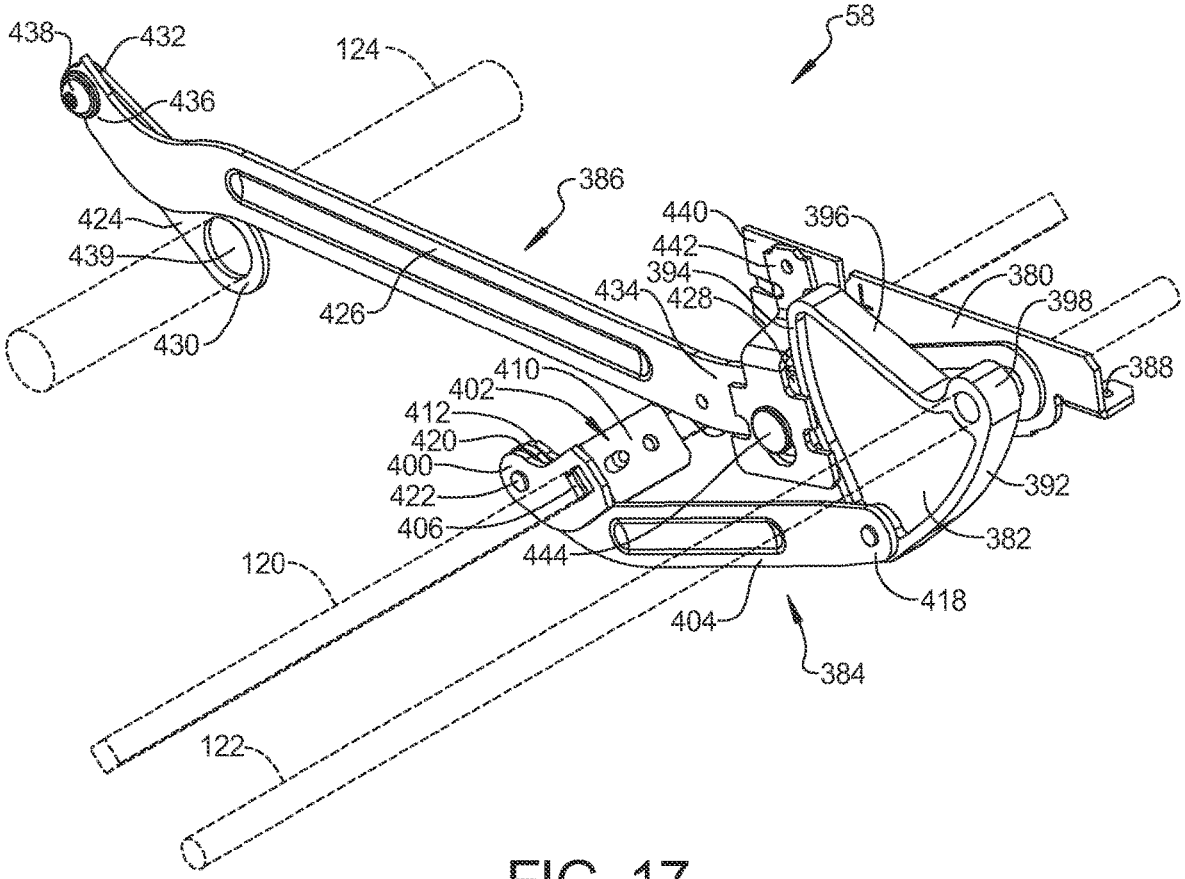
FIG. 17 is a perspective view of a sequencing mechanism of the synchronous mechanism, with the synchronous mechanism in the position of FIG. 1.
Figure 18:
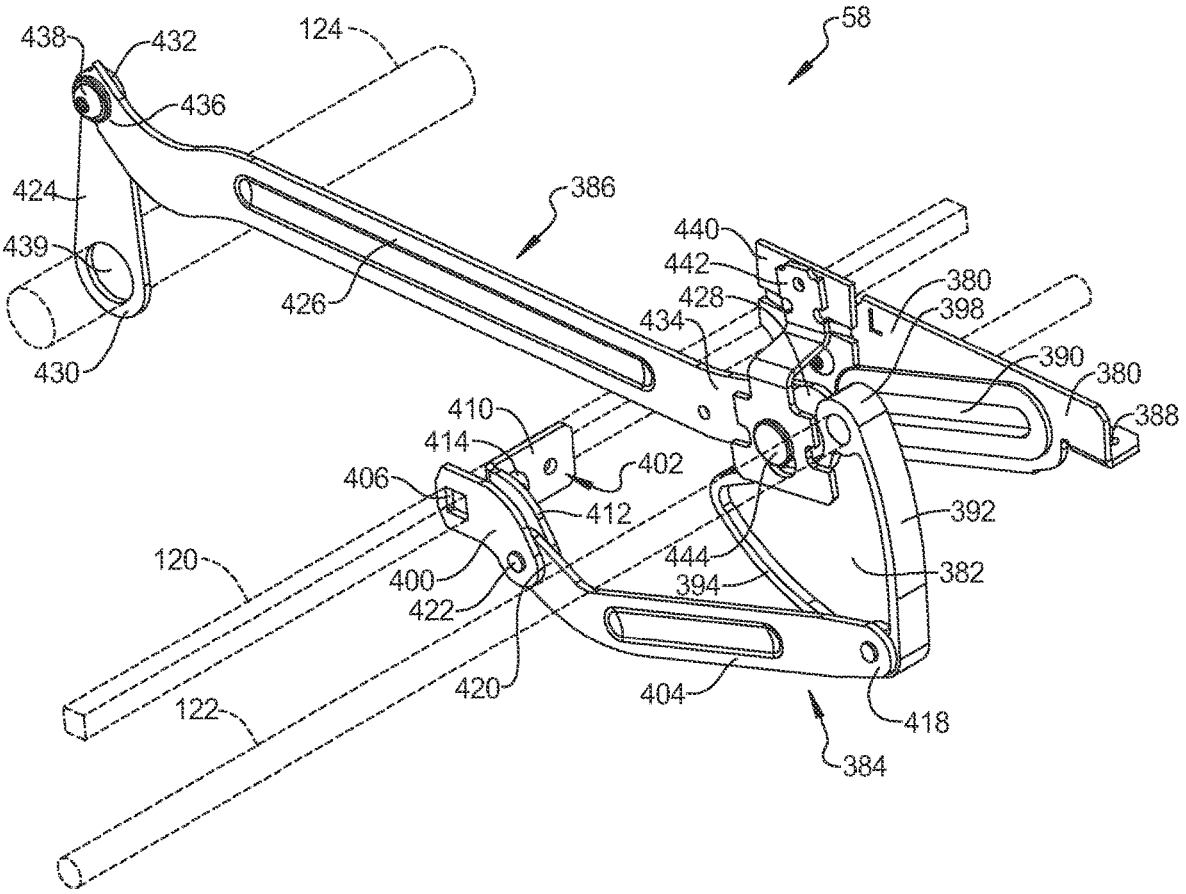
FIG. 18 is a perspective view of the sequencing mechanism of the synchronous mechanism, with the synchronous mechanism in the position of FIG. 6.
Figure 19:
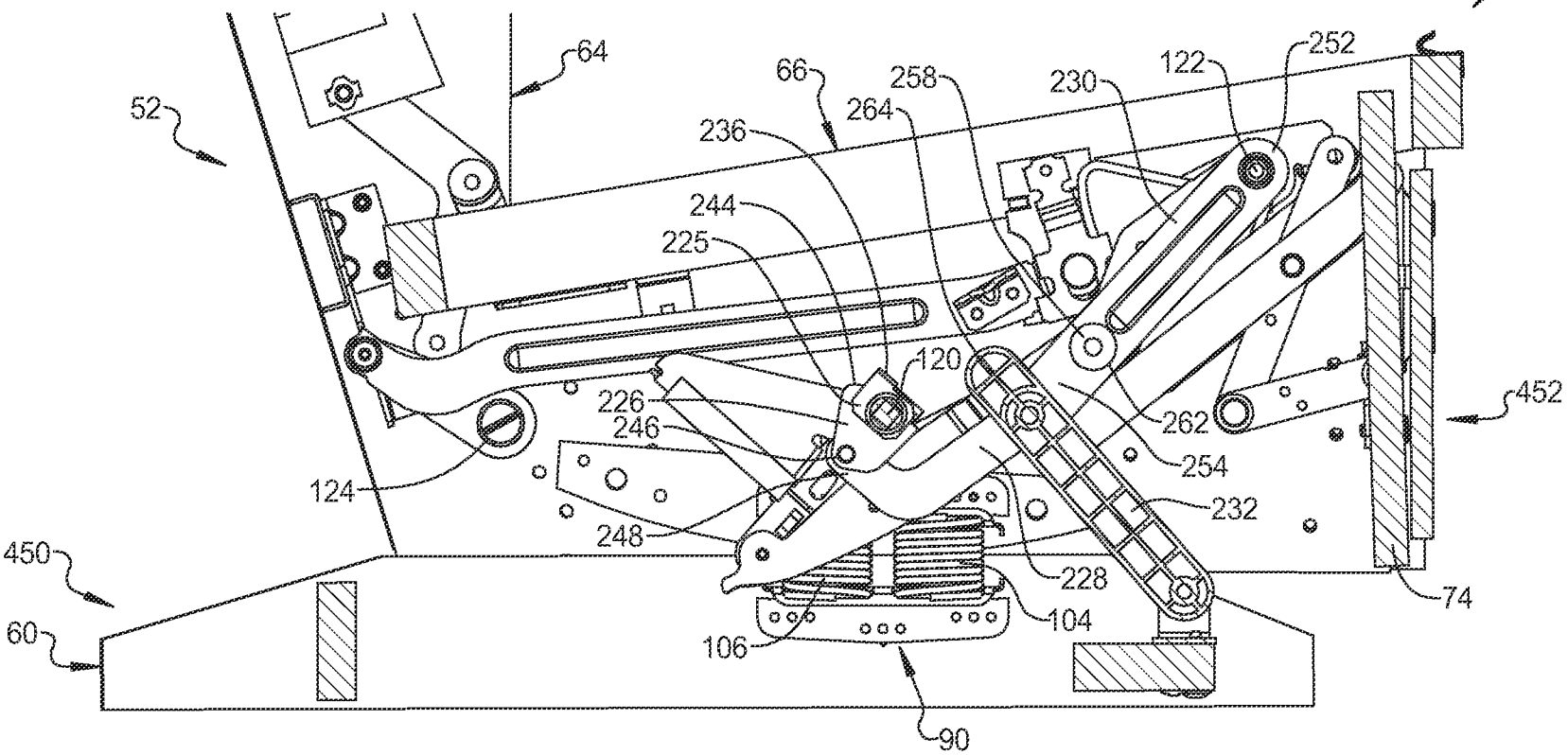
FIG. 19 is a side view of the tilt linkage assembly of the furniture member, with the tilt linkage assembly in the position of FIG. 1.
Figure 20:
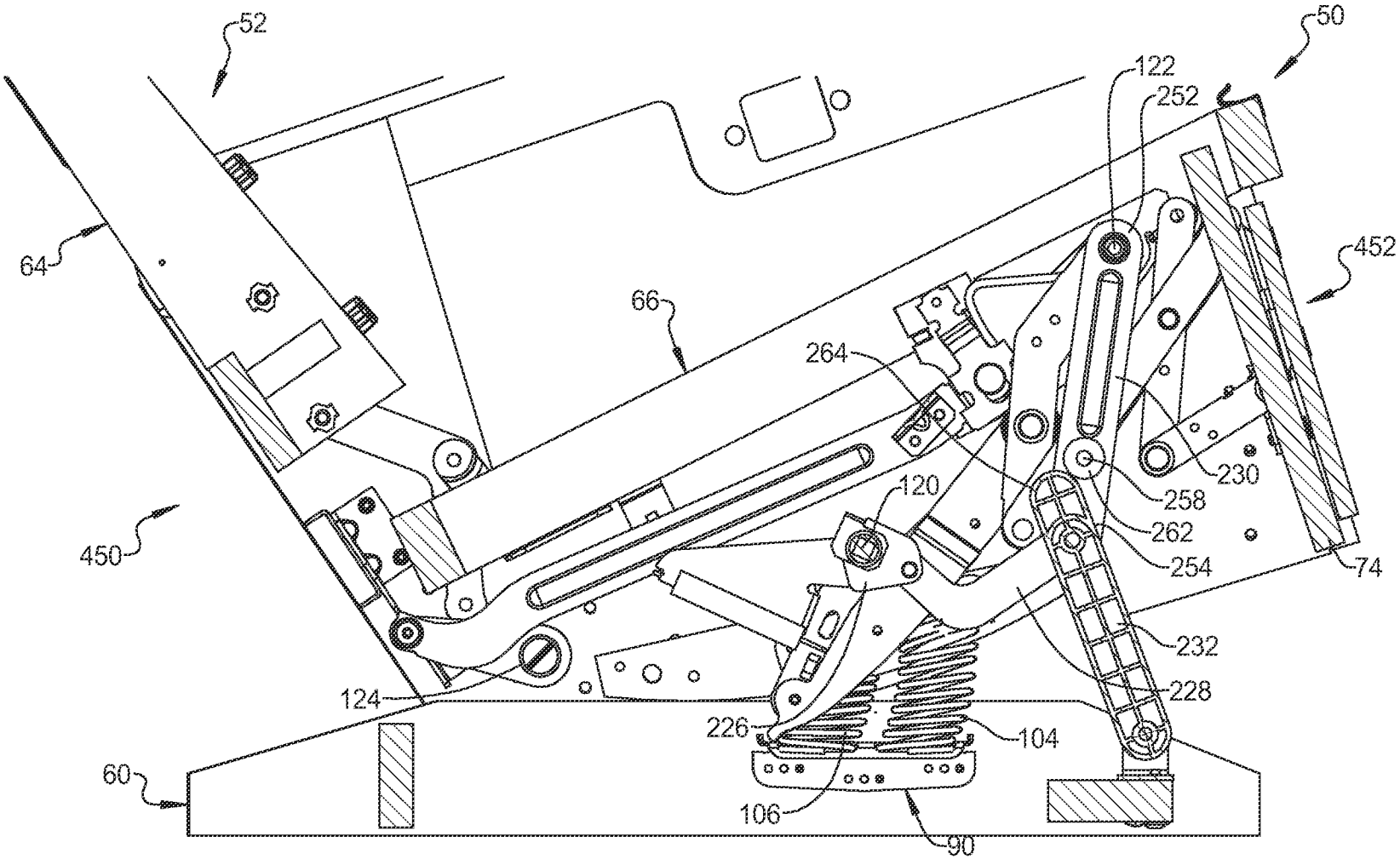
FIG. 20 is a side view of the tilt linkage assembly of the furniture member, with the tilt linkage assembly in the position of FIGS. 2 and 6.
Figure 21:
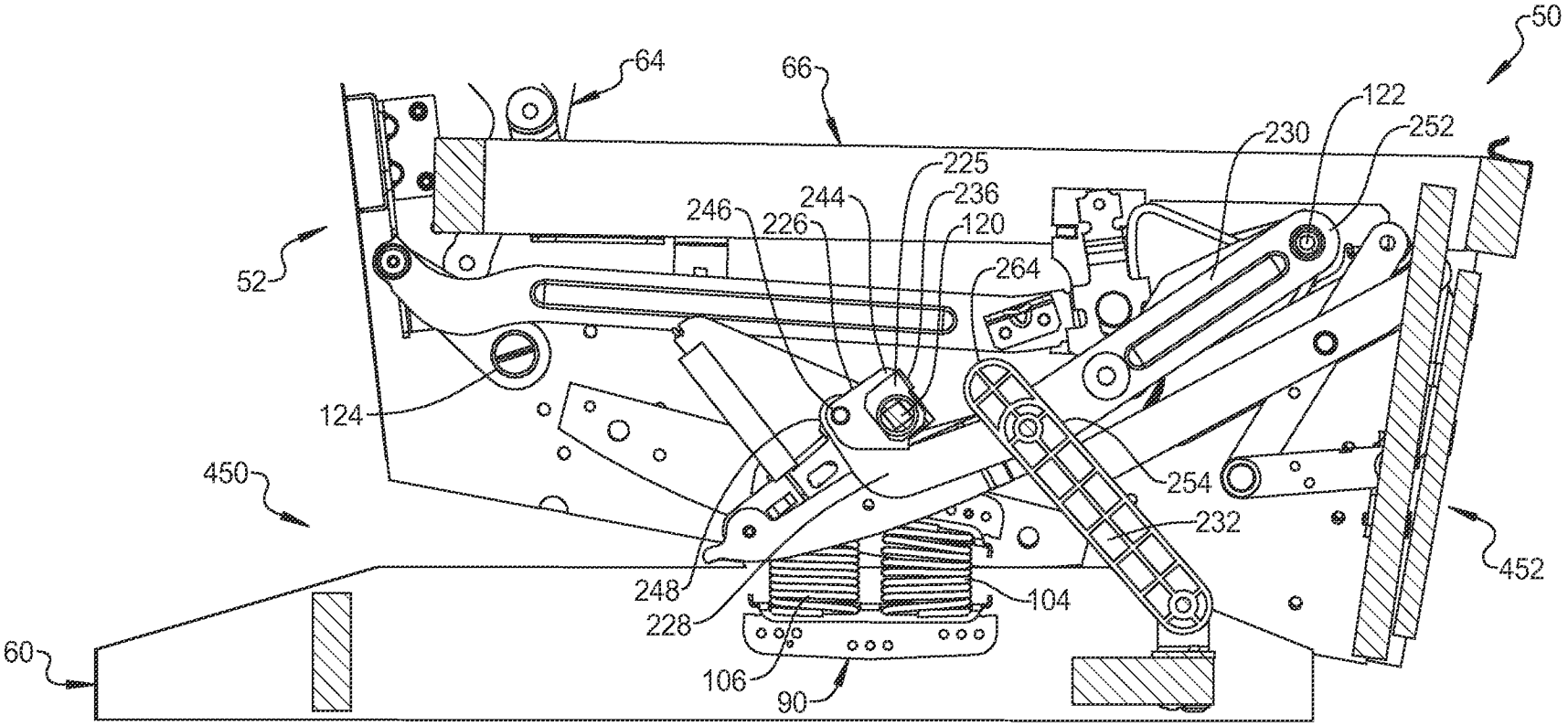
FIG. 21 is a side view of the tilt linkage assembly of the furniture member, with the tilt linkage assembly in the position of FIG. 3.
Figure 22:
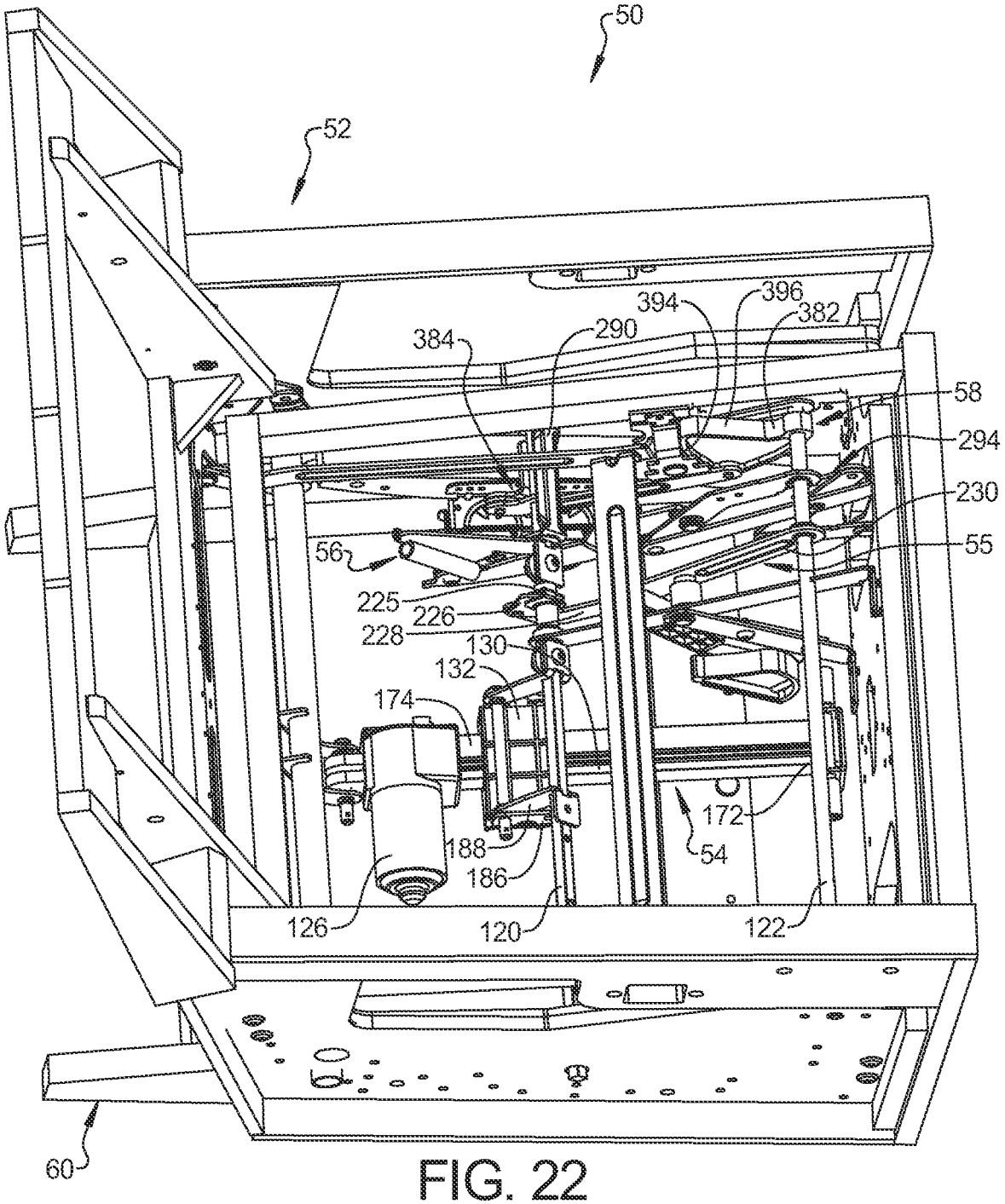
FIG. 22 is a perspective view of the synchronous mechanism, with the synchronous mechanism in the position of FIG. 1.
Figure 23:
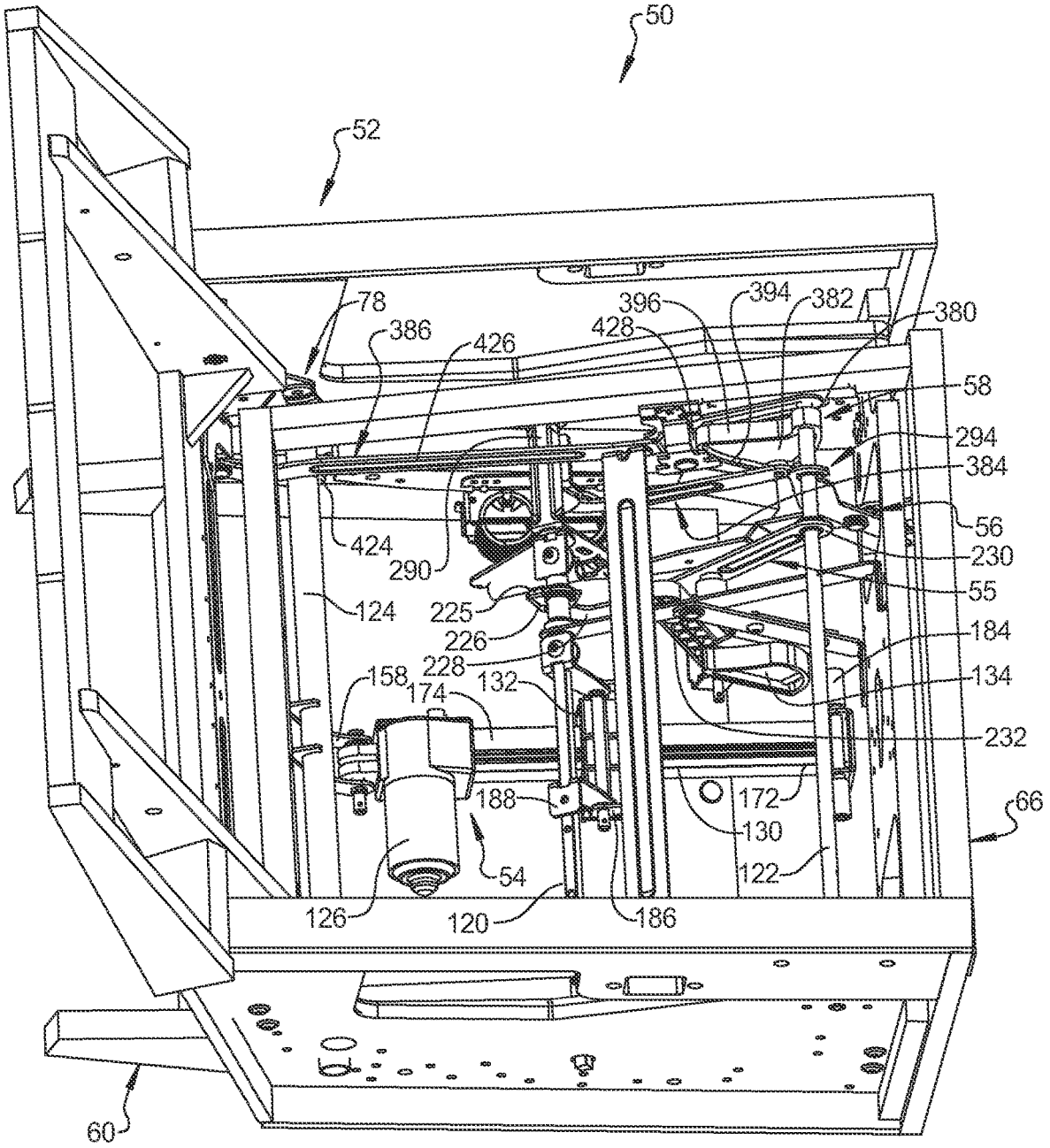
FIG. 23 is a perspective view of the synchronous mechanism, with the synchronous mechanism in the position of FIG. 4.
Figure 24:
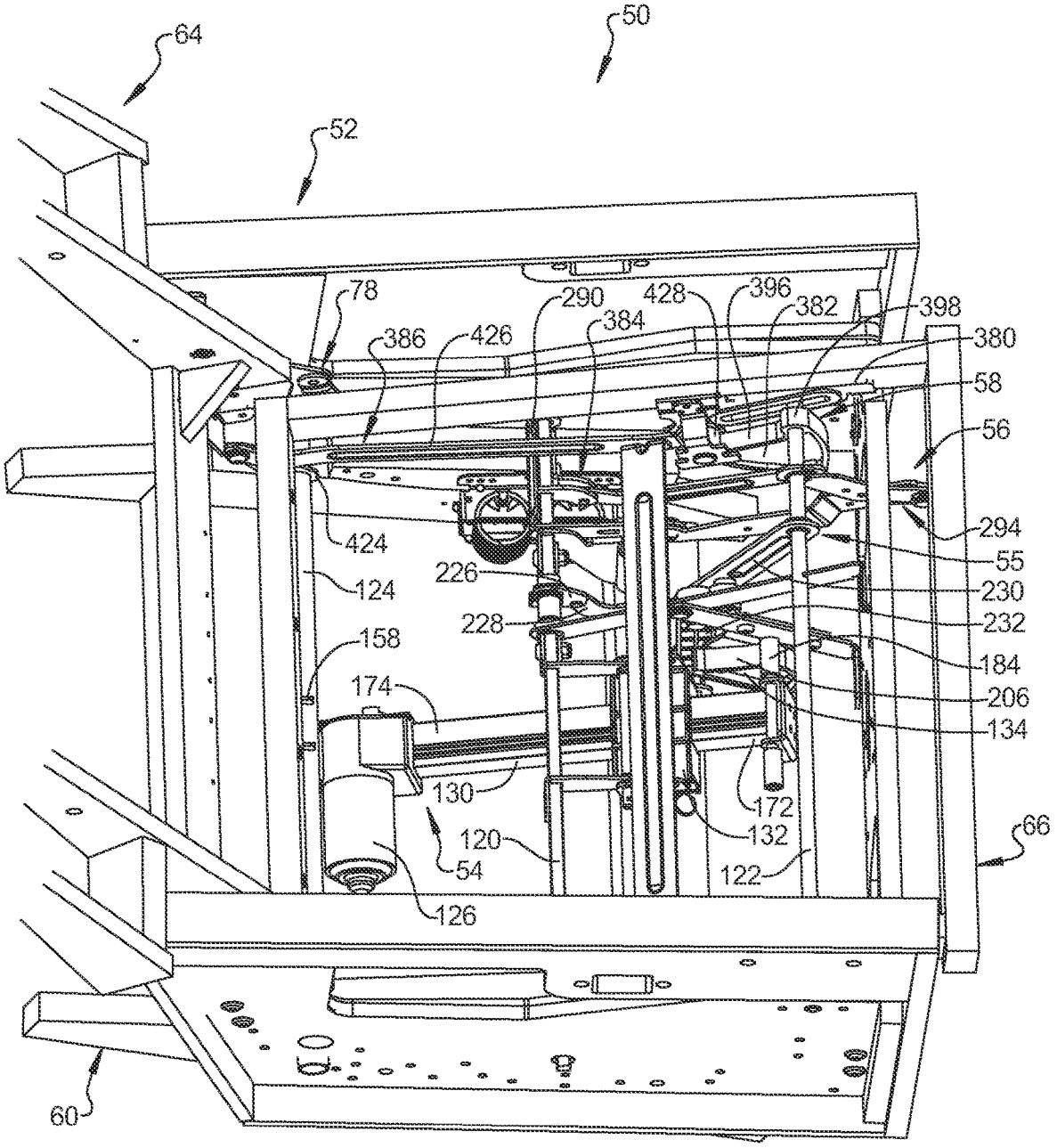
FIG. 24 is a perspective view of the synchronous mechanism, with the synchronous mechanism in the position of FIG. 5.

As shown in FIGS. 9, and 17-18, each of the sequencing mechanisms 58 may include a slotted member 380, a cam 382, a first linkage 384, and a second linkage 386. The pair of sequencing mechanism 58 may be disposed outboard of the legrest mechanism 56. The sequencing mechanisms 58 may be in mirror image configuration with each other. Only one of the sequencing mechanisms 58 is shown in the Figures. The sequencing mechanism 58 is movable between a first position (FIG. 17) and a second position (FIG. 18). The first position of the sequencing mechanism 58 corresponds to when the seat assembly 52 is in the first synchronous position (FIG. 1). The second position of the sequencing mechanism 58 corresponds to when the seat assembly 52 is in the fourth synchronous position (FIG. 6).

As shown in FIG. 7, the slotted member 380 may be positioned inboard of the first support beam 84 of the seat bottom assembly 66. The slotted member 380 may be fixedly attached to the first support beam 84 at the front end 85. More specifically, the slotted member 380 may include one or more flanges 388 (FIGS. 17-18) that extend underneath the first support beam 84 and a mechanical fastener (not shown) may extend through the one or more flanges 388 and into the first support beam 84 to fixedly attach the slotted member 380 to the seat bottom assembly 66. Additionally, the slotted member 380 may include a slot 390 (FIG. 18) that is positioned at an angle relative to the seat bottom assembly 66.

As shown in FIGS. 17-18, the cam 382 may be rotatably coupled to the slotted member 380. The cam 382 may include a first side 392, a second side 394, and a third side 396 that cooperate to substantially form a triangular-shape. The first side 392 and the second side 394 of the cam 382 may be curved and formed in a substantially convex configuration. The third side 396 of the cam 382 may be substantially flat. A protrusion 398 may be formed between the first and third sides 392, 396 of the cam 382. The first support rod 122 may extend through the protrusion 398 and into the slot 390 of the slotted member 380. The cam 382 may be made of a polymeric material such as polyoxymethylene, a composite or a metal material, or any other suitable material.

The first linkage 384 may include a first drive link 400, a second drive link 402, and a connecting link 404. The first drive link 400 may include an aperture 406 that is shaped to the cross-sectional shape of the drive rod 120. The drive rod 120 may extend through the aperture 406 such that the first drive link 400 is drivingly engaged with the drive rod 120.

The second drive link 402 may include a first wall 410 and a second wall 412 that cooperate to substantially form an L-shape. The first wall 410 may be positioned beside the drive rod 120 and more specifically, abut the drive rod 120. One or more mechanical fasteners 414 may extend through the first wall 410 and into the drive rod 120 to fixedly attach the second drive link 402 to the drive rod 120. The second wall 412 of the second drive link 402 may be spaced from the first drive link 400 along the drive rod 120 and may be substantially parallel to the first drive link 400.

The connecting link 404 may include a first end 418 that is rotatably attached to the cam 382 and a second end 420 that is rotatably attached to the first and second drive links 400, 402. More specifically, the first end 418 of the connecting link 404 may be rotatably attached to the cam 382 in a location between the first and second sides 392, 394 of the cam 382. The second end 420 of the connecting link 404 may be positioned between the first drive link 400 and the second wall 412 of the second drive link 402. A mechanical fastener 422 may extend through the first drive link 400, the second end 420 of the connecting link 404, and the second wall 412 of the second drive link 402 to rotatably attach the connecting link 404 to the first and second drive links 400, 402.

The second linkage 386 may include a first link 424, a second link 426, and a follower wheel 428. The first link 424 may include a first end 430 and a second end 432 that opposes the first end 430. The first end 430 may include an aperture 439 that receives the second support rod 124 such that the first link 424 may be fixedly attached to the second support rod 124. The second end 432 may be rotatably coupled to the second link 426. The second link 426 may include a first end 434 and a second end 436 that opposes the first end 434. The first end 434 is attached to the follower wheel 428. The first and second links 424, 426 may be rotatably attached using a mechanical fastener 438 that extends through the second end 432 of the first link 424 and the second end 436 of the second link 426.

A support plate 440 may be positioned adjacent to the slotted member 380. The support plate 440 may be fixedly attached to the first support beam 84 (FIG. 7) of the seat bottom assembly 66. The first end 434 of the second link 426 may be fixedly attached to the support plate 440. A mounting bracket 442 may be disposed at the first end 434 of the second link 426 and may be fixedly attached to the support plate 440. The mounting bracket 442 may extend over the follower wheel 428. A mechanical fastener 444 may extend through the follower wheel 428 and into the support plate 440 such that the follower wheel 428 is rotatably relative to the support plate 440 and the mounting bracket 442.

The follower wheel 428 may roll against the second and third sides 394, 396 of the cam 382. As shown in FIG. 17, the follower wheel 428 may contact the second side 394 of the cam 382 when the seat assembly 52 is in the first synchronous position (FIG. 1). As shown in FIG. 18, the follower wheel 428 may contact the third side 396 of the cam 382, and more specifically abut the protrusion 398, when the seat assembly 52 is in the fourth synchronous position (FIG. 2).

With reference to FIGS. 1-25, the operation of the furniture member 50 will now be discussed.

As shown in FIGS. 1-3 and 19-21, the seat assembly 52 may rock among the nominal rock position (FIGS. 1 and 19), the rearward-rock position (FIGS. 2 and 20), and the forward-rock position (FIGS. 3 and 21) when the legrest mechanism 56 is in the retracted position. The seat assembly 52 may be manually powered among the nominal rock, rearward-rock and forward-rock positions by an occupant sitting in the furniture member 50. To move the seat assembly 52 from the nominal rock position to the rearward-rock position, the occupant may apply a force in a rearward direction (e.g., toward a rearward end 450 of the furniture member 50) to the seatback assembly 64. As a result, the seatback assembly 64 rocks rearward and simultaneously rocks the seat bottom assembly 66 rearward relative to the seat base 60. Movement of the seat bottom assembly 66 relative to the seat base 60 simultaneously causes the first and second springs 104, 106 of the rocker spring assembly 90 to move and flex rearward.

Additionally, movement of the seat bottom assembly 66 rearward simultaneously causes movement of the first support rod 122 in a corresponding direction. Because the third link 230 is attached to the first support rod 122, movement of the first support rod 122 causes the first end 252 of the third link 230 to move in a corresponding direction and thereby, causes the second end 254 of the third link 230 to pivot in a forward direction (e.g., toward a forward end 452 of the furniture member 50). The second end 254 of the third link 230 is attached to the wheel support panel 232 and simultaneously causes the first end 264 of the wheel support panel 232 to pivot forward. Movement of the wheel support panel 232 simultaneously causes the second link 228 and the first link 226 to move in a corresponding direction.

As the wheel support panel 232 continues to move, the wheel support panel 232 contacts the contact surface 262 of the follower wheel 258. Contact of the wheel support panel 232 and the follower wheel 258 restricts the wheel support panel 232 from further pivoting forward toward the front support panel 74 and thereby, restricts the seat assembly 52 from moving further rearward. In other words, when the wheel support panel 232 contacts the contact surface 262 of the follower wheel 258, the seat assembly 52 is in a full rearward-rock position.

To move the seat assembly 52 from the nominal rock position to the forward-rock position, the occupant may apply a force in the forward direction to the seat bottom assembly 66. As a result, the seatback assembly 64 rocks forward and simultaneously rocks the seat bottom assembly 66 forward relative to the seat base 60. Movement of the seat bottom assembly 66 relative to the seat base 60 simultaneously causes the first and second springs 104, 106 of the rocker spring assembly 90 to move and flex forward.

Additionally, movement of the seat bottom assembly 66 forward simultaneously causes the first support rod 122 to move in a corresponding direction. Because the third link 230 is attached to the first support rod 122, movement of the first support rod 122 causes the first end 252 of the third link 230 to move in a corresponding direction and thereby, causes the second end 254 of the third link 230 to move rearward. The second end 254 of the third link 230 is attached to the wheel support panel 232 and simultaneously causes the wheel support panel 232 to pivot rearward. Movement of the second end 254 of the third link 230 additionally causes the second link 228 to pivot rearward. Because the first end 248 of the second link 228 is attached to the second end 246 of the first link 226, movement of the second link 228 drives the first link 226 to rotate about the drive rod 120. As the first link 226 continues to rotate, the first end 244 of the first link 226 contacts the clevis 225 and more specifically, the backwall 236 of the clevis 225. Thereby, the clevis 225 restricts further rotation of the first link 226 and restricts the seat assembly 52 from moving further forward. In other words, when the first end 244 of the first link 226 contacts the backwall 236 of the clevis 225, the seat assembly 52 is in a full forward-rock position.

One of ordinary skill in the art should appreciate that the seat assembly 52 may move from the forward-rock position to the rearward-rock position, and vice versa. Additionally, the seat assembly 52 may move from any position between the nominal rock position, forward-rock position, and rearward-rock position toward either of the forward-rock position or the rearward-rock position.

Figure 25:
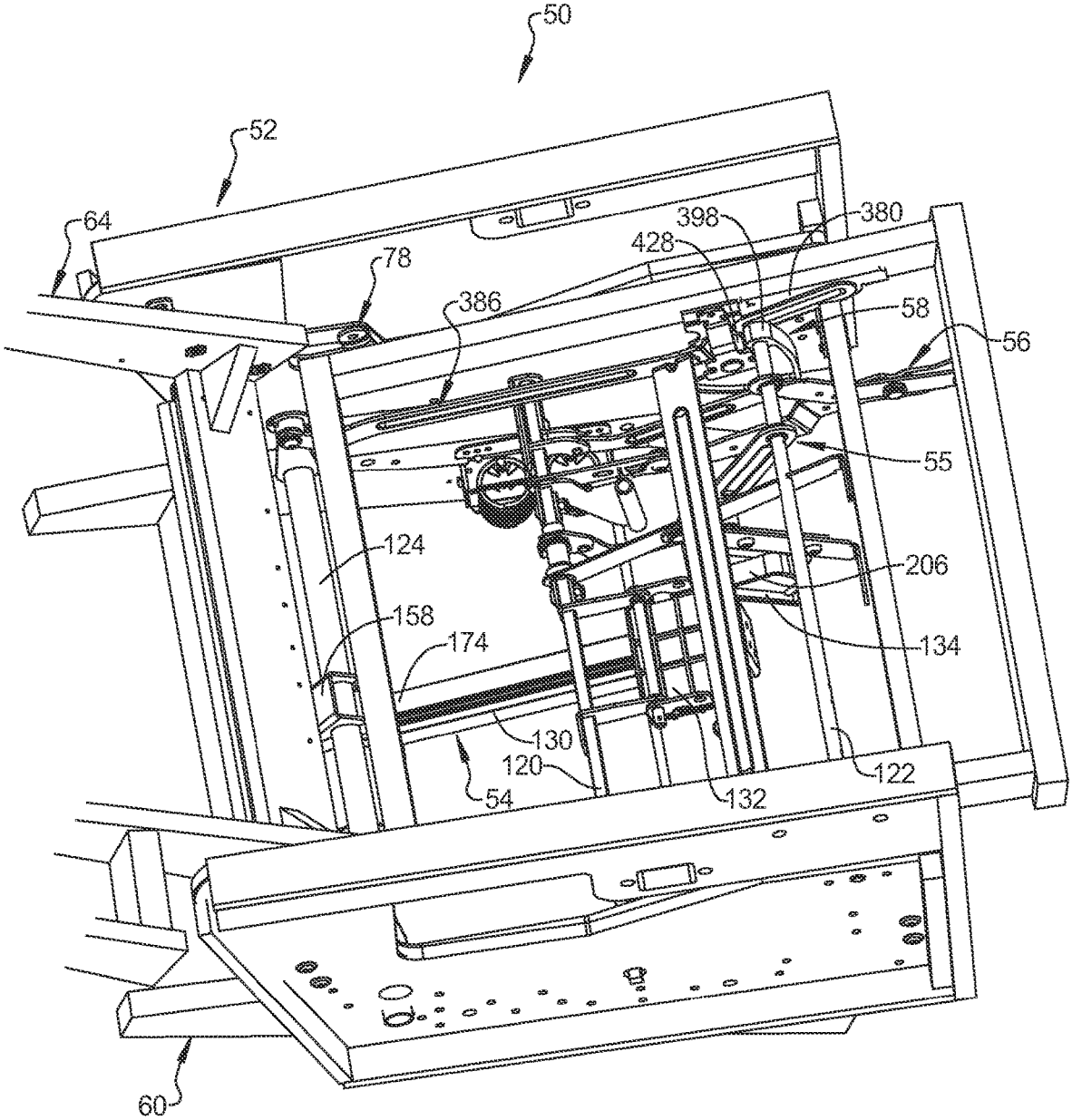
FIG. 25 is a perspective view of the synchronous mechanism, with the synchronous mechanism in the position of FIG. 6.

As shown in FIGS. 22-25, the seat assembly 52 may move among the first synchronous position (FIG. 22), the second synchronous position (FIG. 23), the third synchronous position (FIG. 24), and the fourth synchronous position (FIG. 25). To move the seat assembly 52 from the first synchronous position to the fourth synchronous position, the occupant of the furniture member 50 may operation a user control (e.g., switches, knobs, and/or buttons) to cause the motor 126 to move the drive actuator mechanism 54 from the first position (FIG. 22) to the second position (FIG. 25). More specifically, the motor 126 of the drive actuator mechanism 54 drives the sliding carriage 132 to move along the rail 130, from the second end 174 of the rail 130 to the first end 172 of the rail 130.

From the first synchronous position (FIG. 22) to the second synchronous position (FIG. 23), the sliding carriage 132 slides from the second end 174 of the rail 130 toward the first end 172 of the rail 130. As the sliding carriage 132 moves along the rail 130, the first and second pairs of links 186, 188 drive rotation of the drive rod 120. Rotation of the drive rod 120 simultaneously causes the clevis 225 of the tilt linkage mechanism 55 to rotate such that the clevis 225 abuts the first link 226 when the seat assembly 52 is in the second synchronous position. Rotation of the clevis 225 causes rotation of the first link 226 and the second link 228, thereby causing the third link 230 and the wheel support panel 232 to rotate. Because the third link 230 receives the first support rod 122, rotation of the wheel support panel 232 and the third link 230 causes the seat assembly 52 to begin to move from the nominal rock position toward the rearward-rock position.

Additionally, rotation of the drive rod 120 simultaneously causes the drive link 290 of the legrest mechanism 56 to rotate and in response, the pantograph linkages 294 begin to expand. Lastly, rotation of the drive rod 120 simultaneously causes the first linkage 384 to rotate in a corresponding direction. Rotation of the first linkage 384 causes the cam 382 to rotate such that the follower wheel 428 of the sequencing mechanism 58 rolls against the second side 394 of the cam 382.

From the second synchronous position (FIG. 23) to the third synchronous position (FIG. 24), the sliding carriage 132 continues to slide toward the first end 172 of the rail 130 and causes further rotation of the drive rod 120. Because the sliding carriage 132 is attached to the drive rod 120, the sliding carriage 132 and rail 130 rotate simultaneously with the drive rod 120.

Further rotation of the drive rod 120 simultaneously causes the clevis 225 of the tilt linkage mechanism 55 to further rotate such that the clevis 225 drives rotation of the first, second, and third links 226, 228, 230 and thereby, causes the wheel support panel 232 to rotate to the second position (FIG. 13) when the seat assembly 52 is in the third synchronous position. Rotation of the wheel support panel 232 and third link 230 causes the seat assembly 52 to further tilt rearward and places the seat assembly 52 in the rearward-rock position (FIG. 2).

Additionally, further rotation of the drive rod 120 simultaneously causes the drive link 290 to further rotate such that the legrest mechanism 56 (i.e., pantograph linkages 294) are placed in the deployed position when the seat assembly 52 is in the third synchronous position.

Additionally, further rotation of the drive rod 120 simultaneously causes the first linkage 384 of the sequencing mechanism 58 to rotate in a corresponding direction. Rotation of the first linkage 384 causes rotation of the cam 382 such that the follower wheel 428 contacts the third side 396 of the cam 382 when the seat assembly 52 is in the third synchronous position.

When the pantograph linkages 294 fully expand to the extended position (FIG. 16), the drive rod 120 is restricted from further rotation. Subsequently, the motor 126 causes the rail 130 to move rearward such that the first end 172 of the rail 130 slides towards the sliding carriage 132. In response, the follower wheel 184 of the drive actuator mechanism 54 contacts the cam 134 when the seat assembly 52 is in the third synchronous position. Movement of the rail 130 rearward causes the support link 158 to rotate and simultaneously, causes the second support rod 124 to rotate.

Rotation of the second support rod 124 causes rotation of the second linkage 386. More specifically, rotation of the second support rod 124 causes the first link 424 to simultaneously rotate because the second support rod 124 is fixedly attached to the first link 424. Movement of the first link 424 cause the second link 426 to move forward. Because the second link 426 is fixedly attached to the seat bottom assembly 66, movement of the second link 426 causes the seat assembly 52 to begin moving from the upright position toward the reclined position. Accordingly, the seat bottom assembly 66 moves forward. As the seat bottom assembly 66 moves forward, the slotted member 380 slides in a corresponding direction, relative to the first support rod 122 and the cam 382. Because the follower wheel 428 is fixedly attached to the seat bottom assembly 66, the follower wheel 428 moves forward and rolls against the third side 396 of the cam 382. Since the third side 396 of the cam 382 is substantially flat, the cam 382 allows movement of the follower wheel 428 and the seat bottom assembly 66 such that the seat assembly 52 begins to recline from the upright position toward the reclined position.

From the third synchronous position (FIG. 24) to the fourth synchronous position (FIG. 25), the motor 126 continues to cause the rail 130 to move rearward. The follower wheel 184 rollingly contacts the second side 206 of the cam 134 in order to guide movement of the rail 130. The first end 172 of the rail 130 reaches the sliding carriage 132 when the seat assembly 52 is in the fourth synchronous position. Further movement of the rail 130 causes the support link 158 to further rotate and simultaneously, causes the second support rod 124 to further rotate. Further rotation of the second support rod 124 causes further rotation of the second linkage 386. In response, the seat bottom assembly 66 and the slotted member 380 continues to move in a forward direction. Because the follower wheel 428 is fixedly attached to the seat bottom assembly 66, the follower wheel 428 continues moves forward such that the follower wheel 428 abuts the protrusion 398 when the seat assembly 52 is in the fourth synchronous position. Accordingly, the seat assembly 52 continues to recline and is placed in the reclined position.

As shown in FIGS. 22-25, the seat assembly 52 first moves the legrest mechanism 56 from the retracted position to the extended position and subsequently moves the seat assembly 52 into the recline position. More specifically, the motor 126 provides a stroke of 5.5 inches to move the legrest mechanism 56 from the retracted position to the extended position and a stroke of 3.5 inches to move the seat assembly 52 from the upright position to the recline position. In some configurations, there may be a transition period where the seat assembly 52 begins moving out of the upright position as the legrest mechanism 56 moves into the extended position. Additionally, the tilt linkage mechanism 55 moves the seat assembly 52 from nominal rock position to the rearward-rock position simultaneously with movement of the legrest mechanism 56 from the stowed position to the deployed position.

Figure 28:
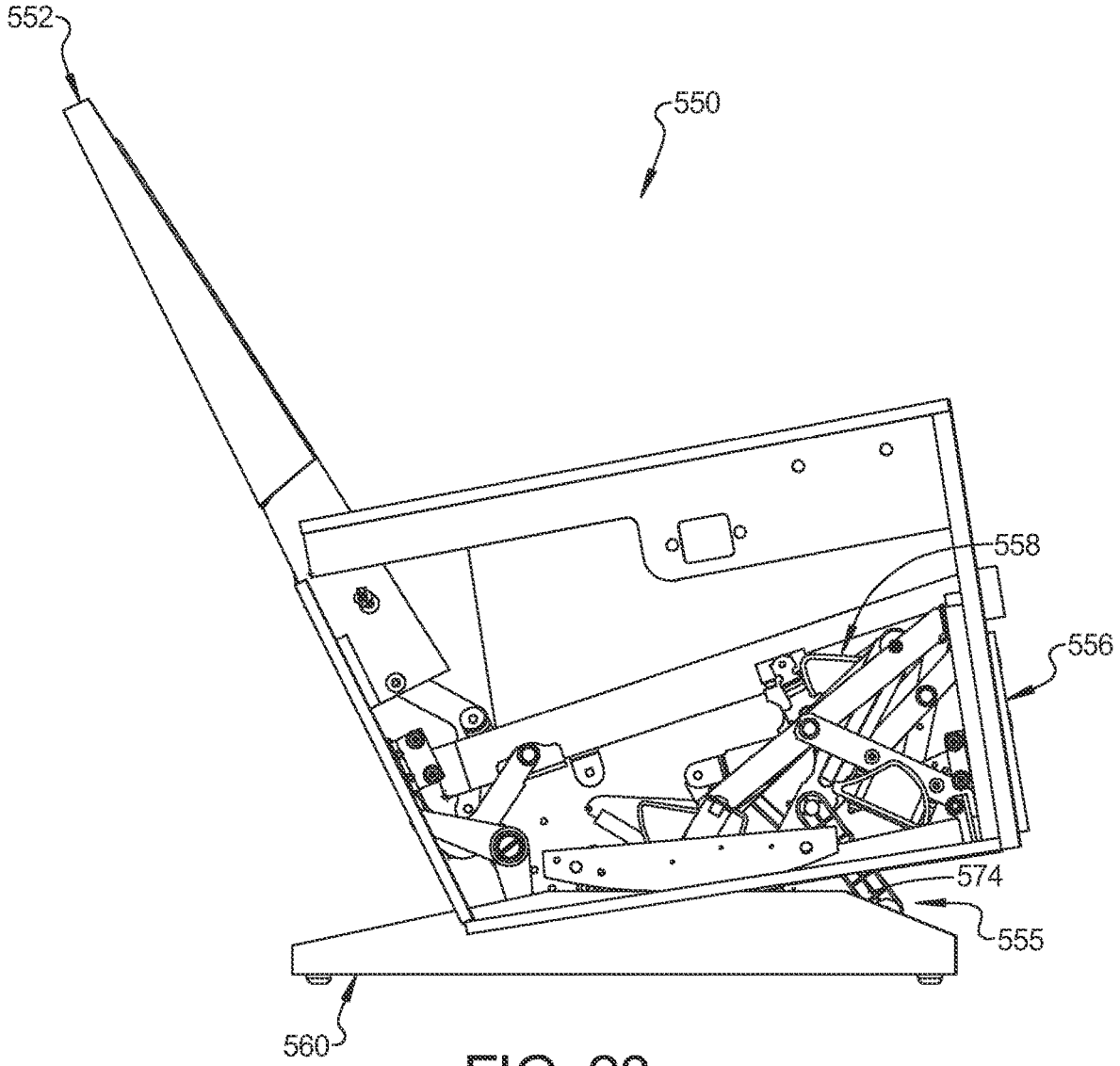
FIG. 28 is a side view of the furniture member showing the seat assembly in a rearward-rock position.
Figure 29:
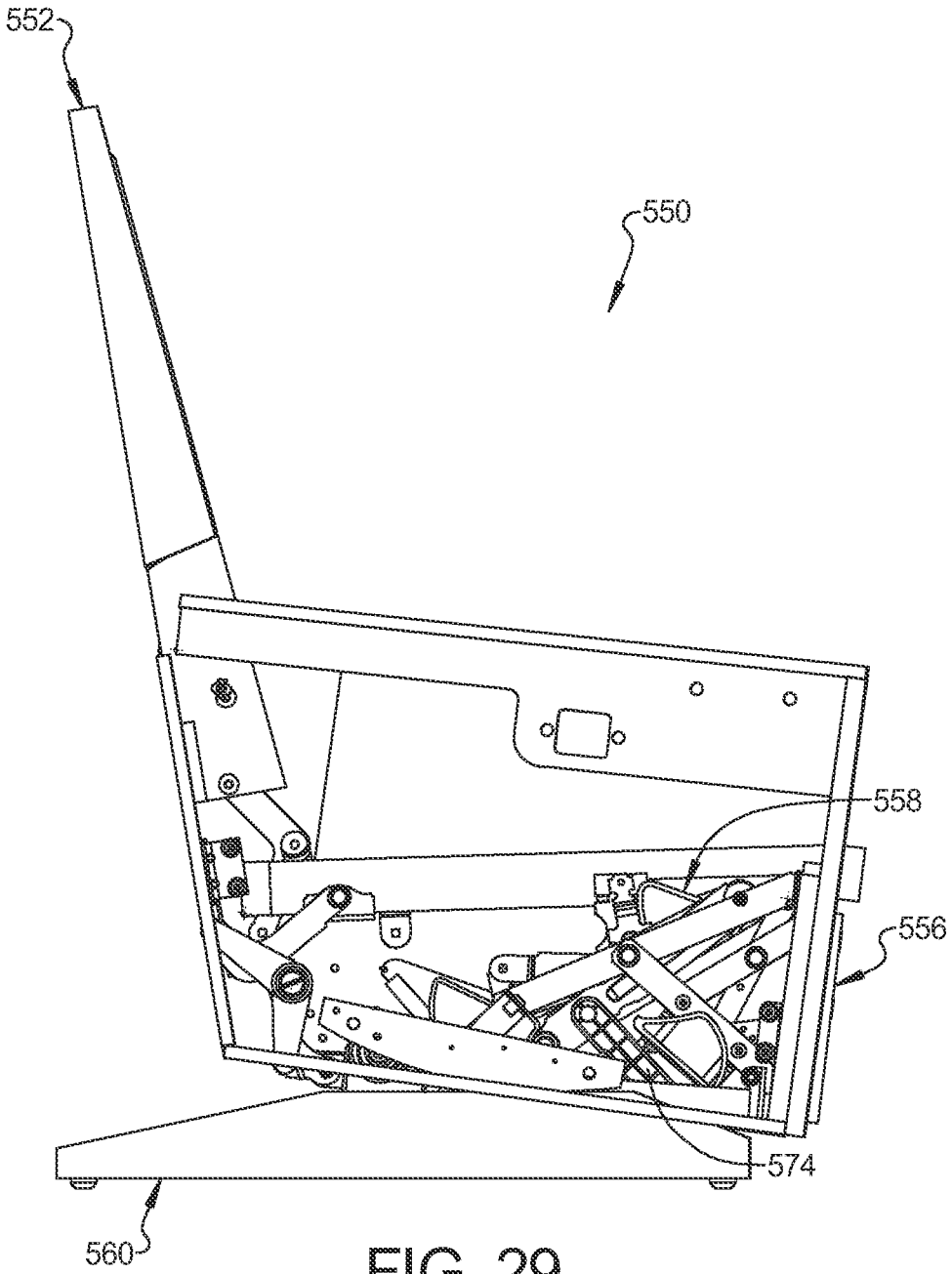
FIG. 29 is a side view of the furniture member showing the seat assembly in a forward-rock position.
Figure 30:
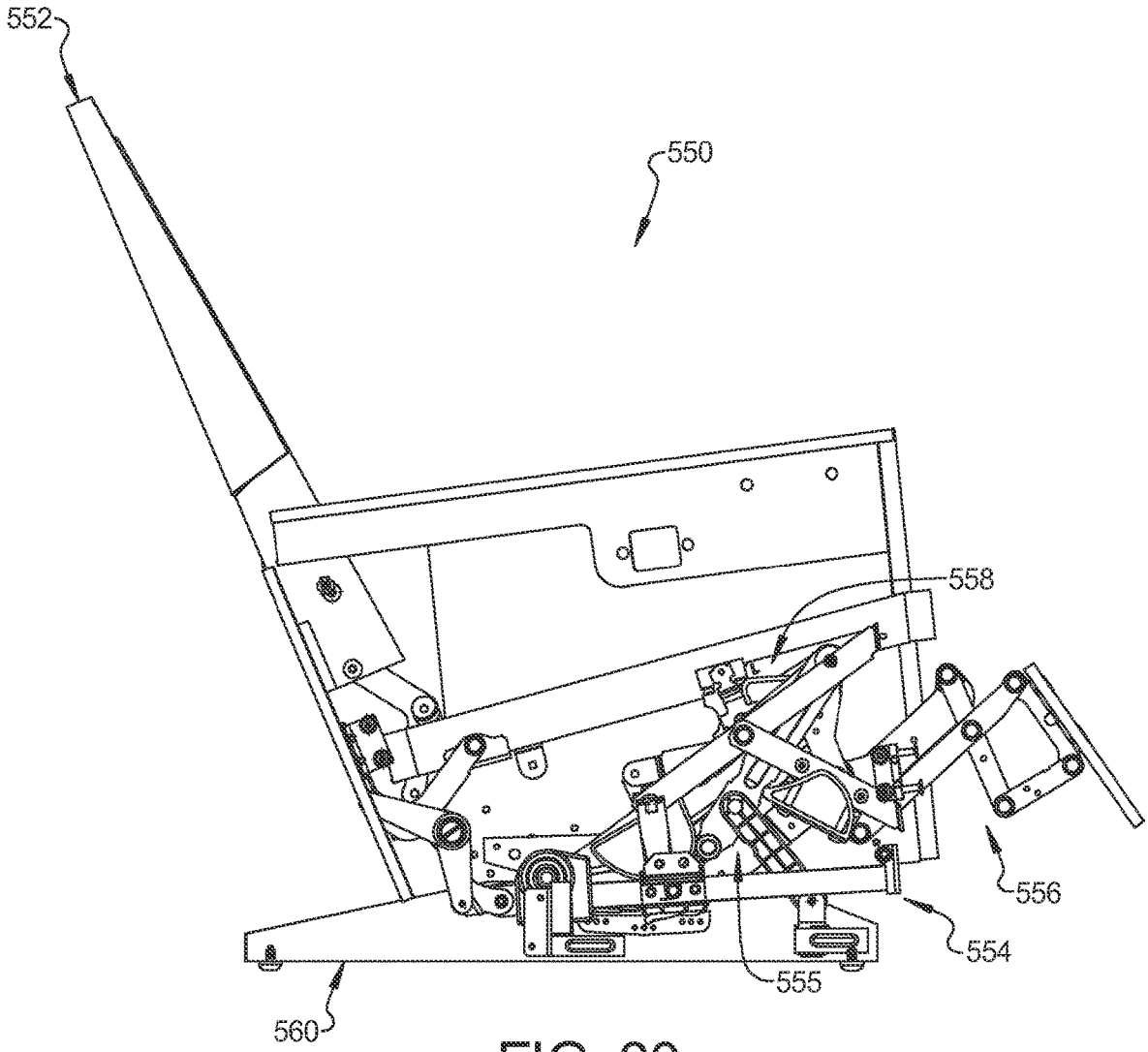
FIG. 30 is a side view of the furniture member showing a synchronous mechanism in a second synchronous position.
Figure 31:
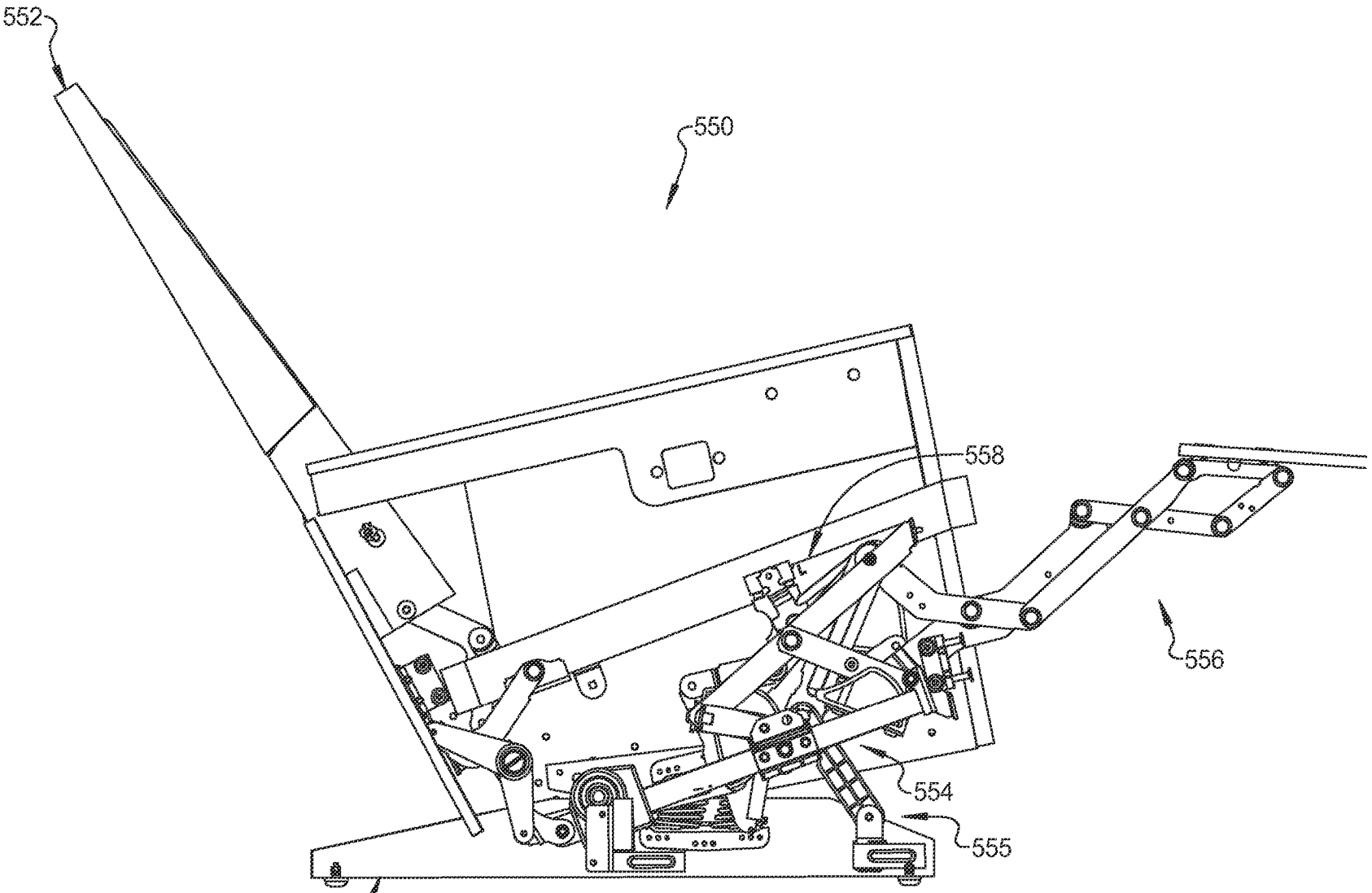
FIG. 31 is a side view of the furniture member showing a synchronous mechanism in a third synchronous position.
Figure 32:
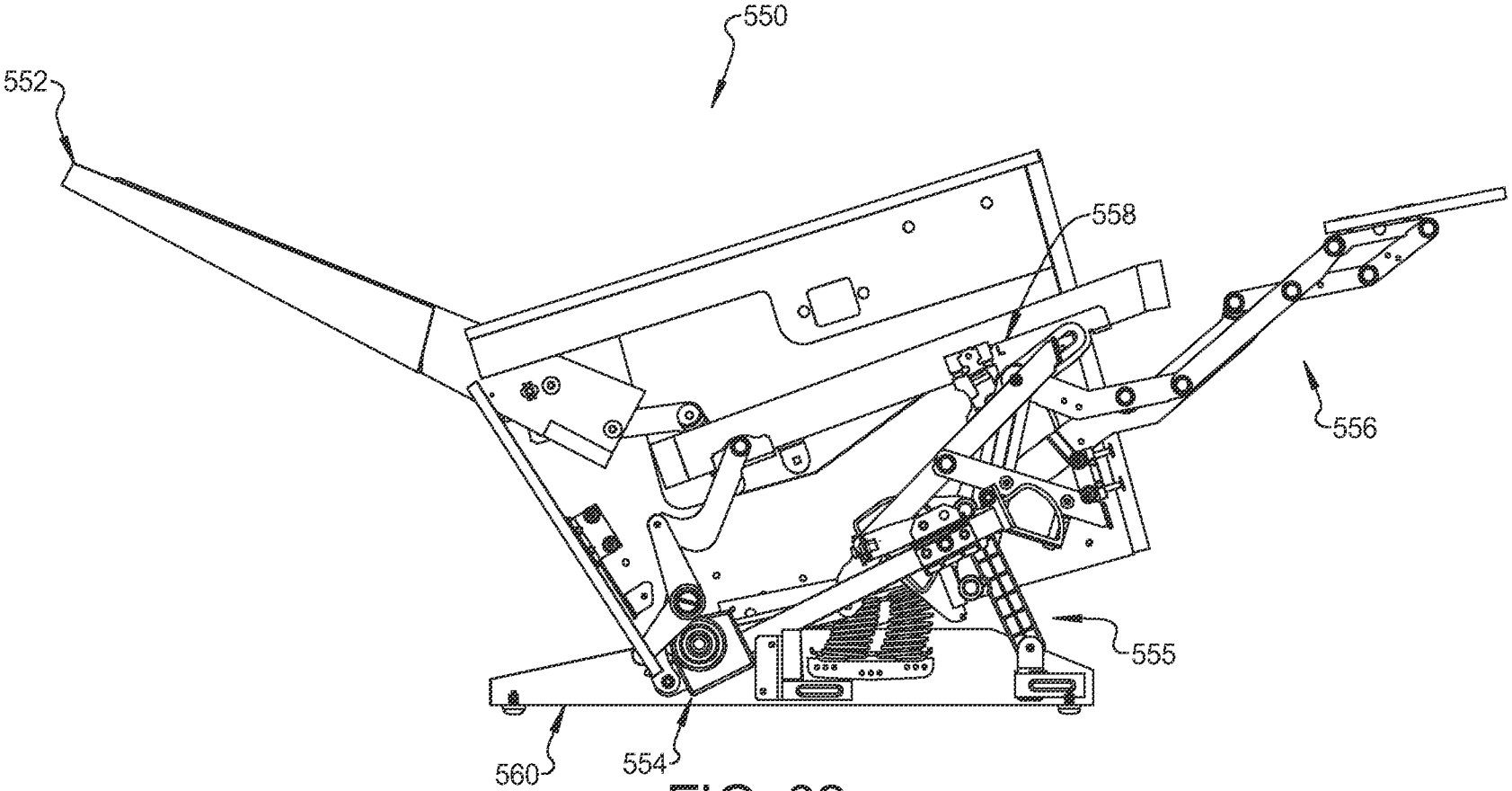
FIG. 32 is a side view of the furniture member showing a synchronous mechanism in a fourth synchronous position.

With reference to FIG. 26-45, another furniture member 550 is provided. The furniture member 550 may include a seat base 560, a seat assembly 552, a drive actuator mechanism 554, a pair of tilt linkage mechanisms 555, a legrest mechanism 556, and a pair of sequencing mechanisms 558. As will be described in further detail below, the seat assembly 552 is movable relative to the seat base 560. The seat assembly 552 may rock forward and backward among a first rock position or a nominal rock position (FIG. 26), a second rock position or a rearward-rock position (FIG. 28), and a third rock position or a forward-rock position (FIG. 29). Additionally, the seat assembly 552 may move between a first synchronous position (FIG. 1), a second synchronous position or a first intermediate position (FIG. 30), a third synchronous position or a second intermediate position (FIG. 31), and a fourth synchronous position (FIG. 32).

The seat base 560, the seat assembly 552, the drive actuator mechanism 554, and the legrest mechanism 556 may be the same or substantially similar to the seat base 60, the seat assembly 52, the drive actuator mechanism 54 and the legrest mechanism 56 of furniture member 50. For example, the seat assembly 552 may include a seatback assembly 551 and a seat bottom assembly 553. Accordingly, the seat base 560, the seat assembly 552, the drive actuator mechanism 554, and the legrest mechanism 556 and the respective operation will not be re-described in detail.

Figure 26:
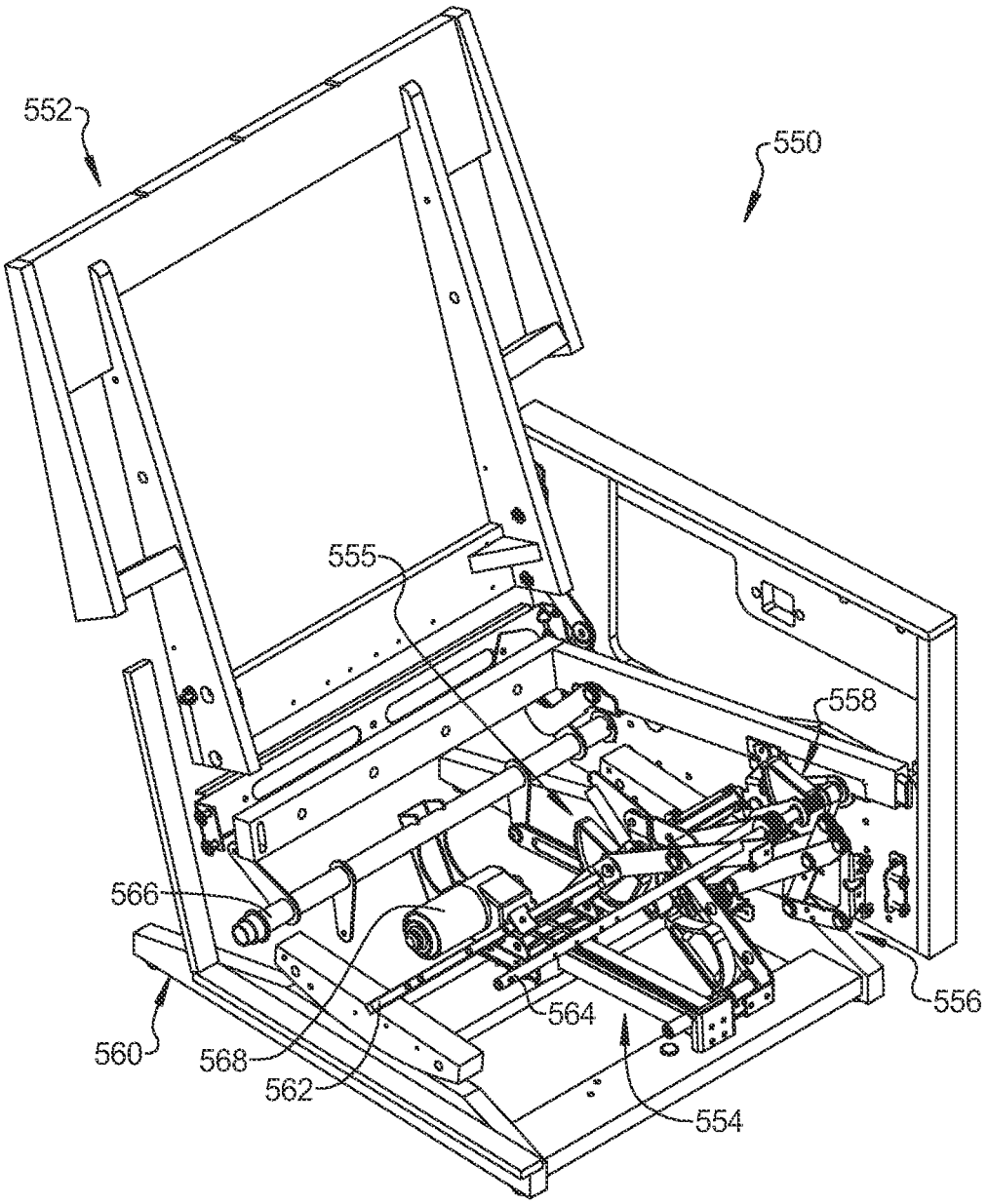
FIG. 26 is perspective view of another furniture member showing a seat assembly in a first synchronous position according to the principles of the present disclosure.
Figure 27:
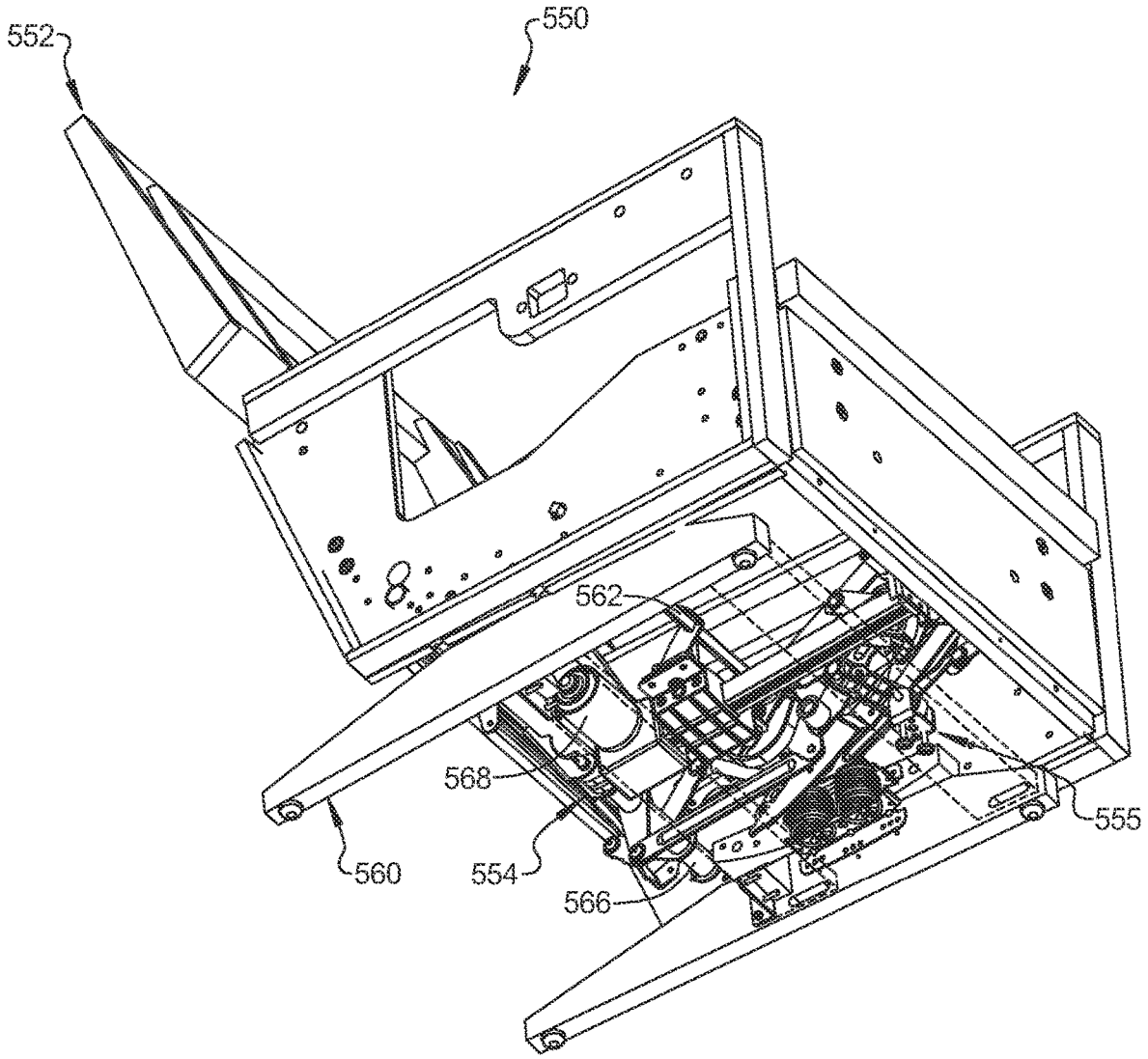
FIG. 27 is a perspective view of the furniture member showing the seat assembly in the first synchronous position.

The drive actuator mechanism 554 may include a drive rod 562, a first support rod 564, a second support rod 566, and a motor 568. The drive actuator mechanism 554 is movable between a first position (FIG. 26) and a second position (FIG. 32). The first position of the drive actuator mechanism 554 corresponds to when the seat assembly 552 is in the first synchronous position (FIG. 26). The second position of the drive actuator mechanism 554 corresponds to when the seat assembly 552 is in the fourth synchronous position (FIG. 32). Similarly, the legrest mechanism 556 is movable between a first legrest position or stowed position (FIG. 26) and a second legrest position or deployed position (FIG. 32). The stowed position of the legrest mechanism 556 corresponds to when the seat assembly 552 is in the first synchronous position (FIG. 26). The deployed position of the legrest mechanism 556 corresponds to when the seat assembly 552 is in the extended position (FIG. 32).

Figure 33:
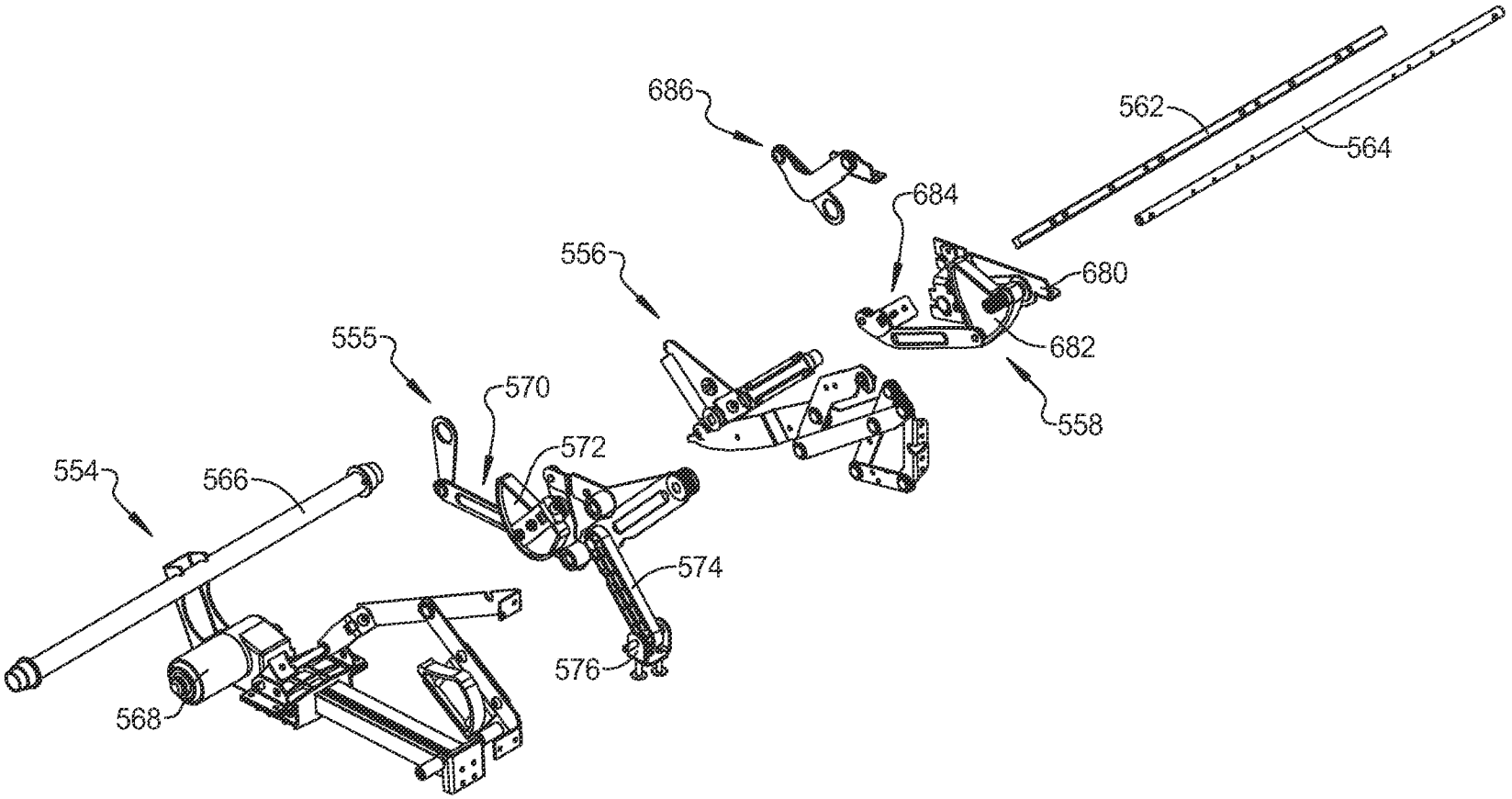
FIG. 33 is an exploded view of the synchronous mechanism of the furniture member.
Figure 34:
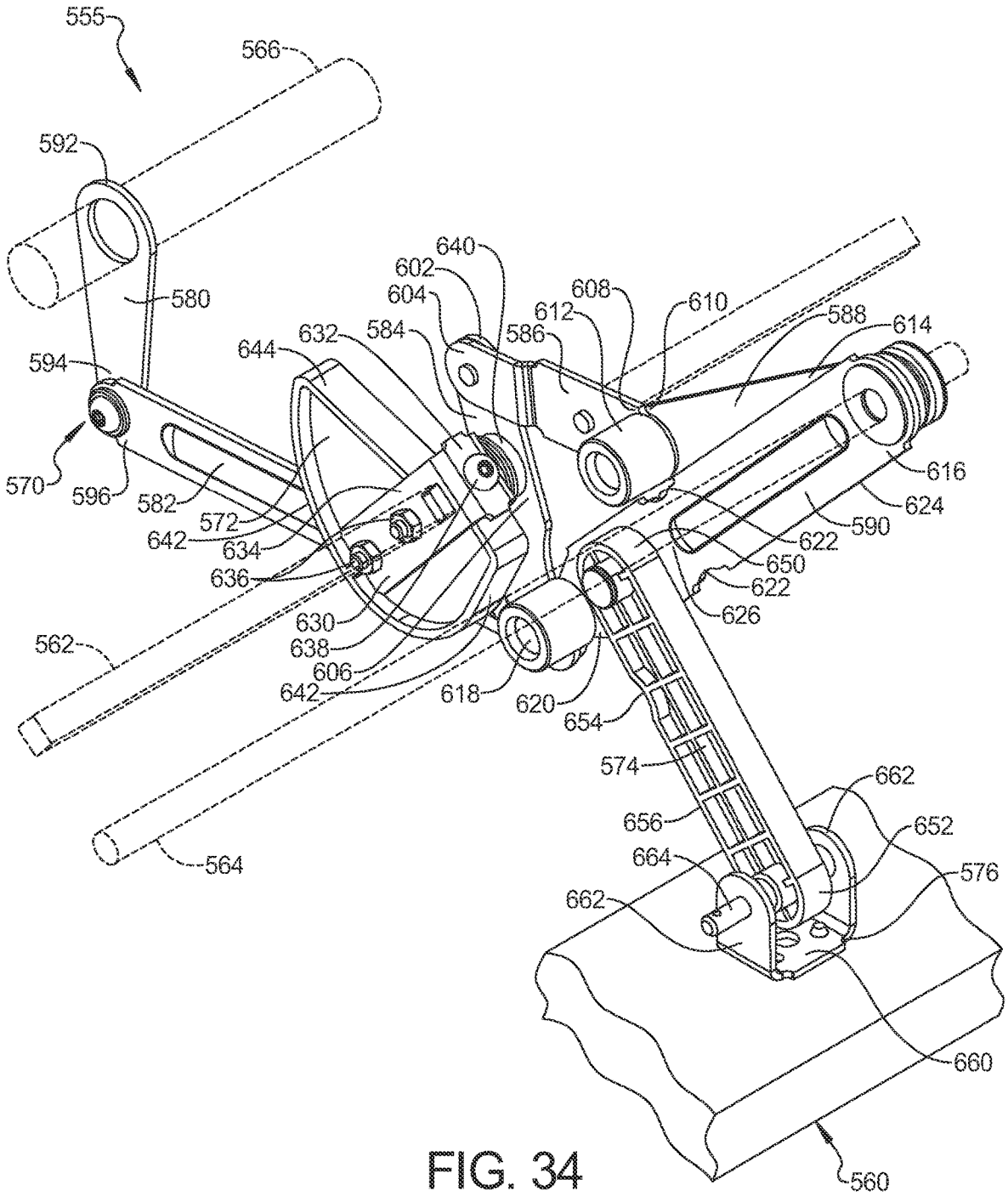
FIG. 34 is a perspective view of a tilt linkage mechanism of the synchronous mechanism, with the synchronous mechanism in a position of FIG. 26.
Figure 35:
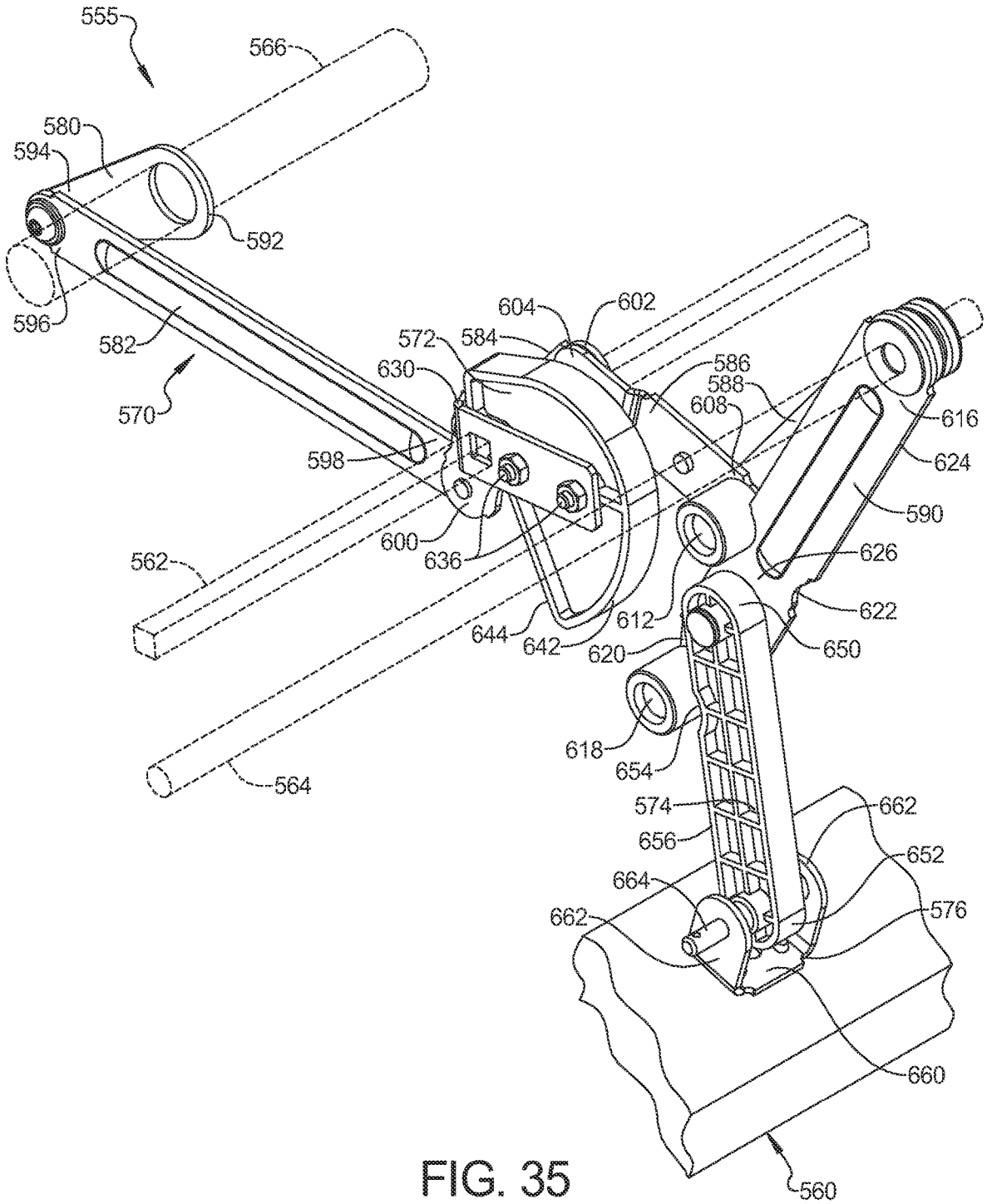
FIG. 35 is a perspective view of a tilt linkage mechanism of the synchronous mechanism, with the synchronous mechanism in a position of FIG. 28.
Figure 36:
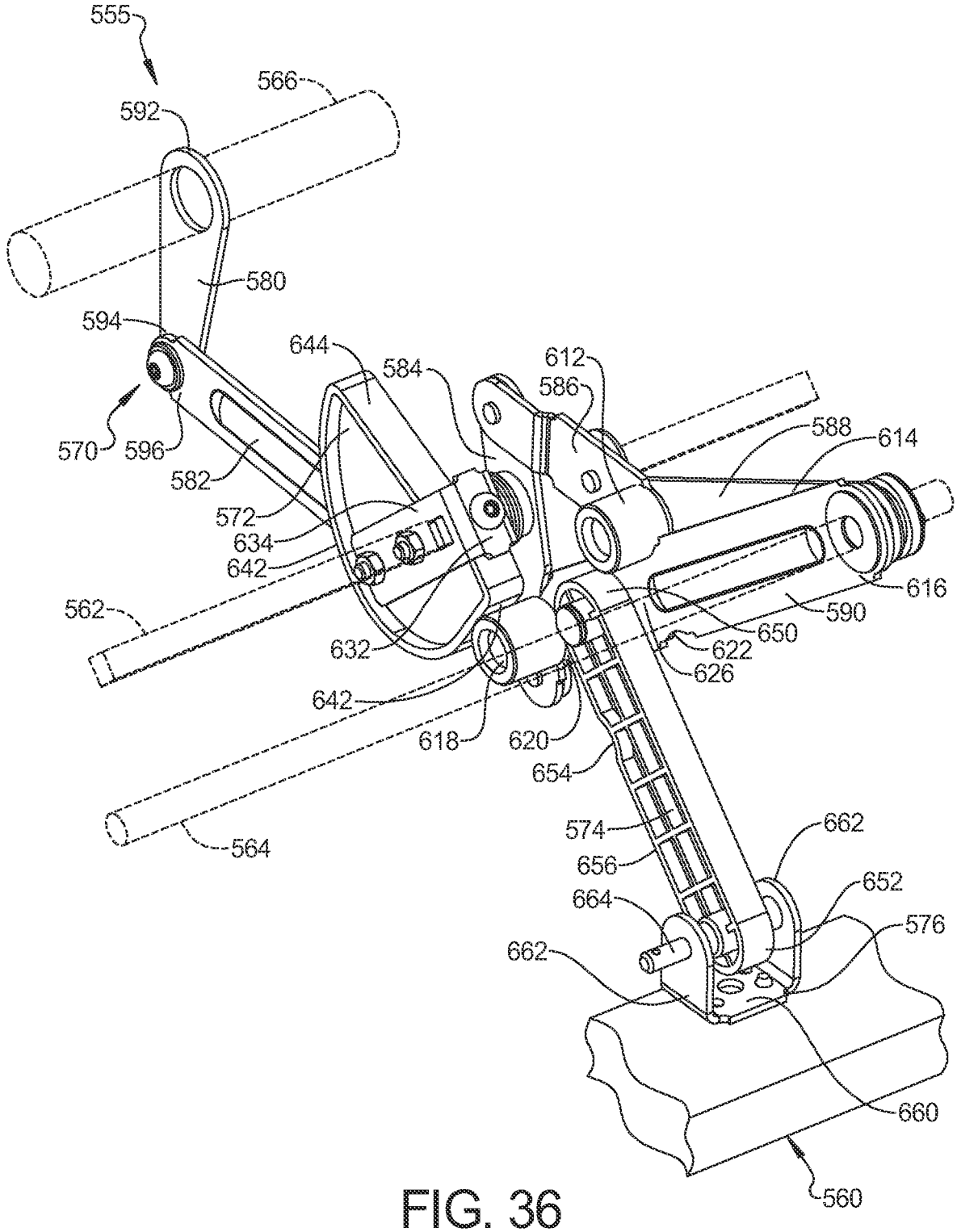
FIG. 36 is a perspective view of a tilt linkage mechanism of the synchronous mechanism, with the synchronous mechanism in a position of FIG. 29.

As shown in FIG. 33 and additional reference to FIGS. 34-36, each of the tilt linkage mechanism 555 may include a set of linkages 570, a cam 572, a wheel support panel 574, and a mount bracket 576. The pair of tilt linkage mechanisms 555 may be disposed on opposing sides of the drive actuator mechanism 554. The tilt linkage mechanism 555 may be in mirror image configuration with each other. Only one of the tilt linkage mechanisms 555 is shown in the Figures. The tilt linkage mechanism 555 is movable between a first position (FIG. 34), a second position (FIG. 35), and a third position (FIG. 36). The first position of the tilt linkage mechanism 555 corresponds to when the seat assembly 552 is in the first synchronous position (FIG. 26) and the nominal rock position (FIG. 26). The second position of the tilt linkage mechanism 555 corresponds to when the seat assembly 552 is in the fourth synchronous position (FIG. 32) and the rearward-rock position (FIG. 28). The third position of the tilt linkage mechanism 555 corresponds to when the seat assembly 552 is in the forward-rock position (FIG. 29).

The linkages 570 may include a first link 580, a second link 582, a third link 584, a fourth link 586, a fifth link 588, and a sixth link 590. A first end 592 of the first link 580 may receive the second support rod 566 and a second end 594 of the first link 580 may be rotatably attached to a first end 596 of the second link 582. A second end 598 of the second link 582 may be rotatably attached to a first end 600 of the third link 584. A second end 602 of the third link 584 may be rotatably attached to a first end 604 of the fourth link 586. The drive rod 120 may extend through an intermediate portion 606 (disposed between the first and second ends) of the third link 584. A second end 608 of the fourth link 586 may be rotatably attached to a first end 610 of the fifth link 588. A first follower wheel 612 may be disposed at the second end 608 of the fourth link 586 and the first end 610 of the fifth link 588. A second end 614 of the fifth link 588 may be rotatably attached to the first support rod 564. A first end 616 of the sixth link 590 may be rotatably attached to the first support rod 564 and positioned inboard of the second end 614 of the fifth link 588. A second follower wheel 618 may be disposed at a second end 620 of the sixth link 590. A pair of recesses 622 may be formed in opposing longitudinal sides 624 of the sixth link 590. The pair of recesses 622 may be positioned at an intermediate portion 626 (disposed between the first and second ends 616, 620) of the sixth link 590. The recesses 622 may be formed in a partial circular shape such that at least one of the recesses 622 may receive the first follower wheel 612.

The cam 572 may be fixedly attached to the drive rod 562 and spaced inboard from the linkages 570. More specifically, a connecting bracket 630 may fixedly attach the cam 572 to the drive rod 562. The connecting bracket 630 may include a backwall 632 and opposing sidewalls 634 that extend from and cooperate with the backwall 632 to substantially form a U-shape. The cam 572 may be disposed between the sidewalls 634 of the connecting bracket 630. The drive rod 562 may be disposed between the cam 572 and the backwall 632 of the connecting bracket 630. One or more mechanical fasteners 636 may extend through the sidewalls 634 of the connecting bracket 630 and the cam 572. Additionally, a mechanical fastener 638 may extend through the backwall 632 of the connecting bracket 630, the drive rod 562 and into the cam 572. A spacer 640 may be disposed between the connecting bracket 630 and the third link 584 of the linkages 570.

The cam 572 may include a first side 642 and a second side 644 that cooperate to substantially form an enclosed U-shape. The first side 642 of the cam 572 may be curved and may substantially form a U-shape. The second side 644 of the cam 572 may be substantially flat and may cooperate with the first side 642 of the cam 572. The backwall 632 of the connecting bracket 630 and the drive rod 562 may be disposed adjacent to the second side 644 of the cam 572. The cam 572 may be made of a polymeric material (such as polyoxymethylene, for example), a composite material, a metallic material, or any other suitable material.

The wheel support panel 574 may extend between a first end 650 and a second end 652 that opposes the first end 650. The first end 650 of the wheel support panel 574 may be rotatably attached to the sixth link 590 in a position between the intermediate portion 626 and the second end 620 of the sixth link 590. The second end 652 of the wheel support panel 574 may be rotatably attached to the seat base 560 using the mount bracket 576. The wheel support panel 574 may include a recess 654 that may be disposed near the first end 650 of the wheel support panel 574. The recess 654 may be formed in a lateral side 656 of the wheel support panel 574 that is adjacent to the second follower wheel 618. The recess 654 may be formed in a partially circle shape such that the recess 654 may receive the second follower wheel 618. The wheel support panel 574 may be made of a polymeric material (such as polyoxymethylene, for example), a composite material, a metallic material, or any other suitable material.

The mount bracket 576 may be fixedly attached to the seat base 560. The mount bracket 576 may include a back wall 660 that abuts the seat base 560 and opposing sidewalls 662 that cooperate with the back wall 660 to substantially form a U-shape. The second end 652 of the wheel support panel 574 is positioned between the sidewalls 662 of the mount bracket 576. A mechanical fastener 664 extends transversely through the sidewalls 662 of the mount bracket 576 and the wheel support panel 574 to rotatably attach the wheel support panel 574 to the mount bracket 576.

Figure 37:
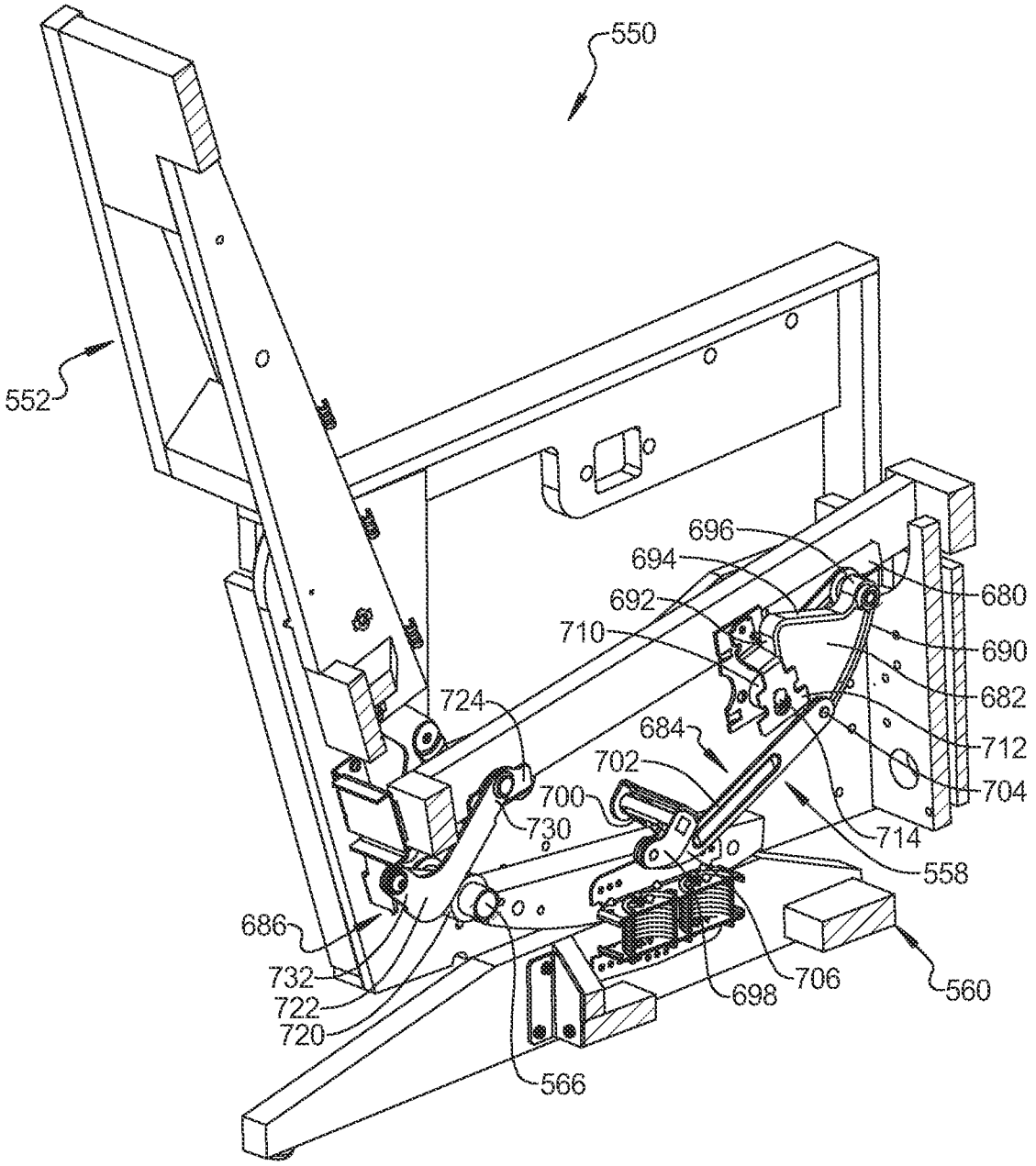
FIG. 37 is a perspective view of a sequencing assembly of the synchronous mechanism, with the synchronous mechanism in a position of FIG. 25.
Figure 38:
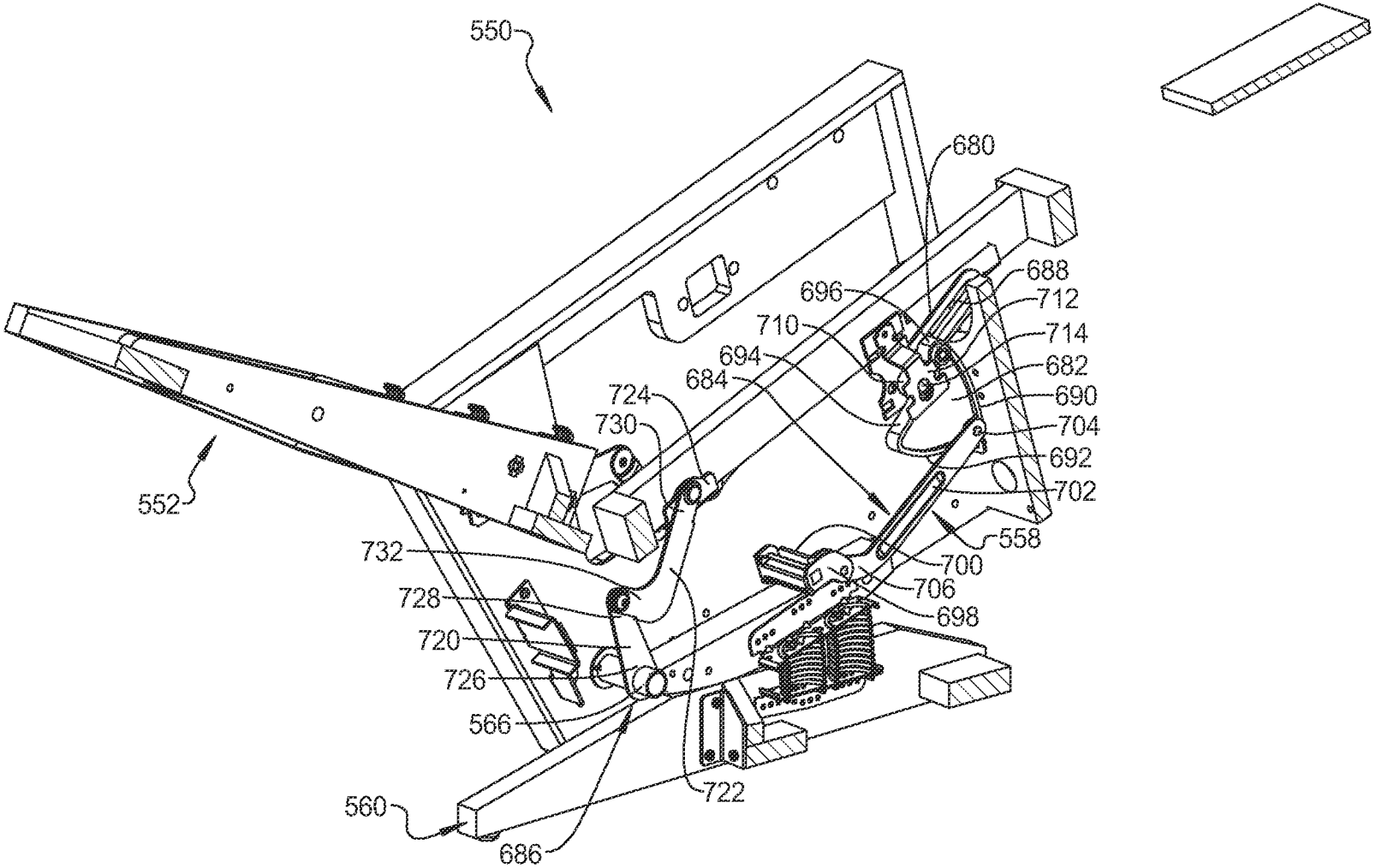
FIG. 38 is a perspective view of a sequencing assembly of the synchronous mechanism, with the synchronous mechanism in a position of FIG. 28.
Figure 39:
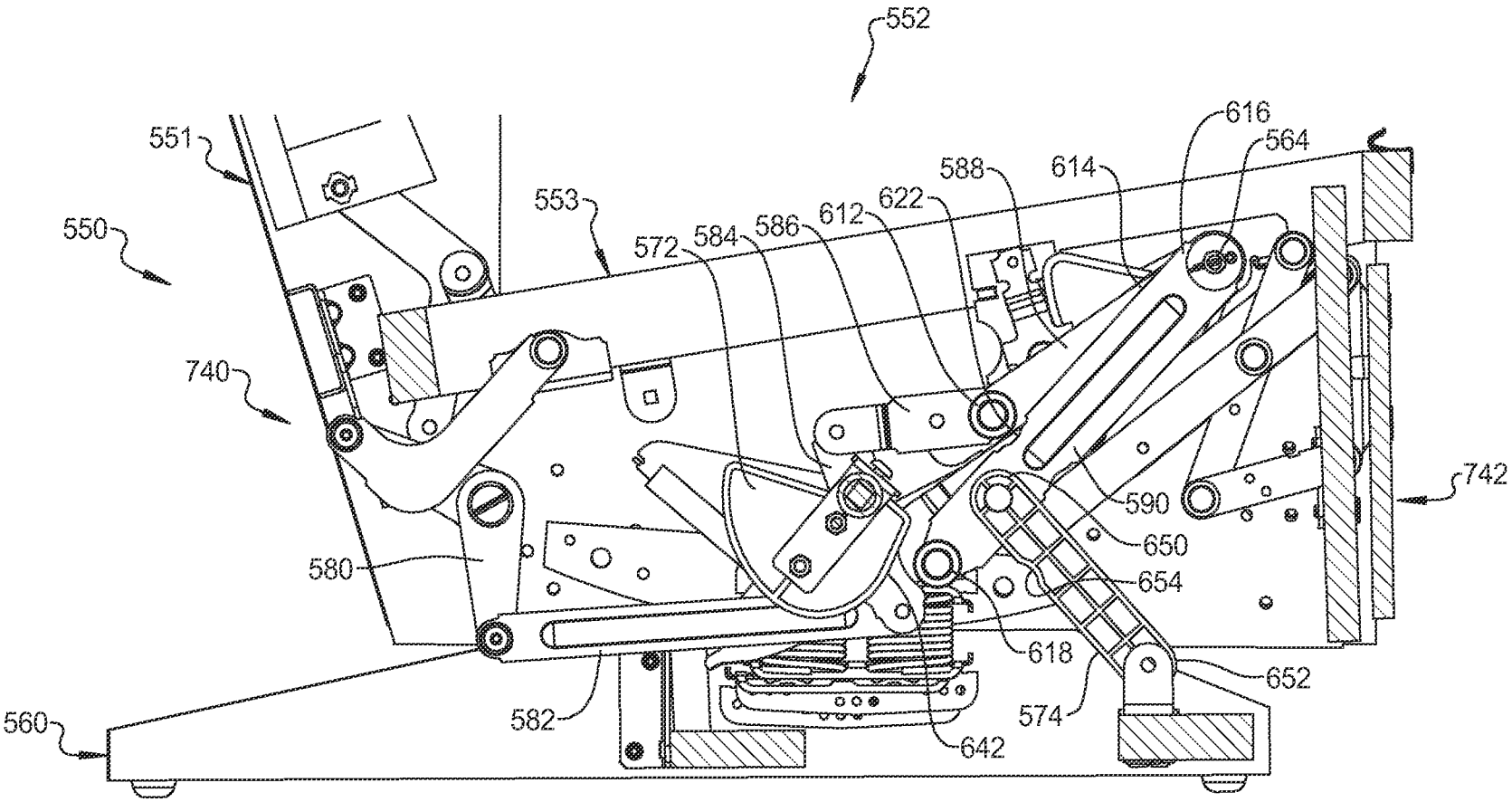
FIG. 39 is a side view of the tilt linkage assembly of the furniture member, with the tilt linkage assembly in the position of FIG. 26.
Figure 40:
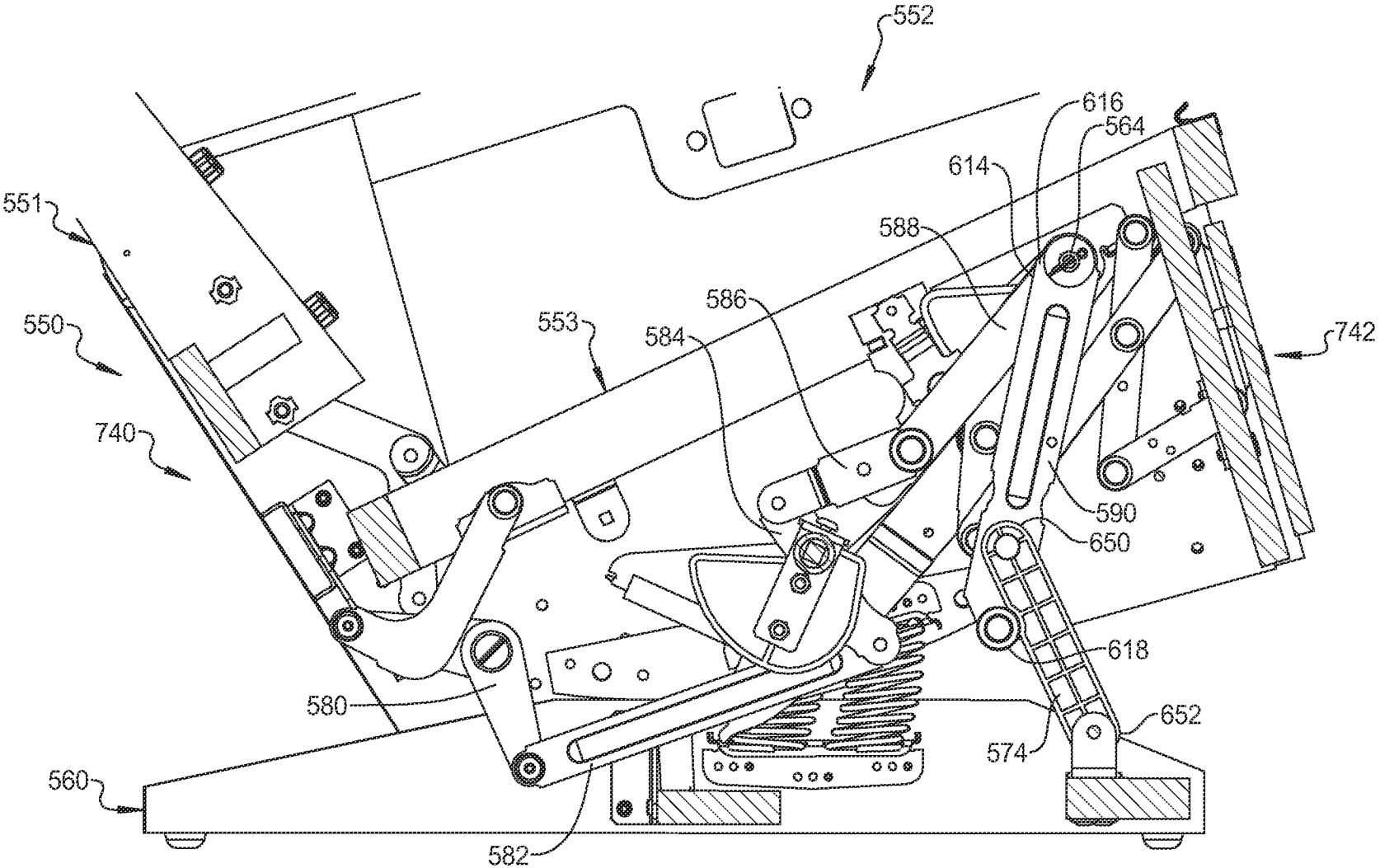
FIG. 40 is a side view of the tilt linkage assembly of the furniture member, with the tilt linkage assembly in the position of FIG. 28.
Figure 41:
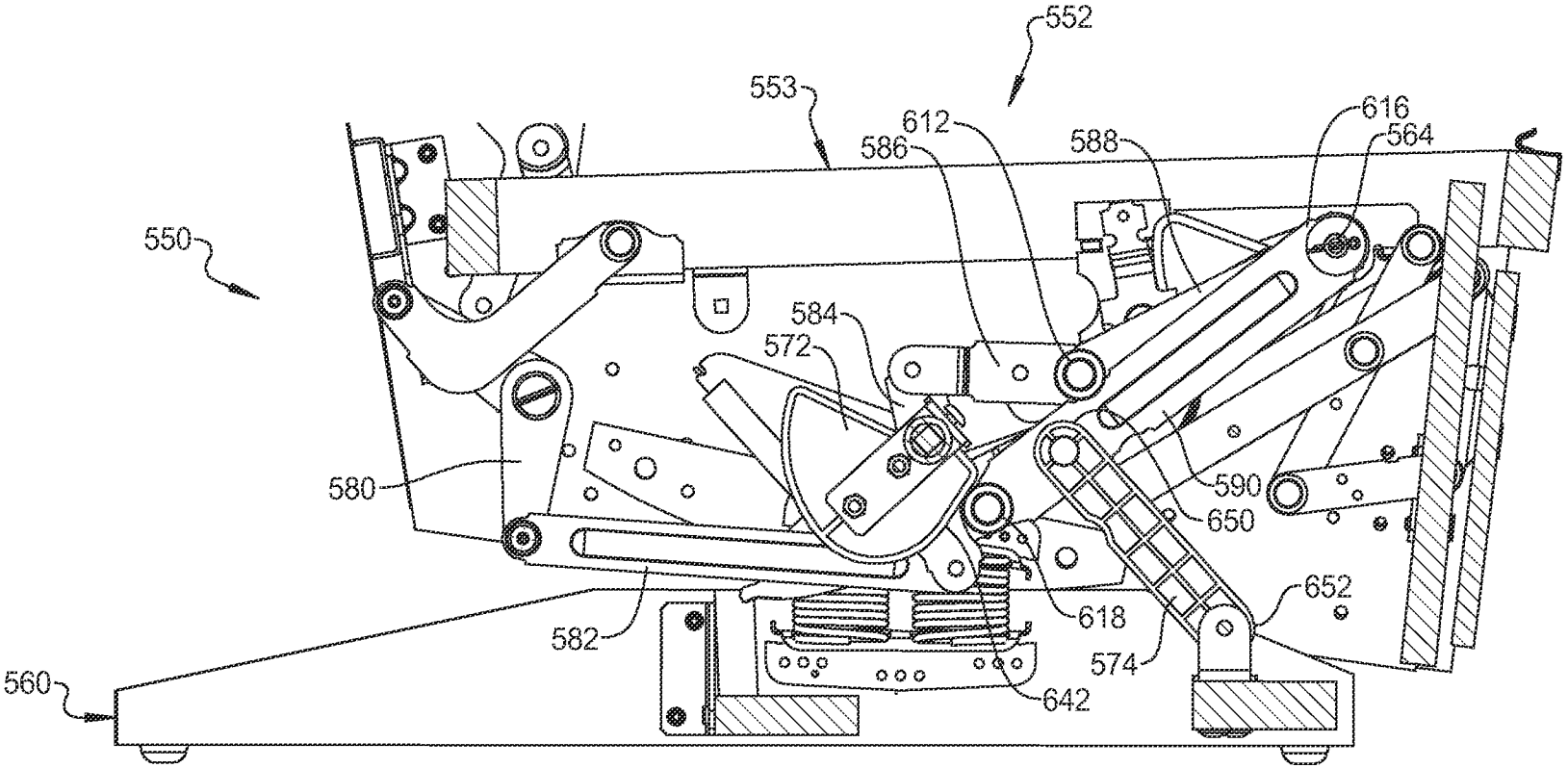
FIG. 41 is a side view of the tilt linkage assembly of the furniture member, with the tilt linkage assembly in the position of FIG. 29.
Figure 42:
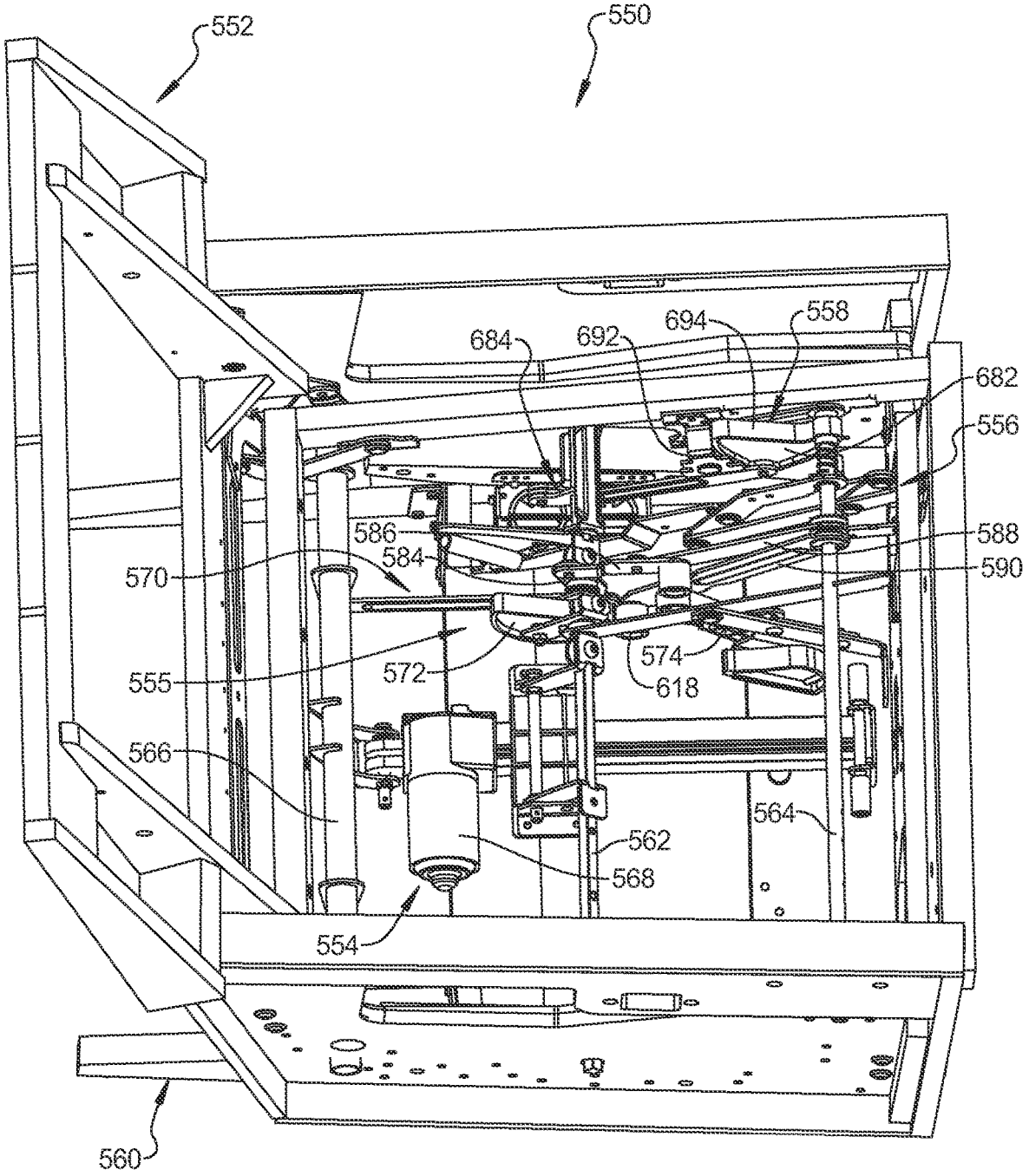
FIG. 42 is a perspective view of the synchronous mechanism, with the synchronous mechanism in a position of FIG. 26.
Figure 43:
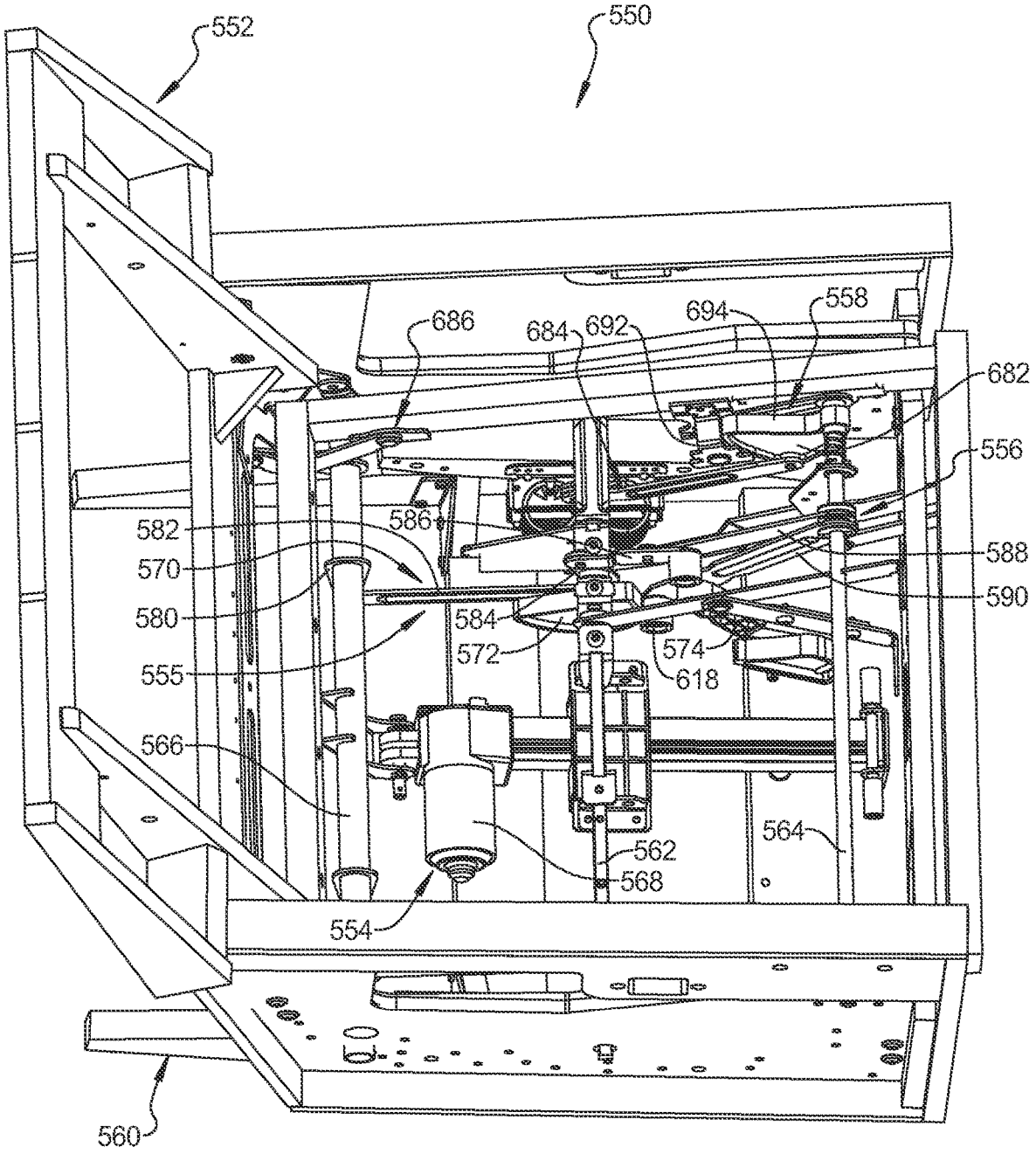
FIG. 43 is a perspective view of the synchronous mechanism, with the synchronous mechanism in a position of FIG. 30.
Figure 44:
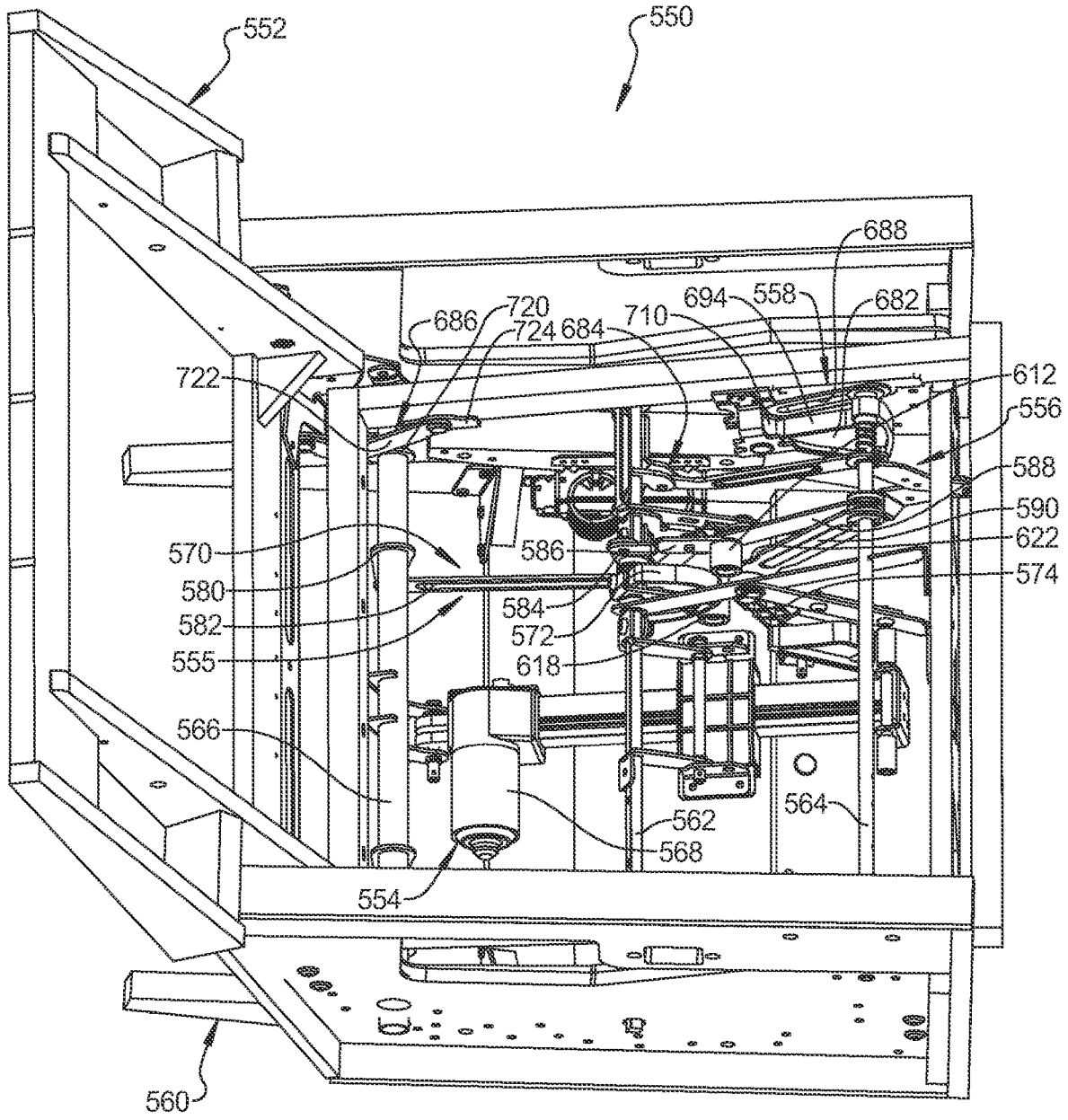
FIG. 44 is a perspective view of the synchronous mechanism, with the synchronous mechanism in a position of FIG. 31.
Figure 45:
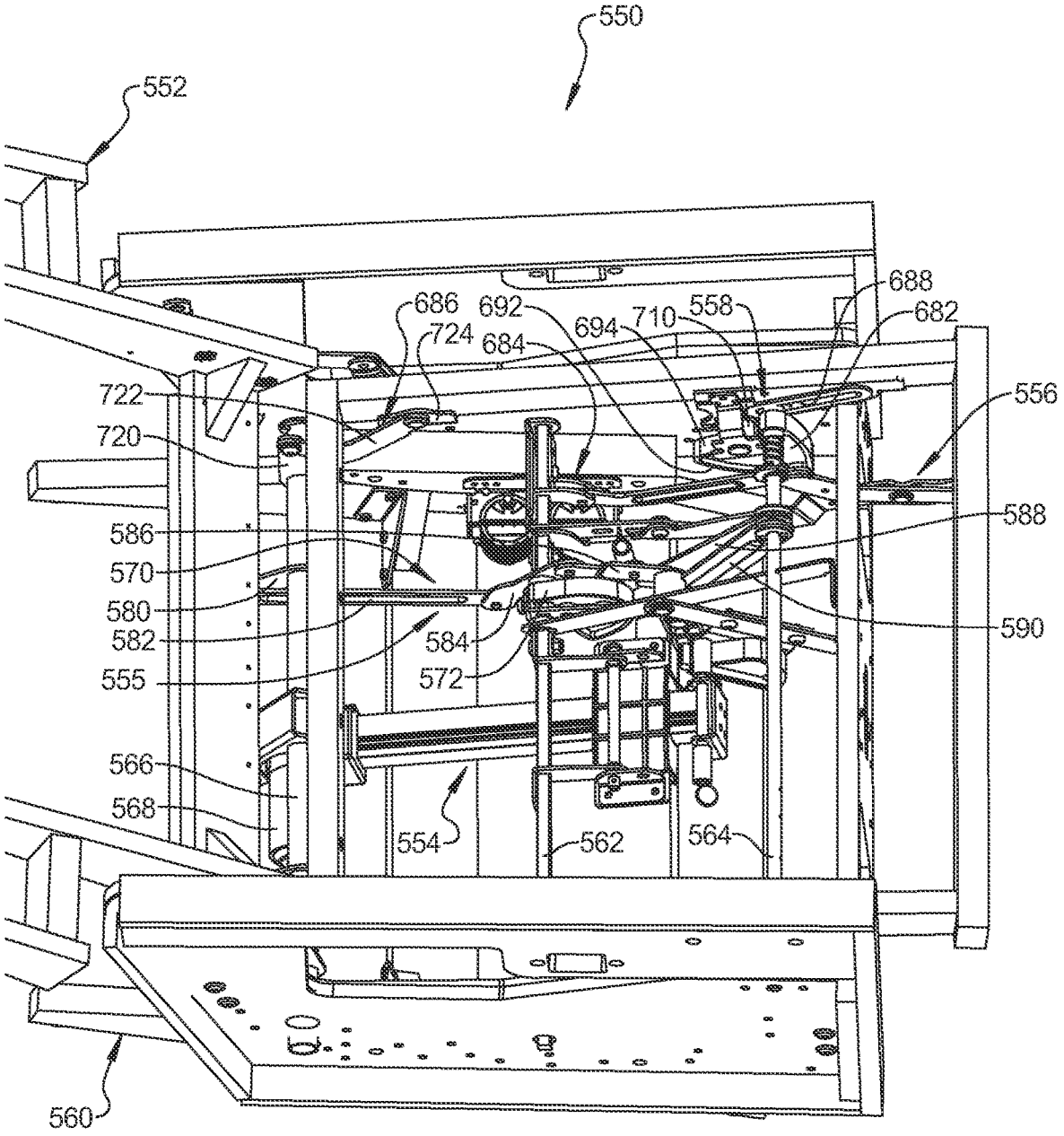
FIG. 45 is a perspective view of the synchronous mechanism, with the synchronous mechanism in a position of FIG. 32.

As shown in FIGS. 33 and 37-38, each of the sequencing mechanism 558 may include a slotted member 680, a cam 682, a first linkage 684, and a second linkage 686. The pair of sequencing mechanisms 558 may be disposed outboard of the pair of legrest mechanisms 556. The sequencing mechanisms 558 may be in mirror image configuration with each other. Only one of the sequencing mechanisms 558 is shown in the figures. The sequencing mechanism 558 is movable between a first position (FIG. 37) and a second position (FIG. 38). The first position of the sequencing mechanism 558 corresponds to when the seat assembly 552 is in the first synchronous position (FIG. 26). The second position of the sequencing mechanism 558 corresponds to when the seat assembly 552 is in the fourth synchronous position (FIG. 32).

The slotted member 680, the cam 682, and the first linkage 684 may be the same or substantially similar to the slotted member 380, the cam 382, and the first linkage 384 of the sequencing mechanism 58. Accordingly, the slotted member 680, the cam 682, and the first linkage 684 will not be re-described in detail.

The slotted member 680 may include a slot 688. The cam 682 may be rotatably coupled to the slotted member 680. The cam 682 may include a first side 690, a second side 692, and a third side 694 that cooperate to substantially form a triangular shape. A protrusion 696 may be formed between the first and third sides 690, 694 of the cam 682. The first support rod 564 may extend through the protrusion 696 and into the slot 688 of the slotted member 680.

The first linkage 684 may include a first drive link 698, a second drive link 700, and a connecting link 702. The drive rod 562 may extend through the first drive link 698 and the second drive link 700 may be secured to the drive rod 562. Accordingly, the first and second drive links 698, 700 are drivingly engaged with the drive rod 562. The connecting link 702 may include a first end 704 that is rotatably attached to the cam 682 and a second end 706 that is rotatably attached to the first and second drive links 698, 700. More specifically, the first end 704 of the connecting link 702 may be fixedly attached to the cam 682 in a location between the first and second sides 690, 692 of the cam 682. The second end 706 of the connecting link 702 may be positioned between the first and the second drive links 698, 700.

A follower wheel 710 may be coupled to the cam 682 and secured to the seat assembly 552 using a mounting bracket 712. A mechanical fastener 714 may extend through the follower wheel 710. The follower wheel 710 may rollingly engaged with the second and third sides 692, 694 of the cam 682. As illustrated in FIG. 37, the follower wheel 710 may contact the second side 692 of the cam 682 when the seat assembly 552 is in the first synchronous position. As illustrated in FIG. 38, the follower wheel 710 may contact the third side 694 of the cam 682, and more specifically abut the protrusion 696, when the seat assembly 552 is in the fourth synchronous position.

The second linkage 686 may include a first link 720, a second link 722, and a mounting bracket 724. The first link 720 may include a first end 726 and a second end 728 that opposes the first end 726. The first end 726 may receive the second support rod 566 and may be fixedly attached to the second support rod 566. The second end 728 may be rotatably attached to the second link 722. The second link 722 may include a first end 730 that is rotatably attached to the mounting bracket 724 and a second end 732 that is rotatably attached to the second end 728 of the first link 720. The mounting bracket 724 may be fixedly attached to the seat assembly 552.

With reference to FIGS. 26-45, the operation of the furniture member 550 will now be discussed.

As shown in FIGS. 26 and 28-29, the seat assembly 552 may rock among the nominal rock position (FIG. 26), the rearward-rock position (FIG. 28), and the forward-rock position (FIG. 29) when the legrest mechanism 556 is in the stowed position. In one example, when the seat assembly 552 is in the rearward-rock position, the seat assembly 552 may be placed approximately 15 degrees in a rearward direction relative to the nominal rock position and when the seat assembly 552 is in the forward-rock position, the seat assembly 552 may be placed approximately 7.5 degrees in a forward direction relative to the nominal rock position.

The seat assembly 552 may be manually powered by an occupant sitting in the furniture member 550. To move the seat assembly 552 from the nominal rock position to the rearward-rock position, the occupant may apply a force to the seatback assembly 551 in a rearward direction (e.g., toward a rearward end 740 of the furniture member 550). As a result, the seatback assembly 551 rocks rearward and simultaneously rocks the seat bottom assembly 553 rearward relative to the seat base 560. Movement of the seat bottom assembly 553 causes movement of the first support rod 564 in a corresponding direction. Because the sixth link 590 is attached to the first support rod 564, movement of the first support rod 564 causes the sixth link 590 to pivot about the first end 616 of the sixth link 590 and thereby, causes the wheel support panel 574 to pivot about the second end 652 and in a forward direction (e.g., toward a forward end 742 of the furniture member 550).

Additionally, movement of the first support rod 564 causes the fifth link 588 to pivot at the second end 614 of the fifth link 588. Because the fifth link 588 is attached to the fourth link 586, the fourth link 586 is attached to the third link 584, the third link is attached to the second link 582, and the second link 582 is attached to the first link 580, movement of the fifth link 588 simultaneously causes the fourth, third, second, and first links 586, 584, 582, 580 to move in a corresponding direction.

As the sixth link 590 and the wheel support panel 574 continue to move, the second follower wheel 618 contacts the recess 654 of the wheel support panel 574. Contact of the second follower wheel 618 and the recess 654 restricts the sixth link 590 from further movement and thereby, restricts the seat assembly 552 from moving further rearward. In other words, when the second follower wheel 618 contacts the recess 654 of the wheel support panel 574, the seat assembly 552 is in a full rearward-rock position.

To move the seat assembly 552 from the nominal rock position to the forward-rock position, the occupant may apply a force to the seat bottom assembly 553 in the forward direction. As a result, the seat assembly 552 rocks forward relative to the seat base 560. Movement of the seat assembly 552, and more specifically the seat bottom assembly 553, simultaneously causes the first support rod 564 to move in a corresponding direction. Because the sixth link 590 is attached to the first support rod 564, movement of the first support rod 564 causes the sixth link 590 to pivot about the first end 616 of the sixth link 590 in an upward direction (e.g., toward the seat bottom assembly 553).

Additionally, movement of the first support rod 564 causes the fifth link 588 to pivot about the second end 614 of the fifth link 588 in the upward direction. Because the fifth link 588 is attached to the fourth link 586, the fourth link 586 is attached to the third link 584, the third link is attached to the second link 582, and the second link 582 is attached to the first link 580, movement of the fifth link 588 simultaneously causes the fourth, third, second, and first links 586, 584, 582, 580 to move in a corresponding direction.

As the sixth link 590 and the wheel support panel 574 continue to move, the first follower wheel 612 contacts the recess 622 of the sixth link 590 and the second follower wheel 618 contacts the first side 642 of the cam 572. Accordingly, the first and second follower wheels 612, 618 restrict further movement of the fifth and sixth links 588, 590, respectively and therefore, restricts the seat assembly 552 from moving further forward. In other words, when the first follower wheel 612 contacts the recess 6222 of the sixth link 590 and the second follower wheel 618 contacts the first side 642 of the cam 572, the seat assembly 552 is in a full forward-rock position.

One of ordinary skill in the art should appreciate that the seat assembly 552 may move from the forward-rock position to the rearward-rock position, and vice versa. Additionally, the seat assembly 552 may move from any position between the nominal rock position, forward-rock position, and rearward-rock position toward either of the forward-rock position or the rearward-rock position.

From the first synchronous position (FIG. 42) to the second synchronous position (FIG. 43), the motor 568 drives rotation of the drive rod 562. Rotation of the drive rod 562 simultaneously causes rotation of the set of linkages 570 and the cam 572. Rotation of the cam 572 causes the cam 572 to come into contact with the second follower wheel 618 and causes rotation of the sixth link 590. Rotation of the sixth link 590 causes rotation of the wheel support panel 574 such that the seat assembly 552 begins to move out of the nominal rock position and begin tilting toward the rearward-rock position. Additionally, rotation of the drive rod 562 causes the legrest mechanism 556 to move out of the stowed position and begin extending toward the deployed position. Lastly, rotation of the drive rod 562 causes the first linkages 684 of the sequencing mechanism 558 to rotate, and thereby rotate the cam 682. Because the follower wheel 710 is in contact with the second side 692 of the cam 682, the seat assembly 552 is restricted from moving out of the upright position and toward the reclined position.

From the second synchronous position (FIG. 43) to the third synchronous position (FIG. 44), the motor 568 further drives rotation of the drive rod 562. Further rotation of the drive rod 562 simultaneously causes further rotation of the set of linkages 570, the cam 572 and thereby, the wheel support panel 574. Accordingly, the seat assembly 552 continues to tilt toward the rearward-rock position. Additionally, further rotation of the drive rod 562 causes the legrest mechanism 556 to continue extending toward the extended position. In one example, when the seat assembly 552 is in the third synchronous position, the seat assembly 552 is placed at an approximately 9 degree body tilt relative to the nominal rock position.

Further rotation of the drive rod 562 also causes the first linkages 684 of the sequencing mechanism 558 to rotate, and thereby rotate the cam 682. The follower wheel 710 (FIG. 44) begins to contact the third side 694 of the cam 682 and therefore, allows the seat assembly 552 to move out of the upright position and begin to recline. More specifically, rotation of the drive rod 562 causes the third link 584 of the tilt linkage mechanism 555 to rotate and in response, causes the first and second links 580, 582 to rotate. Rotation of the first link 580 causes rotation of the second support rod 566 and rotation of the second support rod 566 causes the seat assembly 552 to begin to recline because the first and second links 720, 722 of the second linkage 686 are attached to the seat assembly 552 using the mounting bracket 724.

From the third synchronous position (FIG. 44) to the fourth synchronous position (FIG. 45), the motor 568 further drives rotation of the drive rod 562 and additionally drives rotation of the second support rod 566. Further rotation of the drive rod 562 simultaneously causes further rotation of the set of linkages 570, the cam 572 and thereby, the wheel support panel 574. Accordingly, the seat assembly 552 is placed in the rearward-rock position when the tilt linkage mechanism 555 is in the second position. Additionally, further rotation of the drive rod 562 causes the legrest mechanism 556 to be placed into the deployed position. Lastly, further rotation of the drive rod 562 causes the first linkages 684 of the sequencing mechanism 558 to rotate, and thereby rotate the cam 682. The follower wheel 710 continues to roll against the third side 694 of the cam 682, thereby continuing to allow the seat assembly 552 to recline. The motor 568 of the drive actuator mechanism 554 drives rotation of the second support rod 566. Rotation of the second support rod 566 drives rotation of the second linkage 686 and continues to drive the seat assembly 552 to be placed in the reclined position when the sequencing mechanism 558 is in the second position.

As shown in FIGS. 42-45, the seat assembly 552 first moves the legrest mechanism 556 from the first synchronous position to the fourth synchronous position and subsequently moves the seat assembly 552 from the upright position to the recline position. In some configurations, there may be a transition period where the seat assembly 552 begins moving out of the upright position as the legrest mechanism 556 moves into the extended position.

Additionally, the tilt linkage mechanism 555 moves the seat assembly 552 from nominal rock position to the rearward-rock position simultaneously with movement of the legrest mechanism 56 from the retracted position to the extended position and movement of the seat assembly 552 from the upright position to the recline position. More specifically, the seat assembly 552 is placed at approximately a 9 degree body tilt relative to the nominal rock position when the legrest mechanism 556 is in the extended position and the seat assembly 552 is placed at an approximately 14 degrees of body tilt relative to the nominal rock position when the seat assembly is in the reclined position.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a seat base;

a seat assembly movable relative to the seat base, wherein the seat assembly is movable between a first recline position and a second recline position, and wherein the seat assembly is movable between a first tilt position and a second tilt position;

a legrest platform coupled to the seat assembly and movable between a first legrest position and a second legrest position;

a drive rod rotatable relative to the seat assembly, wherein rotation of the drive rod causes the seat assembly to move from the first tilt position to the second tilt position and causes the legrest platform to move from the first legrest position to the second legrest position;

a tilt linkage mechanism including a clevis drivingly engaged to the drive rod and a wheel support panel pivotally attached to the seat base; and a sequencing mechanism including a cam attached to the drive rod and a follower wheel attached to the seat assembly, wherein the cam is configured to prevent the seat assembly from moving between the first recline position and the second recline position while the seat assembly moves between the first tilt position and the second tilt position and while the legrest platform moves between the first legrest position and the second legrest position.

2. The furniture member of claim 1, wherein rotation of the drive rod causes a first surface of the cam to contact the follower wheel and subsequent rotation of the drive rod causes a second surface of the cam to contact the follower wheel.

3. The furniture member of claim 2, wherein:

when the first surface of the cam contacts the follower wheel, the sequencing mechanism is configured to prevent the seat assembly from reclining from the first recline position to the second recline position, and when the second surface of the cam contacts the follower wheel, the sequencing mechanism is configured to allow the seat assembly to recline from the first recline position to the second recline position.

4. The furniture member of claim 1, further comprising a motor powering rotation of the drive rod.

5. The furniture member of claim 4, wherein:

actuation of the motor controls movement of the seat assembly to achieve intermediate positions between the first recline position and the second recline position and intermediate positions between the first tilt position and the second tilt position; and actuation of the motor controls movement of the legrest platform to achieve intermediate positions between the first legrest position and the second legrest position.

6. The furniture member of claim 4, further comprising:

a rail attached to the motor;

a sliding carriage attached to the drive rod and coupled to the rail; and a support rod rotatable relative to the seat assembly and coupled to the motor.

7. The furniture member of claim 6, wherein:

the motor drives the sliding carriage to slide along the rail and simultaneously causes the drive rod to rotate; and rotation of the drive rod causes the seat assembly to simultaneously move between the first tilt position and the second tilt position and the legrest platform to simultaneously move between the first legrest position and the second legrest position.

8. The furniture member of claim 6, wherein:

the motor drives the rail to slide relative to the sliding carriage and simultaneously causes the support rod to rotate; and rotation of the support rod causes the seat assembly to move between the first recline position and the second recline position.

9. The furniture member of claim 1, wherein rotation of the drive rod causes the clevis to drive rotation of the wheel support panel, and rotation of the wheel support panel causes the seat assembly to move relative to the seat base between the first tilt position and the second tilt position.

10. The furniture member of claim 1, wherein the tilt linkage mechanism includes:

a first link rotatably attached to the clevis and the wheel support panel, the first link is movable independently of the clevis, and a second link rotatably attached to the wheel support panel, and having a follower wheel extending from the second link.

11. The furniture member of claim 10, wherein:

the seat assembly is rockable between a first rock position and a second rock position, the first and second links and the wheel support panel simultaneously rotate as the seat assembly moves between the first and second rock positions; and the seat assembly is rockable between the first rock position and the second rock position when the legrest platform is in the first legrest position.

12. The furniture member of claim 11, wherein when the follower wheel contacts the wheel support panel, the seat assembly is in the first rock position and is restricted from rocking further in a rearward direction.

13. The furniture member of claim 11, wherein when the first link contacts the clevis, the seat assembly is in the second rock position and is restricted from rocking further in a forward direction.

14. A furniture member comprising:

a seat base;

a seat assembly movable relative to the seat base, wherein the seat assembly is movable between an upright position and a reclined position, and wherein the seat assembly is movable between a nominal tilt position and a rearward-tilt position;

a legrest platform coupled to the seat assembly, wherein the legrest platform is movable between a stowed position and a deployed position;

a drive rod rotatable relative to the seat assembly, wherein rotation of the drive rod causes the legrest platform to move from the stowed position to the deployed position;

a support rod rotatable relative to the seat assembly, wherein rotation of the support rod causes the seat assembly to move between the upright position and the reclined position; and a tilt linkage mechanism including a set of linkages attached the drive rod and the support rod, a first cam attached to the drive rod, and a first follower wheel movable into rolling contact with the first cam, and a wheel support panel rotatably attached to the seat base, wherein the tilt linkage mechanism is configured to allow the seat assembly to move between the nominal tilt position and the rearward-tilt position simultaneously while the legrest platform moves between the stowed position and the deployed position and the seat assembly moves between the upright position and the reclined position.

15. The furniture member of claim 14, further comprising:

a sequencing mechanism including a second cam attached to the drive rod and a second follower wheel attached to the seat assembly, wherein the second cam includes a first surface, a second surface, and third surface.

16. The furniture member of claim 15, wherein when the first surface of the second cam contacts the second follower wheel, the second cam is configured to prevent the seat assembly from moving between the upright position and the reclined position.

17. The furniture member of claim 15, wherein when the second surface of the second cam contacts the second follower wheel, the second cam is configured to allow the seat assembly to move between the upright position and the reclined position.

18. The furniture member of claim 14, further comprising a motor powering rotation of the drive rod.

19. The furniture member of claim 18, wherein:

actuation of the motor controls movement of the seat assembly to achieve intermediate positions between the upright position and the reclined position and intermediate positions between the nominal tilt position and the rearward-tilt position; and actuation of the motor controls movement of the legrest platform to achieve intermediate positions between the stowed position and the deployed position.

20. The furniture member of claim 18, further comprising:

a rail attached to the motor; and a sliding carriage attached to the drive rod.

21. The furniture member of claim 20, wherein:

the motor first drives the sliding carriage to slide along the rail and simultaneously causes the drive rod to rotate; and the motor subsequently drives the rail to slide relative to the sliding carriage and simultaneously causes the support rod to rotate.

22. The furniture member of claim 14, wherein the set of linkages of the tilt linkage mechanism includes a first link coupled to the support rod and a second link coupled to the drive rod.

23. The furniture member of claim 14, wherein rotation of the first cam causes the first cam to contact the first follower wheel and simultaneously drive the set of linkages such that the seat assembly moves from the nominal tilt position to the rearward-tilt position.

24. The furniture member of claim 14, wherein:

the seat assembly is sequenced to move from a first synchronous position to a second synchronous position and from a third synchronous position to a fourth synchronous position;

when the seat assembly moves between the first synchronous position and the fourth synchronous position, the seat assembly moves between the nominal tilt position and the rearward-tilt position and the legrest platform moves between the stowed position and the deployed position; and when the seat assembly moves between the second synchronous position and the fourth synchronous position, the seat assembly moves between the upright position and the reclined position.

25. The furniture member of claim 14, wherein the seat assembly is rockable between a rearward-rock position and a forward-rock position, the set of linkages and the wheel support panel simultaneously rotate as the seat assembly moves between the rearward-rock and forward-rock positions;

the seat assembly is free to rock between the forward-rock position and the rearward-rock position when the legrest platform is in the stowed position; and the seat assembly is restricted from rocking between the forward-rock position and the rearward-rock position when the legrest platform is in the deployed position.

26. The furniture member of claim 25, wherein when the first follower wheel contacts the wheel support panel, the seat assembly is in the rearward-rock position and is restricted from rocking further in a rearward direction.

27. The furniture member of claim 25, wherein when the first follower wheel contacts the first cam, the seat assembly is in the forward-rock position and is restricted from rocking further in a forward direction.

* * * * *